US005619976A

United States Patent [19]

Kitagawa et al.

[11] Patent Number: 5,619,976

[45] Date of Patent: Apr. 15, 1997

[54] CONTROL SYSTEM EMPLOYING CONTROLLER OF RECURRENCE FORMULA TYPE FOR INTERNAL COMBUSTION ENGINES

[75] Inventors: Hiroshi Kitagawa; Hidetaka Maki; Norio Suzuki, all of Wako, Japan

[73] Assignee: Honda Giken Kogyo Kabushiki Kaisha, Tokyo, Japan

[21] Appl. No.: 602,115

[22] Filed: Feb. 23, 1996

[30] Foreign Application Priority Data

| | | | |
|---|---|---|---|
| Feb. 24, 1995 | [JP] | Japan | 7-061776 |
| Feb. 24, 1995 | [JP] | Japan | 7-061781 |
| Feb. 24, 1995 | [JP] | Japan | 7-061783 |

[51] Int. Cl.[6] ..... F02D 41/00; F02D 41/14

[52] U.S. Cl. ..... 123/679

[58] Field of Search ..... 123/679, 436, 123/489, 698, 682, 680, 681, 683, 687, 689, 672, 673, 674, 684

[56] References Cited

U.S. PATENT DOCUMENTS

| | | | |
|---|---|---|---|
| 5,129,379 | 7/1992 | Kaneyasu et al. | 123/436 |
| 5,241,943 | 9/1993 | Miyashita et al. | 123/679 |
| 5,253,630 | 10/1993 | Akazaki et al. | 123/682 |
| 5,335,643 | 8/1994 | Abate et al. | 123/679 |
| 5,381,775 | 1/1995 | Birk et al. | 123/679 |
| 5,485,826 | 1/1996 | Ohata et al. | 123/679 |

FOREIGN PATENT DOCUMENTS

| | | |
|---|---|---|
| 60-56253 | 12/1985 | Japan . |
| 3-185244 | 8/1991 | Japan . |
| 4-209940 | 7/1992 | Japan . |
| 5-52140 | 3/1993 | Japan . |
| 6-146998 | 5/1994 | Japan . |

OTHER PUBLICATIONS

"Comptrol", Computer and Application's Mook, No. 27, Jul. 10, 1989, pp. 28–41.

"Automatic Control Handbook", Ohm, Ltd., Japan, pp. 701–707.

"A Survey of Model Reference Adaptive Techniques—Theory and Applications", Landau, *Automatica,* vol. 10, 1974, pp. 353–379.

"Unification of Discrete Time Explicit Model Reference Adaptive Control Designs", Landau et al, *Automatica,* vol. 17, No. 4, 1981, pp. 593–611.

"Combining Model Reference Adaptive Controllers and Stochastic Self-tuning Regulators", Landau, *Automatica,* vol. 18, No. 1, 1982, pp. 77–84.

*Primary Examiner*—Raymond A. Nelli

*Attorney, Agent, or Firm*—Nikaido, Marmelstein, Murray & Oram LLP

[57] ABSTRACT

A control system for an internal combustion engine has an air-fuel ratio sensor arranged in the exhaust system. An air-fuel ratio feedback control carried out based on an output from the air-fuel ratio sensor such that an air-fuel ratio of an air-fuel mixture supplied to the engine is converged to a desired air-fuel ratio is selected between a high-response feedback control using an adaptive controller of a recurrence formula type and a low-response feedback control with a lower response speed than a response speed of the high-response feedback control. Operating conditions of at least one of the engine and an automotive vehicle on which engine is installed are detected. It is determined whether or not the engine is in an unsteady operating condition in which combustion of the engine undergoes a variation, based on detected operating conditions of at least one of the engine and the vehicle. The low-response feedback control is selected at least when it is determined that the engine is in the unsteady operating condition.

25 Claims, 33 Drawing Sheets

SPN
70
20
18
23
19
16
31
17
22
30
60
15
5
33
32
1
14
IG
ECU5
ECU
TW
13
12
11
40
PBA
10
9
43
44
3
4
7
6
θTH
42
TA
8
2
41
21
PA

FIG.7A
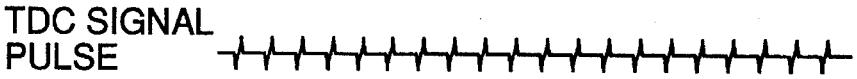
FIG.7B
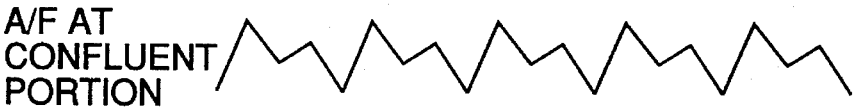
FIG.8A
FIG.8B
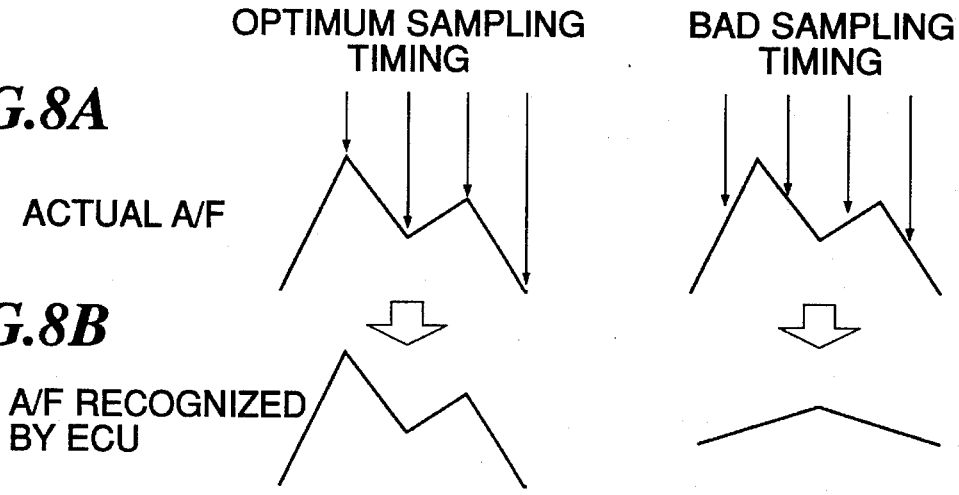

CALCULATION OF KFB
S401
OPEN-LOOP CONTROL IN LAST LOOP ?
YES
NO
S402
DKCMD > DKCMDREF ?
YES
NO
S403
C=0
S404
C=C+1
S405
C≦CREF ?
YES
NO
S406
F/B REGION DETERMINATION
S407
HIGH-RESPONSE F/B REGION ?
NO
YES
S408
HIGH-RESPONSE F/B
S409
| KSTR(k)−1.0 | >KSTRREF ?
YES
NO
S410
KFB=KSTR
S411
LOW-RESPONSE F/B
EXIT

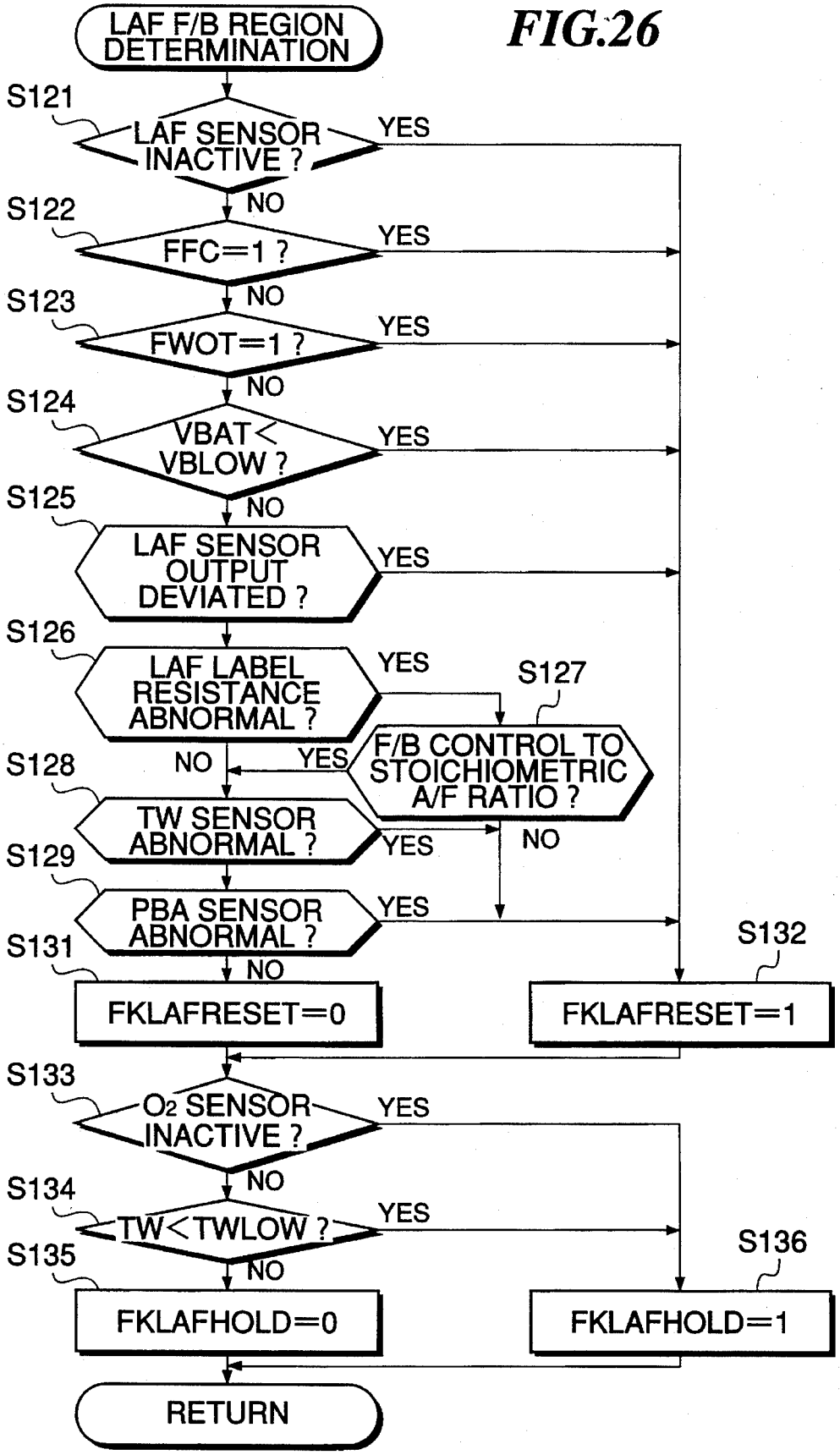
FIG.26
LAF F/B REGION DETERMINATION
S121
LAF SENSOR INACTIVE ?
YES
NO
S122
FFC=1 ?
YES
NO
S123
FWOT=1 ?
YES
NO
S124
VBAT< VBLOW ?
YES
NO
S125
LAF SENSOR OUTPUT DEVIATED ?
YES
S126
LAF LABEL RESISTANCE ABNORMAL ?
YES
S127
F/B CONTROL TO STOICHIOMETRIC A/F RATIO ?
NO
YES
S128
TW SENSOR ABNORMAL ?
YES
NO
S129
PBA SENSOR ABNORMAL ?
YES
NO
S131
FKLAFRESET=0
S132
FKLAFRESET=1
S133
O2 SENSOR INACTIVE ?
YES
NO
S134
TW<TWLOW ?
YES
NO
S135
FKLAFHOLD=0
S136
FKLAFHOLD=1
RETURN CALCULATION OF KFB
S401
OPEN-LOOP CONTROL IN LAST LOOP ?
YES
NO
S402
DKCMD > DKCMDREF ?
YES
NO
S403
C=0
S404
C=C+1
S405
C≦CREF ?
YES
NO
S156
F/B REGION DETERMINATION
S157
HIGH-RESPONSE F/B REGION ?
NO
YES
S158
FKSTR=0 IN LAST LOOP ?
NO
YES
S159
KACT≧ KACTLMTH ?
YES
NO
S160
KACT≦ KACTLMTL ?
YES
NO
S408
HIGH-RESPONSE F/B
S409
| KSTR(k)−1.0 | >KSTRREF ?
YES
NO
S411
LOW-RESPONSE F/B
S410
KFB=KSTR(k)
RETURN F/B REGION DETERMINATION
S172
V/T CHANGEOVER ABNORMAL ?
YES
NO
S173
CYL/TDC SENSOR ABNORMAL ?
YES
NO
S174
STR DIVERGED ?
YES
NO
S175
TW< TWSTRON ?
YES
NO
S176
NE≧ NESTRLMT ?
YES
NO
S177
Hi V/T ?
YES
NO
S178
IDLING ?
YES
NO
S179
θ TH SENSOR ABNORMAL ?
YES
NO
S180
RETRIEVE PBTHFS
PBLOW=PBTHFS
S181
S182
PBA<PBLOW ?
YES
NO
S183
KACT<a ?
YES
NO
S184
KACT>b ?
YES
NO
S185
HIGH-RESPONSE F/B
S186
LOW-RESPONSE F/B
RETURN

CONTROL SYSTEM EMPLOYING CONTROLLER OF RECURRENCE FORMULA TYPE FOR INTERNAL COMBUSTION ENGINES

BACKGROUND OF THE INVENTION

1. Field of the Invention

This invention relates to a control system for internal combustion engines, and more particularly to a control system of this kind, which controls the air-fuel ratio of an air-fuel mixture supplied to the engine in a feedback manner, by applying an adaptive control theory thereto or by the use of a controller of a recurrence formula type.

2. Prior Art

Conventionally, an air-fuel ratio control system for internal combustion engines has been proposed e.g. by Japanese Laid-Open Patent Publication (Kokai) No. 3-185244, in which an optimal regulator which is one of modern control theories is applied to air-fuel ratio feedback control based on an output from a linear-output oxygen concentration sensor (LAF sensor) arranged in the exhaust system of the engine, whereby the air-fuel ratio feedback control is carried out by the use of the output from the LAF sensor and an optimum feedback gain calculated based on a dynamic model representative of a behavior of the engine (adaptive control).

In the air-fuel ratio feedback control having the optimal regulator applied thereto, a recurrence formula representing a correlation between a result of measurement or detection of the air-fuel ratio and control amounts applied in the past is prepared, to thereby obtain an optimal value of the control amount to be applied in the following execution of the air-fuel ratio control. The air-fuel ratio feedback control utilizing the optimal regulator is high in control response, and is therefore very effective means for controlling the air-fuel ratio of the mixture so long as the engine combustion continues to be in a steady or stable condition.

However, if the air-fuel ratio feedback control utilizing the optimal regular is carried out when the engine is decelerating, the engine combustion becomes unstable, which results in large variations in the detected air-fuel ratio of the mixture. To suppress such undesired variations of the air-fuel ratio, there has been proposed an air-fuel ratio control system for an internal combustion engine by Japanese Laid-Open Patent Publication (Kokai) No. 4-209940, which, when the engine is decelerating, applies an optimal feedback gain which imparts lower responsiveness to the control system or effects changeover from adaptive control to proportional term/integral term control (PI control).

However, the air-fuel ratio feedback control utilizing the optimal regulator relies on results of control operations executed in the past. Therefore, when the engine is in an operating condition where continuity of the control cannot be maintained, erroneous or unsuitable control amounts can be calculated even when the engine is not decelerating. For example, if the engine combustion is not in a steady or stable state, hunting can occur due to the high responsiveness of the feedback control utilizing the optimal regulator. That is, the accuracy and stability of the control by the use of the optimal regulator lowers when the air-fuel ratio of the mixture undergoes a drastic change, the engine combustion is degraded, the air-fuel ratio of the mixture cannot be detected with accuracy, or a correct amount of fuel corresponding to a calculated control amount is not supplied to the engine, for example. Therefore, from the viewpoint of driveability and exhaust emission characteristics of the engine, the proposed air-fuel ratio feedback control utilizing the optimal regulator has room for improvement. This problem becomes very serious, especially with an adaptive controller using a recurrence formula, which has still higher responsiveness than the optimal regulator.

On the other hand, an air-fuel ratio control system has been proposed by Japanese Patent Publication (Kokai) No. 60-56353, which interrupts execution of air-fuel ratio feedback control for controlling the air-fuel ratio based on an output from an oxygen concentration sensor, which detects the concentration of oxygen in exhaust gases emitted from the engine, when the oxygen concentration sensor is determined to be abnormal.

Further, there has been also proposed an air-fuel ratio control system by Japanese Laid-Open Patent Publication (Kokai) No. 5-52140, which interrupts execution of the feedback control (adaptive control) based on an optimal feedback gain calculated by the use of the optimal regulator described above when the linear-output air-fuel ratio sensor is in a half-warmed-up condition (i.e. before it is fully warmed up), but executes the air-fuel ratio feedback control by the PID method.

However, the air-fuel ratio control system disclosed in Japanese Patent Publication (Kokai) No. 60-56253 interrupts execution of the feedback control when abnormality of the oxygen concentration sensor has been detected, and therefore there is room for improvement in respect of exhaust emission characteristics and driveability of the engine during the interruption of the feedback control.

The air-fuel ratio control system disclosed in Japanese Laid-Open Patent Publication (Kokai) No. 5-52140 contemplates a half-warmed-up condition of the linear-output air-fuel ratio sensor, but does not contemplate abnormality of sensors including the linear-output air-fuel ratio sensor. Therefore, there remains room for improvement in respect of exhaust emission characteristics and driveability of the engine which would be degraded when any of the sensors is abnormal.

Further, an air-fuel ratio control system is known, which carries out PID air-fuel ratio control of a mixture supplied to an internal combustion engine, based on an output from a linear-output air-fuel ratio sensor arranged in the exhaust passage by the use of a proportional term, an integral term, and a differential term, and detects abnormality of a fuel supply system of the engine by the use of the integral term.

However, if this abnormality-detecting method is directly applied to an air-fuel ratio control system using the aforementioned optimal regulator having such fairly high control speed that correction coefficients calculated during the feedback control are changed at high speeds and by fairly large amounts, it is impossible to detect abnormality of the fuel supply system with accuracy.

SUMMARY OF THE INVENTION

It is a first object of the invention to provide a control system for an internal combustion engine, which is capable of maintaining sufficient accuracy and stability of the air-fuel ratio control even when the engine combustion is not in a steady or stable condition, thereby maintaining excellent driveability and exhaust emission characteristics of the engine on such an occasion.

It is a second object of the invention to provide a control system for an internal combustion engine, which is capable of continuing the air-fuel ratio feedback control so long as it is possible to carry out the same even when abnormality of any of sensors is detected, thereby minimizing the degree of degradation of exhaust emission characteristics and driveability of the engine.

It is a third object of the invention to provide a control system for an internal combustion engine, which is capable of detecting abnormality of a fuel supply system of the engine with ease and accuracy while carrying out the air-fuel ratio feedback control by the use of a controller of the recurrence formula type at the same time.

To attain the first object, according to a first aspect of the invention, there is provided a control system for an internal combustion engine having an exhaust system, the engine being installed on an automotive vehicle, comprising:

an air-fuel ratio sensor arranged in the exhaust system;

first control means for controlling an amount of fuel to be supplied to the engine in a feedback manner based on an output from the air-fuel ratio sensor by using an adaptive controller of a recurrence formula type, such that an air-fuel ratio of an air-fuel mixture supplied to the engine is converged to a desired air-fuel ratio;

second control means for controlling the amount of the fuel to be supplied to the engine in a feedback manner with a response speed lower than a response speed of the first control means, based on the output from the air-fuel ratio sensor, such that the air-fuel ratio of the air-fuel mixture supplied to the engine is converged to the desired air-fuel ratio;

operating condition-detecting means for detecting operating conditions of at least one of the engine and the vehicle;

unsteady condition-determining means for determining whether or not the engine is in an unsteady operating condition in which combustion of the engine undergoes a variation, based on an output from the operating condition-detecting means; and selecting means for selecting between the first control means and the second control means for controlling the amount of fuel to be supplied to the engine, the selecting means selecting the second control means at least when the unsteady condition-determining means determines that the engine is in the unsteady operating condition.

Preferably, the adaptive controller of the first control means has a parameter-adjusting mechanism for adjusting adaptive parameters used by the adaptive controller.

Preferably, the second control means controls the amount of fuel to be supplied to the engine in a feedback manner based on the output from the air-fuel ratio sensor by using an adaptive controller of a recurrence formula type, such that the air-fuel ratio of the air-fuel mixture supplied to the engine is converged to the desired air-fuel ratio, the adaptive controller of the second control means having a parameter-adjusting mechanism for adjusting adaptive parameters used thereby, the parameter-adjusting mechanism of the adaptive controller of the second control means adjusting the adaptive parameters used by the adaptive controller of the second control means at a speed lower than a speed at which the parameter-adjusting mechanism of the adaptive controller of the first control means adjusts the adaptive parameters used by the adaptive controller of the first control means.

Alternatively, the second control means controls the amount of the fuel to be supplied to the engine in the feedback manner by using at least one of a proportional term, a differential term, and an integral term.

Preferably, the selecting means selects the first control means after a predetermined time period elapses from the time it is determined that the engine enters a steady operating condition in which the combustion of the engine is stable.

Preferably, the operating condition-detecting means includes means for detecting a decelerating condition of the engine.

Preferably, the operating condition-detecting means includes means for detecting a temperature of the engine.

Preferably, the operating condition-detecting means includes means for detecting a retardation of ignition timing of the engine.

Preferably, the operating condition-detecting means includes means for detecting interruption of fuel supply to the engine.

Preferably, the engine includes traction control means for controlling an excessive slip of wheels of the vehicle, the operating condition-detecting means including means for detecting operation of the traction control means.

Preferably, the engine includes engine output characteristic control means for controlling an output characteristic of the engine, the operating condition-detecting means including means for detecting operation of the engine output characteristic control means.

Preferably, the vehicle has a transmission, the operating condition-detecting means detects shift gear position-changing operation of the transmission.

Preferably, the operating condition-detecting means includes means for detecting a change in the desired air-fuel ratio of the mixture supplied to the engine.

To attain the second object, according to a second aspect of the invention, there is provided control system for an internal combustion engine having an exhaust system, comprising:

an air-fuel ratio sensor arranged in the exhaust system;

first control means for controlling an amount of fuel to be supplied to the engine in a feedback manner based on an output from the air-fuel ratio sensor by using a controller of a recurrence formula type, such that an air-fuel ratio of an air-fuel mixture supplied to the engine is converged to a desired air-fuel ratio;

second control means for controlling the amount of the fuel to be supplied to the engine in a feedback manner with a response speed lower than a response speed of the first control means based on the output from the air-fuel ratio sensor, such that the air-fuel ratio of the air-fuel mixture supplied to the engine is converged to the desired air-fuel ratio;

operating condition-detecting means for detecting operating conditions of the engine;

abnormality-detecting means for detecting abnormality of at least one of the engine and the control system, and fail-safe action means for at least inhibiting operation of the first control means in a manner dependent on the abnormality of the at least one of the engine and the control system, when the abnormality of the least one of the engine and the control system is detected.

Preferably, the controller of the first control means is an adaptive controller which has a parameter-adjusting mechanism for adjusting adaptive parameters used by the adaptive controller.

Preferably, the second control means controls the amount of fuel to be supplied to the engine in a feedback manner based on the output from the air-fuel ratio sensor by using a controller of a recurrence formula type, such that the air-fuel ratio of the air-fuel mixture supplied to the engine is converged to the desired air-fuel ratio, the controller of the second control means adjusting a gain used by the controller of the second control means at a speed lower than a speed at which the parameter-adjusting mechanism of the controller of the first control means adjusts a gain used by the controller of the first control means.

Alternatively, the second control means controls the amount of the fuel to be supplied to the engine in the feedback manner by using at least one of a proportional term, a differential term, and an integral term.

Preferably, the engine includes a plurality of cylinders, intake valves and exhaust valves provided for each of the plurality of cylinders, and valve timing-changing means for changing valve timing at which the intake valves and exhaust valves are operated, the abnormality-detecting means detecting abnormality of operation of the valve timing-changing means, the fail-safe action means inhibiting operation of the first control means and causing the second control means to operate, when the abnormality of the operation of the valve timing-changing means is detected.

Preferably, the engine includes a plurality of cylinders, the operating condition-detecting means including a TDC sensor for detecting a TDC position for each of the plurality of cylinders and a cylinder-discriminating sensor for discriminating each cylinder from other ones, the fail-safe action means inhibiting operation of the first control means and causing the second control means to operate, when abnormality of operation of at Least one of the TDC sensor and the cylinder-discriminating sensor is detected.

Preferably, the fail-safe action means inhibits operation of the first control means and cause the second control means to operate, when diverging of an air-fuel ratio correction coefficient output from the first control means is detected by the abnormality-detecting means.

Preferably, the engine includes an intake passage, and a throttle valve arranged in the intake passage, the operating condition-detecting means including a throttle valve opening sensor for detecting a degree of opening of the throttle valve, an intake passage pressure sensor for detecting pressure within the intake passage at a location downstream of the throttle valve, and an engine rotational speed sensor for detecting a rotational speed of the engine, the fail-safe action means inhibiting operation of the first control means and causing the second control means to operate, when abnormality of the throttle valve opening sensor is detected, provided that the pressure within the intake passage detected by the intake passage pressure sensor is lower than a predetermined value set according to the rotational speed of the engine detected by engine rotational speed sensor.

To attain the third object, according to a third aspect of the invention, there is provided control system, for an internal combustion engine having a fuel supply system, and an exhaust system, comprising:

an air-fuel ratio sensor arranged in the exhaust system;

control means for calculating an air-fuel ratio correction coefficient based on an output from the air-fuel ratio sensor by using a controller of a recurrence formula type to control an amount of fuel to be supplied to the engine in a feedback manner such that an air-fuel ratio of an air-fuel mixture supplied to the engine is converged to a desired air-fuel ratio;

smoothing means for smoothing a value of the air-fuel ratio correction coefficient calculated by the control means to obtain a smoothed value of the air-fuel ratio correction coefficient;

averaged coefficient value-calculating means for calculating an averaged value of the smoothed value of the air-fuel ratio correction coefficient; and abnormality-determining means for determining abnormality of the fuel supply system of the engine, based on the averaged value.

Preferably, the value of the air-fuel ratio correction coefficient used by the averaged coefficient value-calculating means is obtained when the air-fuel ratio detected by the air-fuel ratio sensor changes across the desired air-fuel ratio value.

Preferably, the engine including an intake system, a fuel tank, an evaporative emission control system for purging evaporative fuel generated from the fuel tank into the intake system, the control means having inhibiting means for inhibiting purging of evaporative fuel by the evaporative emission control system, when the averaged value of the smoothed value of the air-fuel ratio correction coefficient is smaller than a predetermined value which is slightly larger than a lower limit value of the averaged value, and for inhibiting determination of the fuel supply system by the abnormality-determining means when the averaged value exceeds the predetermined value after the inhibition of the purging of evaporative fuel by the evaporative emission control system.

Preferably, the abnormality-determining means determines that the fuel supply system is abnormal when the averaged value lies outside a range defined by predetermined upper and lower values.

The above and other objects, features, and advantages of the invention will become more apparent from the following detailed description taken in conjunction with the accompanying drawings.

BRIEF DESCRIPTION OF THE DRAWINGS

FIGS. 7A and 7B collectively form a timing chart showing the relationship between generation of TDC signal pulses of the engine and an air-fuel ratio detected at a confluent portion of the exhaust system of the engine (output from the LAF sensor), in which:

FIG. 7A shows TDC signal pulses; and

FIG. 7B shows the output from the LAF sensor;

FIGS. 8A and 8B show good and bad examples of timing of sampling output from the LAF sensor, in which:

FIG. 8A shows examples of sampling timing in relation to the actual air-fuel ratio; and FIG. 8B shows examples of the air-fuel ratio recognized by an ECU through sampling of the output from the LAF sensor;

FIG. 26 is a flowchart showing a subroutine for determining whether the engine is operating in an LAF feedback control region which is executed by the control system according to the fourth embodiment at the step S6 in FIG. 4;

DETAILED DESCRIPTION

The invention will now be described in detail with reference to drawings showing embodiments thereof.

Figure 1:
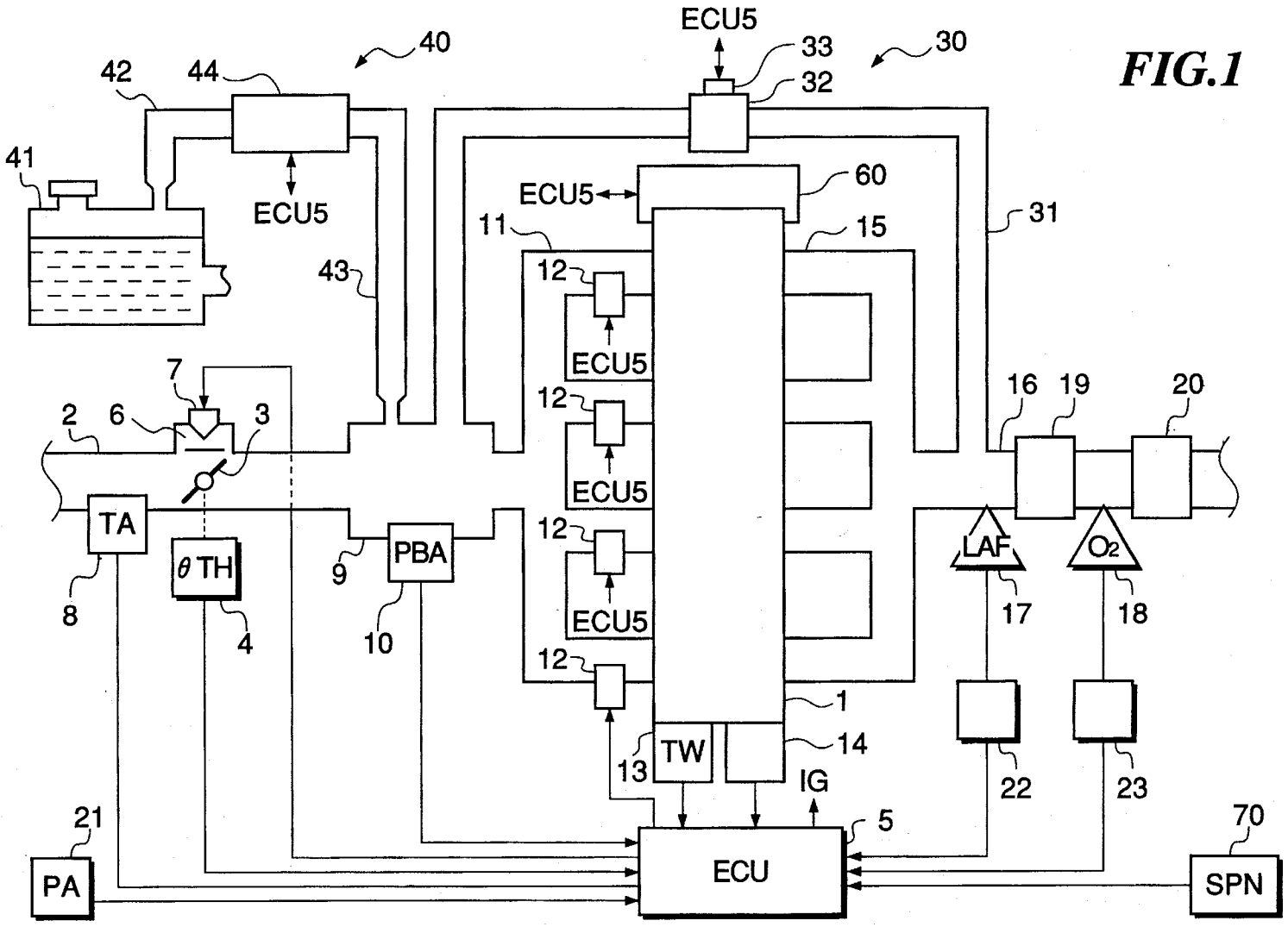
FIG. 1 is a block diagram showing the arrangement of an internal combustion engine and a control system therefor, according to a first embodiment of the invention.

Referring first to FIG. 1, there is schematically shown the whole arrangement of an internal combustion engine and an air-fuel ratio control system therefor, according to an embodiment of the invention. In the figure, reference numeral 1 designates a DOHC straight type four-cylinder internal combustion engine (hereinafter simply referred to as "the engine") having a pair of intake valves and a pair of exhaust valves provided for each cylinder, neither of which are shown.

An intake pipe 2 of the engine 1 is connected to a combustion chamber, not shown, of each cylinder of the engine 1, through a confluent portion (intake manifold) 11. Arranged in the intake pipe 2 is a throttle valve 3 to which is connected a throttle valve opening (θTH) sensor 4, for generating an electric signal indicative, of the sensed throttle valve opening θTH and supplying the same to an electronic control unit (hereinafter referred to as "the ECU") 5. An auxiliary air passage 6 is provided at the intake pipe 2, which bypasses the throttle valve 3. Arranged in the auxiliary air passage 6 is an auxiliary air amount control valve 7 which is connected to the ECU 5 to have its valve lift controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion as a chamber 9 at a location intermediate between the throttle valve 3 and the intake manifold 11 filled with an engine coolant. An intake pipe absolute pressure (PBA) sensor 10 is provided in communication with the interior of the chamber 9, for supplying an electric signal indicative of the sensed absolute pressure PBA to the ECU 5.

An engine coolant temperature (TW) sensor 13 is mounted in the cylinder block of the engine 1 filled with an engine coolant, for supplying an electric signal indicative of the sensed engine coolant temperature TW to the ECU 5. Connected to the ECU 5 is a crank angle sensor 14 for detecting the rotational angle of a crankshaft, not shown, of the engine 1 and supplying an electric signal indicative of the sensed rotational angle of the crankshaft to the ECU 5.

The crank angle sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing and for detecting the engine rotational speed NE.

Fuel injection valves 12 are inserted into the intake manifold 11 for respective cylinders at locations slightly upstream of the intake valves. The fuel injection valves 12 are connected to a fuel pump, not shown, and electrically connected to the ECU 5 to have fuel injection timing and fuel injection periods (valve opening periods) thereof controlled by signals therefrom. Spark plugs, not shown, of the engine 1 are also electrically connected to the ECU 5 to have ignition timing θIG thereof controlled by signals therefrom.

An exhaust pipe 16 is connected to the combustion chambers of the engine 1 through an exhaust manifold 15. A linear-output oxygen concentration sensor (hereinafter referred to as "the LAF sensor") 17 is arranged in the exhaust pipe 16 at a location immediately downstream of a confluent portion of the exhaust pipe 16. Further arranged in the exhaust pipe 16 are a first three-way catalyst (immediate downstream three-way catalyst) 19 and a second three-way catalyst (bed-downstream three-way catalyst) 20, and an oxygen concentration sensor (hereinafter referred to as "the 02 sensor") 18 inserted into the exhaust pipe 16 at a location intermediate between the three-way catalysts 19, 20. The three-way catalysts 19 and 20 function to purify noxious components in exhaust gases, such as HC, CO, and NOx.

The LAF sensor 17 is connected to the ECU 5 via a low-pass filter 22, for generating an electric signal which is almost proportional in value to the concentration of oxygen (air-fuel ratio) in exhaust gases from the engine and supplying the same to the ECU 5. The 02 sensor 18 has a characteristic that an electromotive force thereof drastically changes when the air-fuel ratio of exhaust gases changes across a stoichiometric air-fuel ratio, so that the 02 sensor 18 generates a high level signal when the air-fuel ratio of the exhaust gases is richer than the stoichiometric air-fuel ratio, and a low level signal when it is leaner than the same. The 02 sensor 18 is connected to the ECU 5 via a low-pass filter 23, for supplying a signal indicative of the sensed oxygen concentration to the ECU 5.

Arranged between the engine 1 and wheels, not shown, of a vehicle on which the engine 1 is installed is an automatic transmission, not shown, for transmitting torque generated by the engine 1 to the vehicle. The automatic transmission is comprised of a fluid clutch, etc. By operating a shift lever, not shown, the gear shift position can be changed to a P range, an N range, or a D range.

The automatic transmission has a shift position sensor SPN 70 for detecting the gear shift position, and an electric signal indicative of the sensed shift position is supplied to the ECU 5.

The wheels of the vehicle are provided with wheel speed sensors, not shown, for detecting rotational speeds of driving wheels and trailing wheels. Electric signals indicative of the sensed rotational speeds of the wheels are supplied to the ECU 5. The ECU 5 determines, based on detected rotational speeds of the driving and trailing wheels, whether or not the driving wheels are in an excessive slip state. If the excessive slip state of the driving wheels is detected, the ECU carries out traction control by making lean the air-fuel ratio of a mixture supplied to the engine or interrupting fuel supply to part of the cylinders, or by largely retarding the ignition timing.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 33 and supplying a signal indicative of the detected valve lift to the ECU 5. The EGR valve 32 is an electromagnetic valve having a solenoid which is connected to the ECU 5, the valve lift of which is linearly changed by a signal from the ECU 5.

Figure 2:
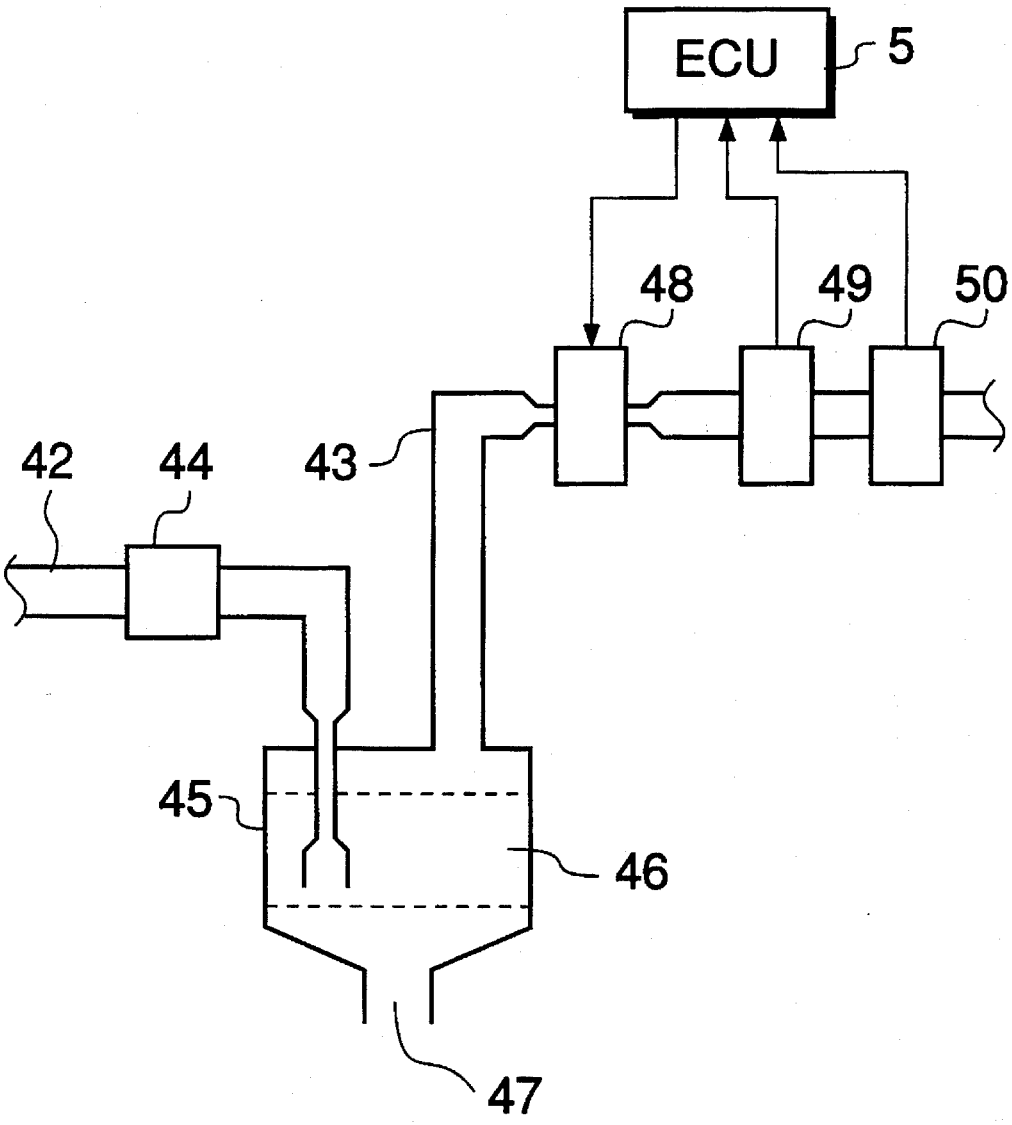
FIG. 2 is a block diagram showing details of the construction of an evaporative emission control system appearing in FIG. 1.

Next, an evaporative emission control system 40 for the engine will be described with reference to FIG. 2 as well. The evaporative emission control system 40 is comprised of a fuel tank 41, a canister 45, a passage 42 connecting between the tank 41 and the canister 45, and a purging passage 43 connecting between the canister 45 and the chamber 9 of the intake pipe 2. The canister 45 contains an adsorbent 45 for adsorbing evaporative fuel generated from the fuel tank 41 and is provided with an air inlet port 47 via which outside air is introduced into the canister 45. A two-way valve 44 having a positive pressure valve and a negative pressure valve, neither of which is shown, is arranged in the passage 42, while a purge control valve 48 formed by an electromagnetic valve of a duty control type, a flowrate sensor 49 for detecting a flow rate of a mixture flowing through the passage 43, which contains evaporative fuel, and an HC concentration sensor 50 for detecting concentration of hydrocarbons (HC) contained in the mixture, are arranged in the purging passage 43. The purge control valve 48 and the sensors 49, 50 are connected to the ECU 5. The purge control valve 48 has its valve opening controlled by a control signal from the ECU 5, and a signal indicative of the flow rate of the mixture sensed by the flowrate sensor 49 and a signal indicative of the concentration of HC sensed by the HC concentration sensor 50 are supplied to the ECU 5.

The evaporative emission control system 40 operates in the following manner: When the pressure of evaporative fuel generated within the fuel tank 41 reaches a predetermined level, the positive pressure valve of the two-way valve 44 is caused to open, thereby allowing the evaporative fuel to flow into the canister 45 for the adsorbent contained therein to adsorb the evaporative fuel for temporary storage. The purge control valve 48 has its valve opening/closing operation controlled by a duty control signal from the ECU 5, and during a valve opening period, the evaporative fuel temporarily stored in the canister 45 is purged to be drawn into the chamber 9 together with a fresh air from the air inlet port 47 by negative pressure created in the chamber 9, via the purge control valve 48 through the purging passage 43, and supplied to each cylinder. When the negative pressure within the fuel tank 41 increases due to cooling by a cold ambient air, the negative pressure valve of the two-way valve 44 is opened to return the evaporative fuel temporarily stored in the canister 45 to the fuel tank 41. Thus, the evaporative emission control system 40 prevents emission of evaporative fuel generated from the fuel tank 41 into the air.

The engine 1 has a valve timing changeover mechanism 60 which changes valve timing (inclusive of the valve lift) of the intake valves and exhaust valves between a high-speed valve timing suitable for operation of the engine in a high rotational speed region and a low-speed valve timing suitable for operation of the engine in a low rotational speed region. Further, when the low-speed valve timing is selected, one of the two intake valves is rendered inoperative, whereby stable combustion of the engine is secured even when the air-fuel ratio is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are connected to the ECU 5. A signal indicative of the sensed hydraulic pressure is supplied to the ECU 5 which in turn controls the electromagnetic valve for changing the valve timing.

Further connected to the ECU 5 is an atmospheric pressure (PA) sensor 21 for detecting atmospheric pressure and supplying a signal indicative of the sensed value to the ECU 5.

The ECU 5 is comprised of an input circuit having the functions of shaping the waveforms of input signals from various sensors mentioned above, shifting the voltage levels of sensor output signals to a predetermined level, converting analog signals from 20 analog-output sensors to digital signals, and so forth, a central processing unit (hereinafter referred to as "the CPU"), memory means formed of a ROM storing various operational programs which are executed by the CPU, and a RAM for storing results of calculations therefrom, etc., and an output circuit which delivers driving signals to electromagnetic valves such as the fuel injection valves 12 and the EGR valve 32, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the 02 sensor 18, and air-fuel ratio open-loop control regions, and calculates, based upon the determined engine operating conditions, the fuel injection period TOUT over which the fuel injection valves 12 are to be opened, by the use of the following equation (1), to output driving signals for driving the fuel injection valves 12 and spark plugs, based on the results of the calculation:

$$TOUT=TIMF\times KTOTAL\times KCMDM\times KFB \quad (1)$$

Figure 3:
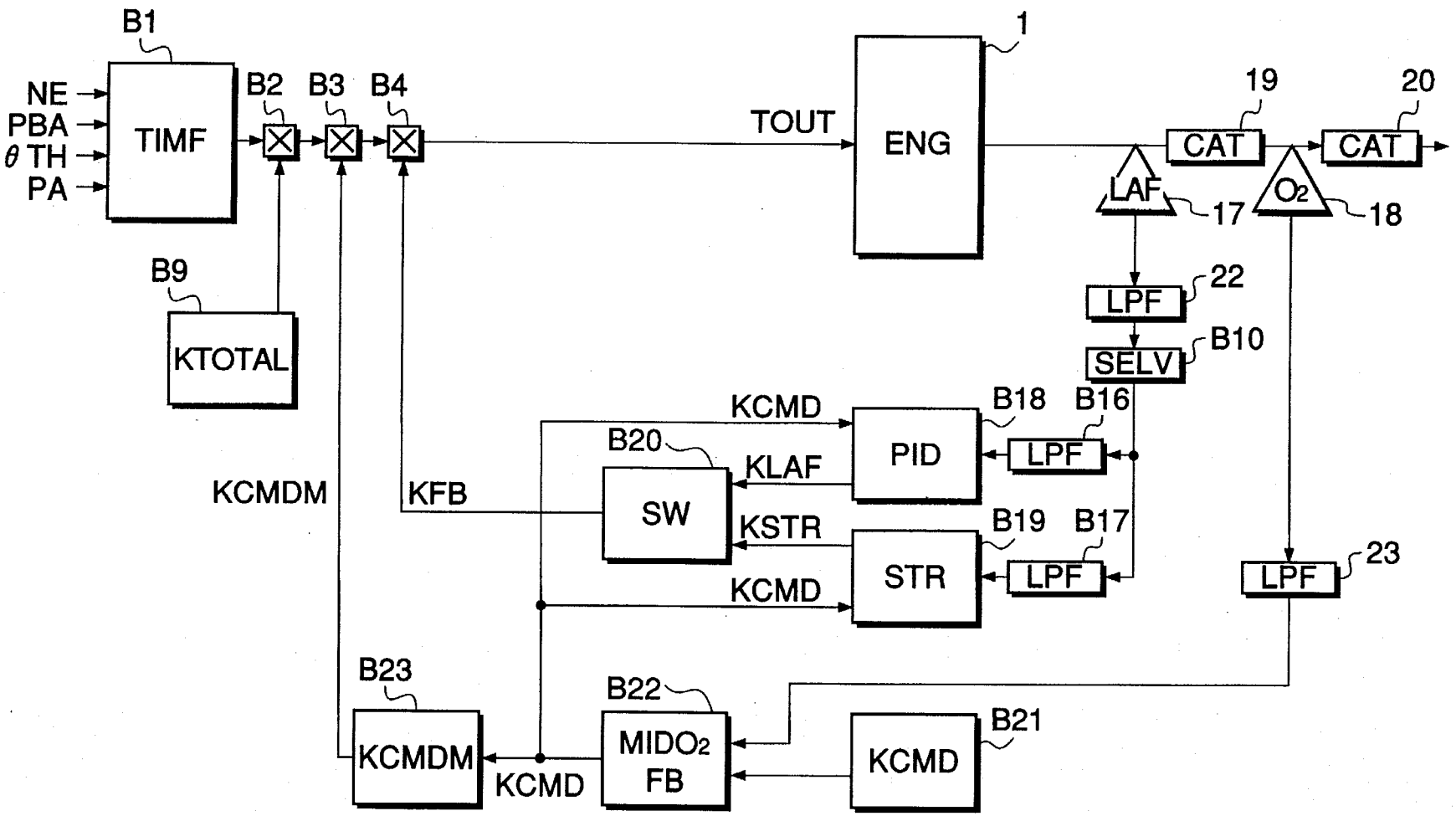
FIG. 3 is a block diagram useful in explaining functions of the air-fuel ratio control system and a manner of controlling the air-fuel ratio of a mixture supplied to the engine.

FIG. 3 shows an outline of the manner of calculating the fuel injection period TOUT according to the above equation (1), in which various blocks exhibit their functions. In the present embodiment, an amount of fuel supplied to the engine is calculated as the fuel injection period, which corresponds to an amount of fuel to be injected, and therefore the fuel supply amount TOUT will be also referred to as the fuel injection amount or the fuel amount hereinafter.

In the figure, a block B1 calculates a basic fuel amount TIMF based on the intake air amount. The basic fuel amount TIMF is basically set according to the engine rotational speed NE and the intake pipe absolute pressure PBA. Preferably, a model is prepared in advance, which represents a portion of the engine extending from the throttle valve 3 of the intake system to the combustion chamber, and a correction is made to the TIMF value in dependence on a delay of the flow of intake air obtained on the model. In this preferred method, the throttle valve opening θTH and the atmospheric pressure PA are also used as additional parameters indicative of operating conditions of the engine 1.

Reference numerals B2 to B4 designates multiplying blocks, which each multiply the basic fuel amount TIMF by parameter values input thereto, and deliver the product values. These blocks carry out the arithmetic operation of the equation (1), and an output from the multiplying block B4 provides fuel injection amounts TOUT for the respective cylinders.

A block B9 multiplies together all feedforward correction coefficients, such as an engine coolant temperature-dependent correction coefficient KTW set according to the engine coolant temperature TW and an EGR-dependent correction coefficient KEGR set according to the amount of recirculation of exhaust gases during execution of the exhaust gas recirculation, to obtain the correction coefficient KTOTAL, which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the 02 sensor 18 supplied via the low-pass filter 23, and delivers the corrected KCMD value to a block B18 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values into a ring buffer memory, not shown, and selects one of the stored values depending on operating conditions of the engine (LAF sensor output-selecting processing), which was sampled at the optimum timing for each cylinder, to supply the selected value to the block B18 and a block B19 via low-pass filter blocks B16 and B17. The LAF sensor output-selecting processing eliminates the inconvenience that the air-fuel ratio, which changes every moment, cannot be accurately detected depending on the timing of sampling of the output from the LAF sensor 17, there is a time lag before exhaust gases emitted from the combustion cheer reach the LAF sensor 17, and the response time of the LAF sensor per se changes depending on operating conditions of the engine.

The block B18 calculates a PID correction coefficient KLAF through PID control based on the difference between the actual air-fuel ratio and the desired air-fuel ratio and delivers the calculated KLAF value to the block B20. The block B19 calculates an adaptive control correction coefficient KSTR through adaptive control (Self-Tuning Regulation), based on the detected air-fuel ratio, and delivers the calculated KSTR value to the block B20. The reason for employing the adaptive control is as follows: If the basic fuel amount TIMF is merely multiplied by the desired air-fuel ratio coefficient KCMD (KCMDM), the resulting desired air-fuel ratio and hence the detected air-fuel ratio may become dull due to a response lag of the engine. The adaptive control is employed to dynamically compensate for the response lag of the engine to thereby improve the toughness of the air-fuel ratio control against external disturbances.

The block B20 selects either the PID correction coefficient KLAF or the adaptive control correction coefficient KSTR supplied thereto, depending upon operating conditions of the engine, and delivers the selected correction coefficient as a feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated by the ordinary PID control in response to the output from the LAF sensor 17, or the adaptive control correction coefficient KSTR calculated by the adaptive control is selectively applied as the correction coefficient KFB to the equation (1) to calculate the fuel injection amount TOUT. When the correction coefficient KSTR is applied, the responsiveness of the air-fuel ratio control exhibited when the desired air-fuel ratio is changed or the actual air-fuel ratio is changed and the toughness of the air-fuel ratio control against external disturbances can be improved, and hence the purification rate of the catalysts can be improved to ensure excellent exhaust emission characteristics of the engine in various operating conditions of the engine.

In the present embodiment, the functions of the various blocks in FIG. 3 are each performed by arithmetic operations by the CPU of the ECU 5, which will be described in detail with reference to flowcharts for carrying out the operations.

Figure 4:
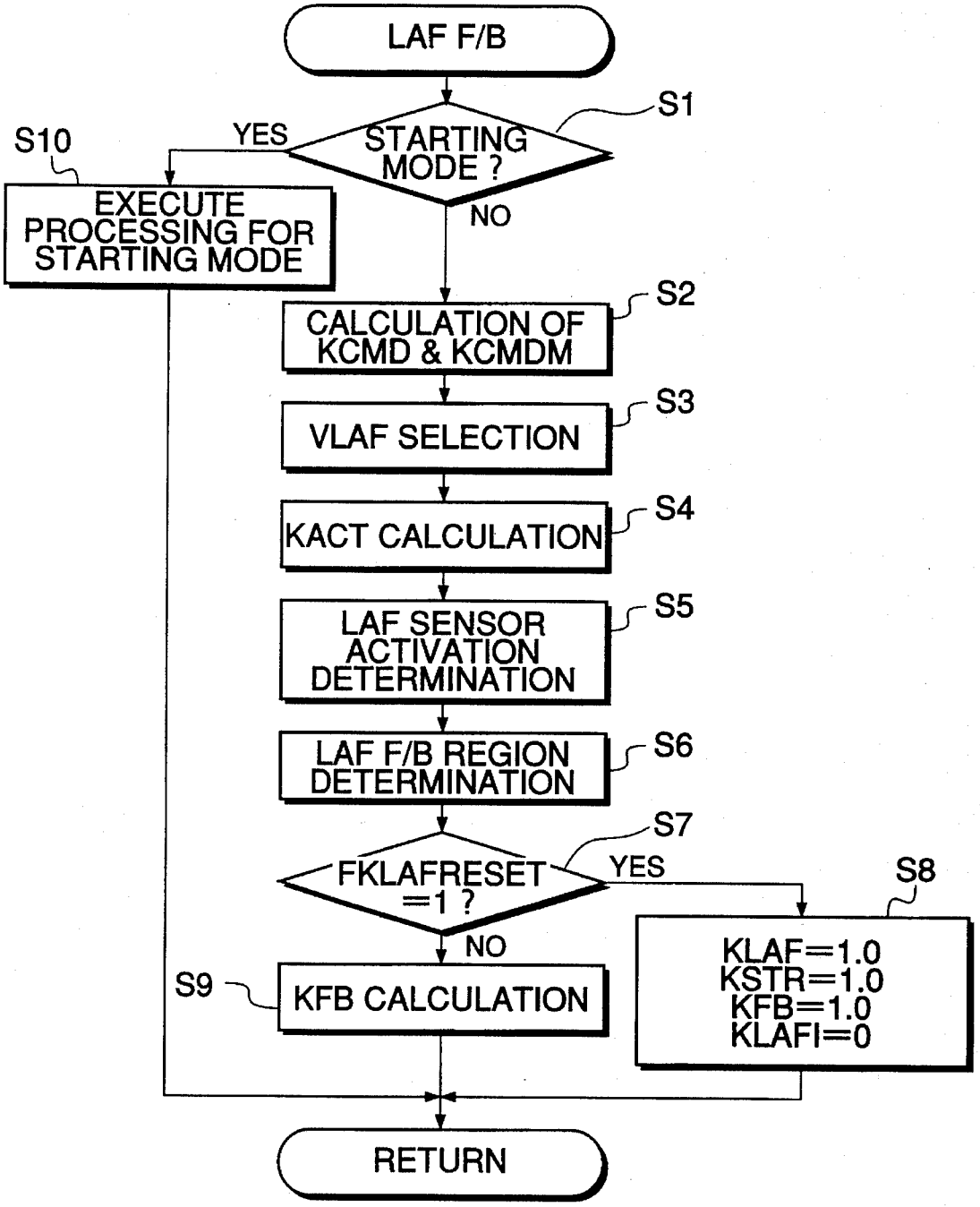
FIG. 4 is a flowchart showing a routine for calculating a feedback correction coefficient KFB, based on an output from a LAF sensor appearing in FIG. 1.

FIG. 4 shows a routine for calculating the PID correction coefficient KLAF and the adaptive control correction coefficient KSTR, according to the output from the LAF sensor 17. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S10 to execute a subroutine for the starting mode. If the engine is not in the starting mode, the desired air-fuel ratio coefficient (the desired equivalent ratio) KCMD and the final desired air-fuel ratio coefficient KCMDM are calculated at a step S2, and the LAF sensor output-selecting processing is executed at a step S3. Further, the actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region e.g. when the LAF sensor 17 has been activated but at the same time neither fuel cut nor wide open throttle operation is being carried out. If it is determined at this step that the engine is not in the LAF feedback control region, a reset flag FKLAFRESET is set to "1", whereas if it is determined the engine is in the LAF feedback control region, the reset flag FKLAFRESET is set to "0".

At the following step 7, it is determined whether or not the reset flag FKLAFRESET assumes "1". If FKLAFRESET=1, the program proceeds to a step S8, wherein the PID correction coefficient KLAF, the adaptive control correction coefficient KSTR, and the feedback correction coefficient KFB are all set to "1.0", and an integral term KLAFI of the PID control is set to "0", followed by terminating the present program. On the other hand, if FKLAFRESET=0 holds, the feedback correction coefficient KFB is calculated at a step S9, followed by terminating the present program.

Details of operations executed at the steps S2 to S4, S6, and S9 will be described hereinbelow.

Figure 5:
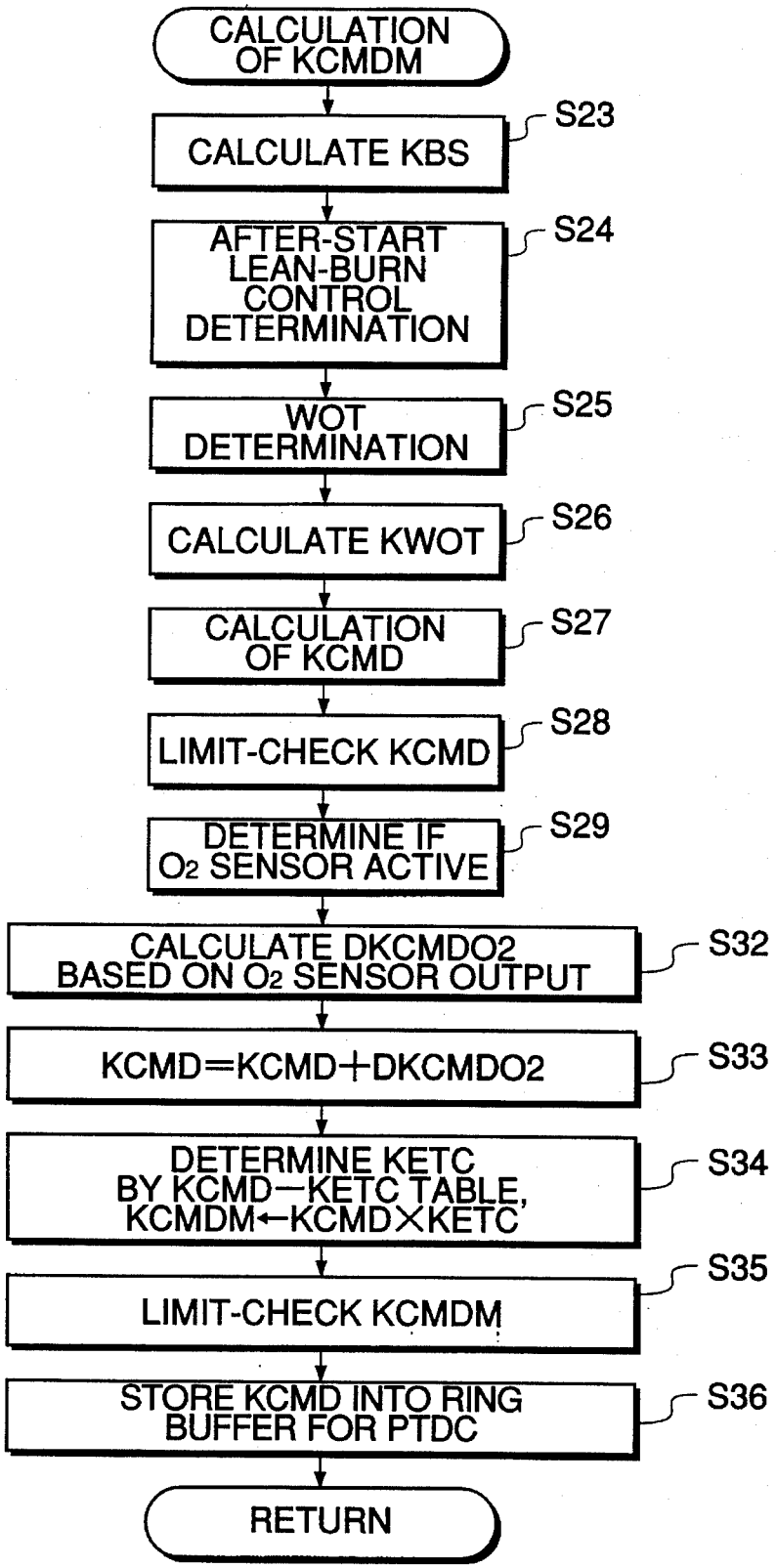
FIG. 5 is a flowchart showing a subroutine for calculating a final desired air-fuel ratio coefficient KCMDM, which is executed at a step S2 in FIG. 4.

FIG. 5 shows a subroutine for executing the step S2 of the FIG. 4 routine to calculate the final desired air-fuel ratio correction coefficient KCMDM.

At a step S23, a basic value KBS is determined by retrieving a map according to the engine rotational speed NE and the intake pipe absolute pressure PBA. The map also contains values of the basic value KBS to be applied during idling of the engine.

At the following step S24, it is determined whether or not conditions for carrying out so-called after-start lean-burn control are fulfilled (after-start leaning determination). If the conditions are fulfilled, an after-start leaning flag FASTLEAN is set to "1", whereas if they are not fulfilled, the flag FASTLEAN is set to "0". The conditions for the after-start lean-burn control are determined to be fulfilled when a predetermined time period has not elapsed after the start of the engine and at the same time the engine coolant temperature TW, the engine rotational speed NE and the intake pipe absolute pressure PBA are within respective predetermined ranges. The after-start lean-burn control is carried out for the purpose of preventing an increase in emission of HC occurring when the catalysts are inactive immediately after the start of the engine, as well as reducing the fuel consumption.

Then, at a step S25, it is determined whether or not the throttle valve is fully open (i.e. the engine is in a WOT condition). If the throttle valve is fully open, a WOT flag FWOT is set to "1", whereas if the 15 throttle valve is not fully open, the same flag is set to "0". Then, an enriching correction coefficient KWOT is calculated according to the engine coolant temperature TW at a step S26. At the same time, a correction coefficient KXWOT to be applied in a high coolant temperature condition is also calculated.

At the following step S27, the desired air-fuel ratio coefficient KCMD is calculated, and then limit-checking of the calculated KCMD value is carried out to limit the KCMD value within a range defined by predetermined upper and lower limit values at a step S28. A subroutine for executing the step S27 will be described in detail hereinafter with reference to FIG. 6.

At the following step S29, it is determined whether or not the 02 sensor 18 has been activated. If the 02 sensor 18 has been activated, an activation flag FMO2 is set to "1", whereas if the 02 sensor has not been activated, the same flag is set to "0". The 02 sensor 18 is determined to have been activated e.g. when a predetermined time period has elapsed after the start of the engine. At the following step S32, a correction term DKCMDO2 for correcting the desired air-fuel ratio coefficient KCMD is calculated according to the output VMO2 from the 02 sensor 18. More specifically, the correction term DKCMDO2 is calculated by the PID control according to a difference between the 02 sensor output VMO2 and a reference value VREFM.

Then, at a step S33, the desired air-fuel ratio coefficient KCMD is corrected by the use of the following equation (2):

$$KCMD=KCMD+DKCMD02 \quad (2)$$

This correction makes it possible to set the desired air-fuel ratio coefficient KCMD such that a deviation of the LAF sensor output from a proper value is corrected.

At the following step S34, a KCMD-KETC table is retrieved according to the calculated KCMD value to determine a correction coefficient KETC, and the final desired air-fuel ratio coefficient KCMDM is calculated by the use of the following equation (3):

$$KCMDM=KCMD\times KETC \quad (3)$$

The correction coefficient KETC compensates for the influence of fuel cooling effects caused by fuel injection, the degree of which increases as the KCMD value increases to increase the fuel injection amount. The correction coefficient KETC is set to a larger value as the KCMD value is larger.

Then, limit-checking of the calculated KCMDM value is carried out at a step S35, and the KCMD value obtained at the step S33 is stored in a ring buffer memory at a step S36, followed by terminating the subroutine.

Figure 6:
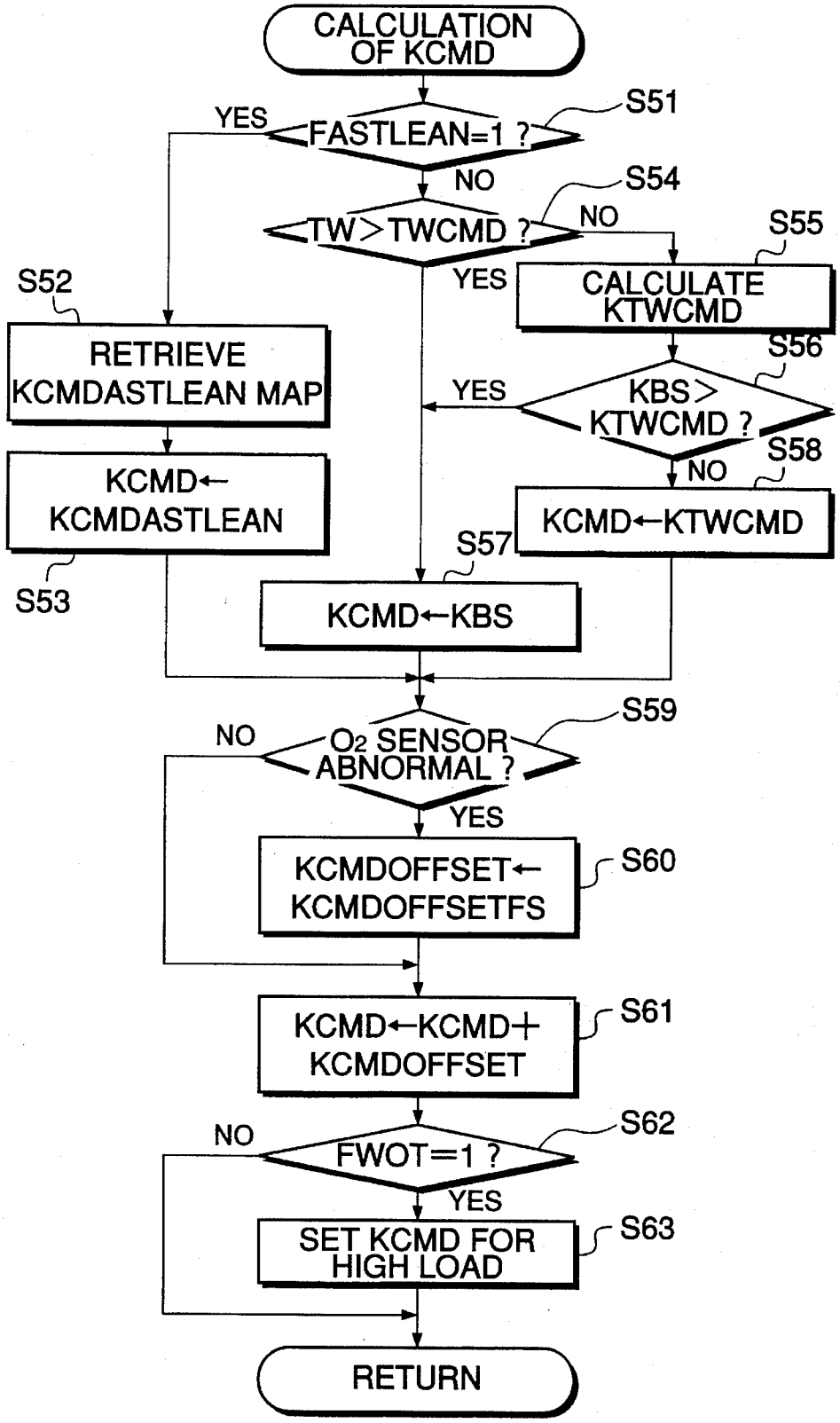
FIG. 6 is a flowchart showing a subroutine for calculating a desired air-fuel ratio coefficient KCMD, which is executed at a step S27 in FIG. 5.

FIG. 6 shows a subroutine for calculating the KCMD value, which is executed at the step S27 in FIG. 5.

First, at a step S51, it is determined whether or not the after-start leaning flag FASTLEAN which has been set at the step S24 in FIG. 5 is equal to "1", and if FASTLEAN=1 holds, a KCMDASTLEAN map is retrieved to determine a leaning desired value KCMDASTLEAN which corresponds to a central air-fuel ratio suitable for the after-start lean-burn control, at a step S52. The KCMDASTLEAN map is set such that map values of the leaning desired value KCMDASTLEAN are set according to the engine coolant temperature TW and the intake pipe absolute pressure PBA. Then, at a step S53 the desired air-fuel ratio coefficient KCMD is set to the thus determined KCMDASTLEAN value, followed by the program proceeding to a step S59.

On the other hand, if FASTLEAN=0 holds at the step S51, which means that the conditions for executing the after-start lean-burn control are not satisfied, it is determined whether or not the engine coolant temperature TW is higher than a predetermined value TWCMD (e.g. 80° C.). If TW>TWCMD holds, the KCMD value is set to the basic value KBS calculated at the step S23 in FIG. 5, at a step S57, followed by the program proceeding to the step S59. If TW≦TWCMD holds, a map which is set according to the engine coolant temperature TW and the intake pipe absolute pressure PBA is retrieved to determine a desired value KTWCMD suitable for low coolant temperature at a step S55, and then it is determined at a step S56 whether or not the basic value KBS is larger than the determined KTWCMD value. If KBS>KTWCMD holds, the program proceeds to the step S57, whereas if KBS≦KTWCMD holds, the KCMD value is replaced by the determined desired value KTWCMD suitable for low coolant temperature at a step S58, followed by the program proceeding to the step S59.

At the step S59, it is determined whether or not abnormality of the 02 sensor 18 has been detected. If no abnormality of the 02 sensor 18 has been detected, the program jumps to the step S61, whereas if abnormality of the 02 sensor 18 has been detected, an addend correction term KCMDOFFSET is set to an addend correction term KCMDOFFSETFS for fail-safe action at a step S60, followed by the program proceeding to the step S61.

The addend correction term KCMDOFFSETFS for fail-safe action is set to such a value as will cause slight shifting of the air-fuel ratio of the mixture supplied to the engine in an enriching direction. This makes it possible to prevent a variation in torque from the engine or knocking of the engine due to supply of a lean air-fuel ratio mixture to the engine when the 02 sensor is abnormal.

At the step S61, the KCMD value is corrected by the use of the following equation (4), followed by the program proceeding to a step S62:

$$KCMD=KCMD+KCMDOFFSET \quad (4)$$

where KCMDOFFSET represents an addend correction term for finely adjusting the desired air-fuel ratio coefficient KCMD so as to compensate for variations in characteristics of the exhaust system and the LAF sensor of the engine, as well as changes in the exhaust system and the LAF sensor due to aging such that the actual air-fuel ratio falls within an optimum value for window zones of the three-way catalysts. The addend correction term KCMDOFFSET is set based on the characteristics of the LAF sensor 17, etc.

At a step S62, it is determined whether or not the WOT flag FWOT which has been set at the step S25 in FIG. 5 is equal to "1". If FWOT=0 holds, the program is immediately terminated, whereas if FWOT=1 holds, the desired air-fuel ratio correction coefficient KCMD is set to a value suitable for a high-load condition of the engine at a step S63, followed by terminating the present program. The step S63 is executed more specifically by comparing the KCMD value with the enriching correction coefficients KWOT and KXWOT for the high-load condition of the engine calculated at the step S26 of the FIG. 5 routine, and if the KCMD value is smaller than these values, the KCMD value is multiplied by the correction coefficient KWOT or KXWOT for correction of the same.

Next, the LAF sensor output-selecting processing at the step S3 of the FIG. 4 routine will be described.

Exhaust gases are emitted from the engine in the exhaust stroke, and accordingly clearly the behavior of the air-fuel ratio detected at the confluent portion of the exhaust system of the multi-cylinder engine is synchronous with generation of each TDC signal pulse. Therefore, detection of the air-fuel ratio by the LAF sensor 17 is also required to be carried out in synchronism with generation of each TDC signal pulse. However, depending on the timing of sampling the output from the LAF sensor 17, there are cases where the behavior of the air-fuel ratio cannot be accurately grasped.

For example, if the air-fuel ratio detected at the confluent portion of the exhaust system varies as shown in FIG. 7B in comparison with timing of generation of each TDC signal pulse shown in FIG. 7A, the air-fuel ratio recognized by the ECU 5 can have quite different values depending on the timing of sampling, as shown in FIG. 8B. Therefore, it is desirable that the sampling of the output from the LAF sensor 17 should be carried out at such timing as enables the ECU 5 to recognize actual variation of the sensor output as accurately as possible.

Further, the variation of the air-fuel ratio also depends upon a time period required to elapse before exhaust gases emitted from the cylinder reach the LAF sensor 17 as well as upon the response time of the LAF sensor 17. The required time period depends on the pressure and volume of exhaust gases, etc. Further, sampling of the sensor output in synchronism with generation of each TDC signal pulse is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 9:
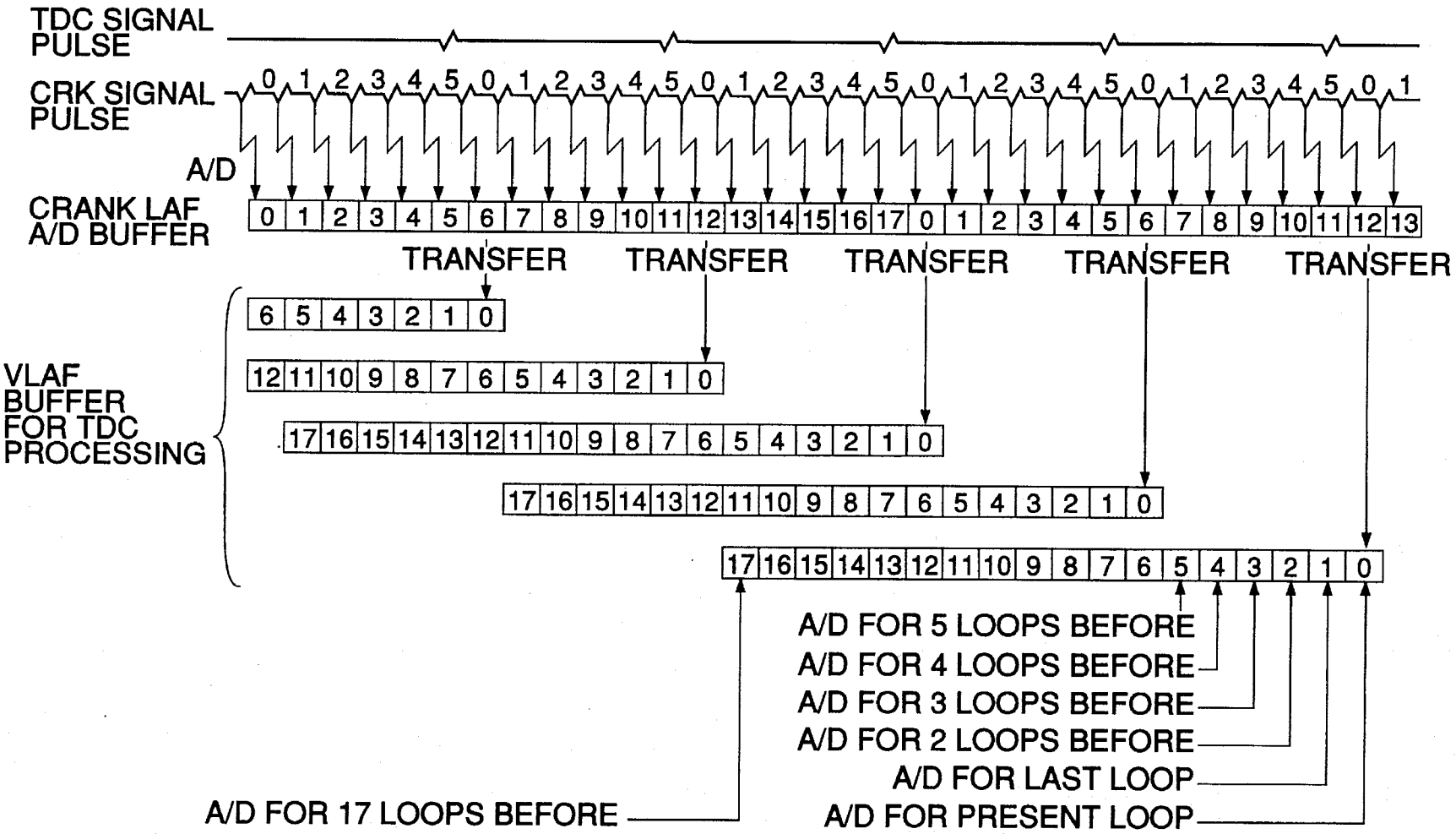
FIG. 9 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 9, values of the output from the LAF sensor 17 sampled in synchronism generation of each CRK signal pulse (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 10:
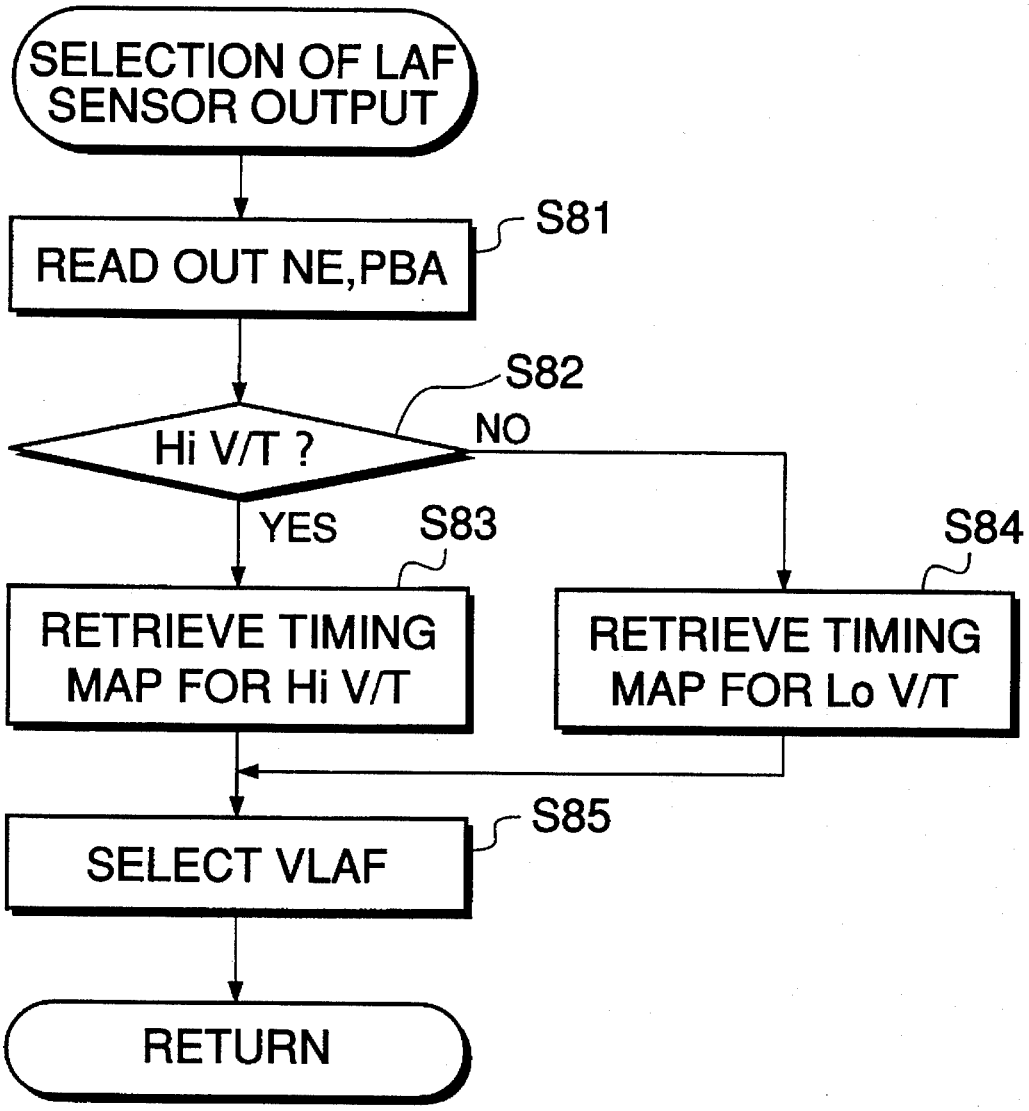
FIG. 10 is a flowchart showing a subroutine for executing a LAF sensor output selection, which is executed at a step S3 in FIG. 4.

FIG. 10 shows a subroutine for carrying out the LAF sensor output selection executed at the step S3 in FIG. 4.

First, at a step S81, the engine rotational speed NE and the intake pipe absolute pressure PBA are read from the respective sensor outputs, and then it is determined at a step S82 whether or not the present valve timing is set to the high-speed valve timing. If the present valve timing is set to the high-speed valve timing, a timing map suitable for the high-speed valve timing is retrieved at a step S83, whereas if the same is set to the low-speed valve timing, a timing map suitable for the low-speed valve timing is retrieved at a step S84. Then, one of the LAF sensor output values VLAF stored in the ring buffer is selected as a selected value VLAFSEL according to the result of the retrieval at a step S85, followed by terminating the program.

Figure 11:
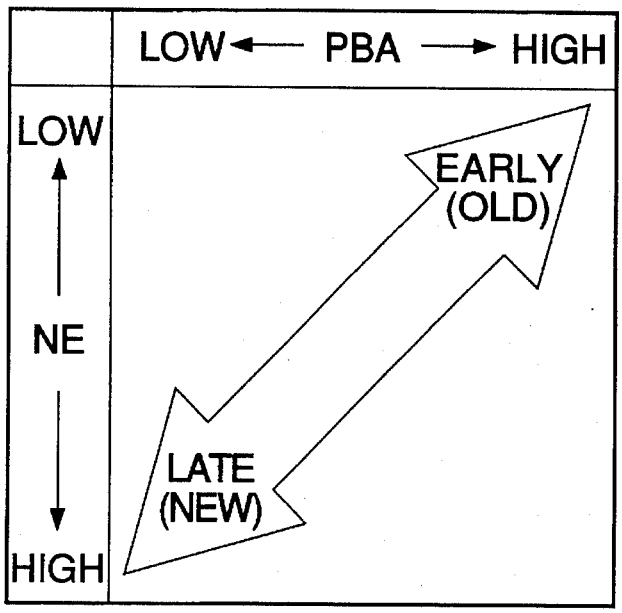
FIG. 11 is a diagram showing characteristics of timing maps used in the FIG. 10 subroutine.
Figure 12A:
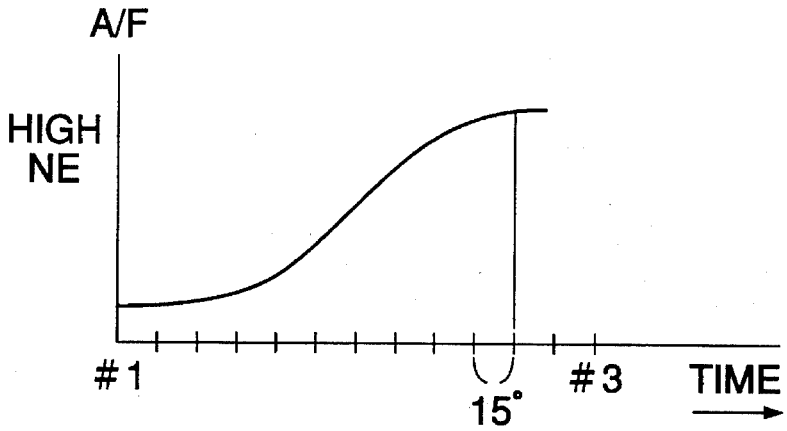
FIG. 12A is a diagram showing characteristics of the output from the LAF sensor assumed at a high engine rotational speed, which is useful in explaining the characteristics of the timing maps shown in FIG. 11.
Figure 12B:
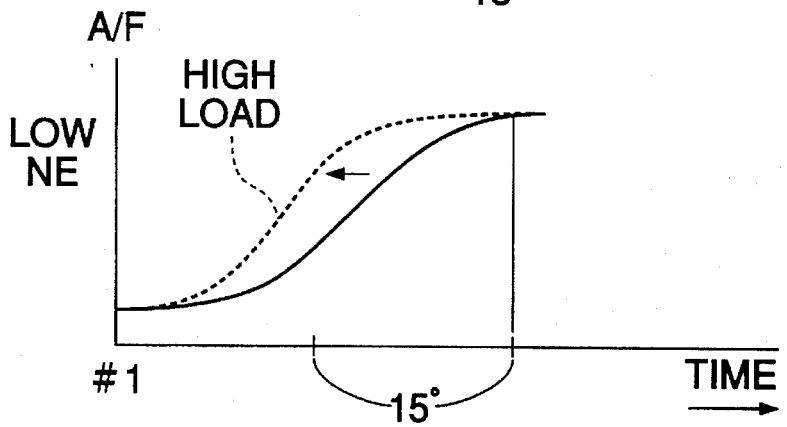
FIG. 12B is a diagram showing characteristics of the output from the LAF sensor assumed at a low engine rotational speed with a shift to be effected when a change in load on the engine occurs, which is useful in explaining the characteristics of the timing maps shown in FIG. 11.

The timing maps are set e.g. as shown in FIG. 11 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that as shown in FIGS. 8A and 8B referred to before, the air-fuel ratio is best sampled at timing closest to time points corresponding to maximal and minimal values (hereinafter both referred to as "extreme values" of the actual air-fuel ratio), and assuming that the response time of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIG. 12A and 12B.

Further, the timing map for the high-speed valve timing is set such that for the same value of the engine rotational speed NE and the same value of intake pipe absolute pressure PBA, a VLAF value is selected which is sampled at earlier timing than one set in the timing map for the low-speed valve timing. This is because the high-speed valve timing sets the starting of opening of the exhaust valves earlier than the low-speed valve timing.

As described above, according to the FIG. 10 subroutine, the sensor output VLAF value sampled at the optimum timing is selected depending on operating conditions of the engine which improves the accuracy of detection of the air-fuel ratio.

Figure 13:
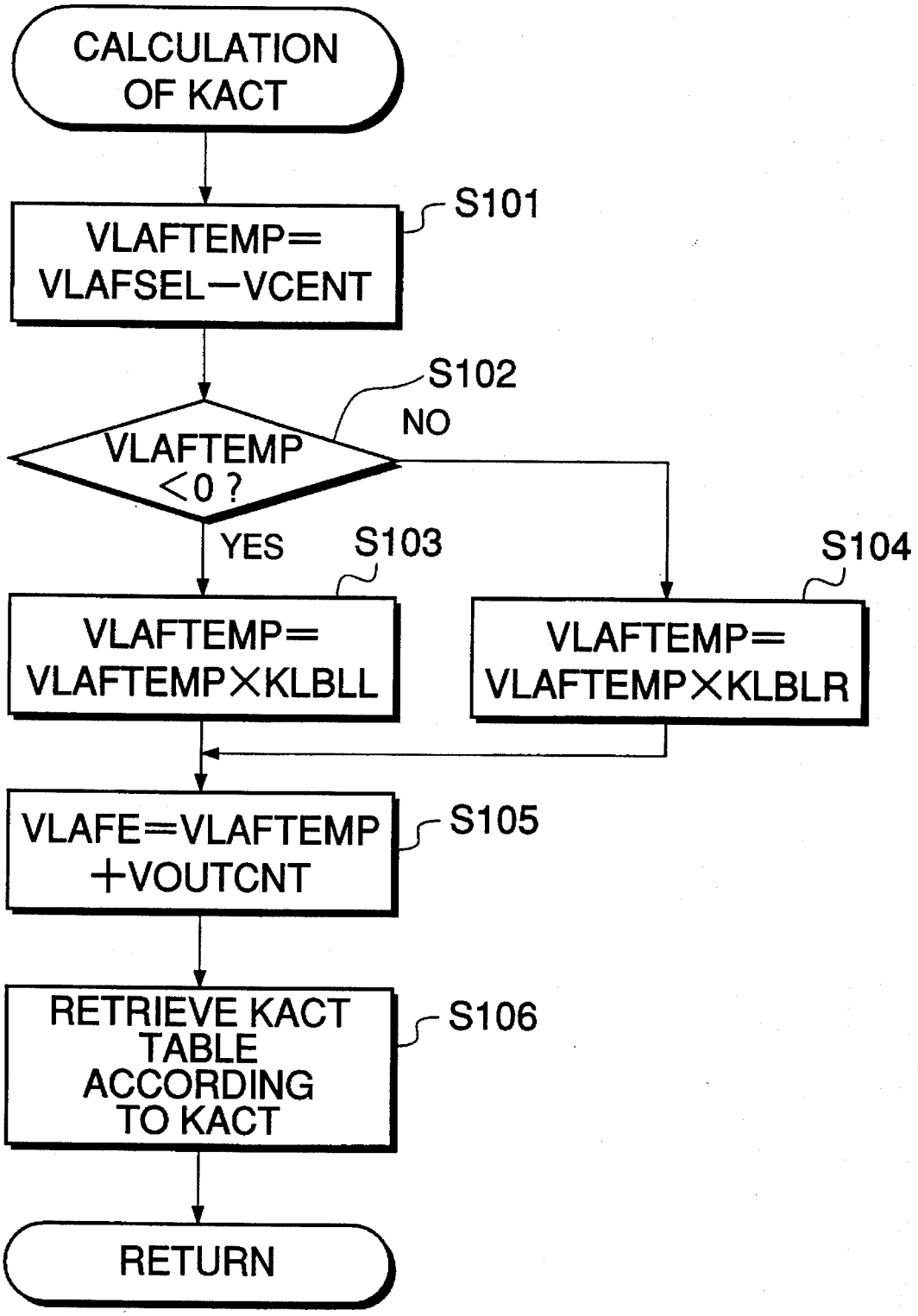
FIG. 13 is a flowchart showing a subroutine for calculating an actual equivalent ratio KACT, which is executed at a step S4 in FIG. 4.

Then, the calculation of the actual equivalent ratio KACT executed at the step S4 of the FIG. 4 routine will be described with reference to FIG. 13.

First, at a step S101, a central value VCENT of the sensor output is subtracted from the selected sensor output value VLAFSEL determined by the FIG. 10 subroutine to obtain a temporary value VLAFTEMP. The central value VCENT is a value of the output from the LAF sensor 17 detected when the air-fuel ratio of the mixture is equal to the stoichiometric air-fuel ratio.

Next, it is determined at a step S102 whether or not the temporary value VLAFTEMP is negative. If VLAFTEMP<0 holds, which means that the actual air-fuel ratio is leaner than the stoichiometric air-fuel ratio, the VLAFTEMP value is multiplied by a lean value correction coefficient KLBLL for correction of the same at a step S103. On the other hand, if VLAFTEMP≧0 holds, which means that the air-fuel ratio is richer than the stoichiometric air-fuel ratio, the VLAFTEMP value is multiplied by a rich value correction coefficient KLBLR for correction of the same at a step S104. The lean value correction coefficient KLBLL and the rich value correction coefficient KLBLR are calculated according to a label resistance value indicated on the LAF sensor 17 for correcting variations in sensor output value between LAF sensors to be employed. The label resistance value is set according to output characteristics of the LAF sensor measured in advance, and the ECU 5 reads the label resistance value to determine the correction coefficients KLBLL, KLBLR.

At the following step S105, a table central value VOUTCNT is added to the temporary value VLAFTEMP to calculate a corrected output value VLAFE, and a KACT table is retrieved according to the corrected output value VLAFE to determine the actual equivalent ratio KACT at a step S106. In the KACT table, the table central value VOUTCNT corresponds to lattice point data corresponding to the stoichiometric air-fuel ratio (KACT=1.0).

By the above processing, the actual equivalent ratio KACT can be obtained which is free of the influence of undesired variations in output characteristics between individual LAF sensors employed.

Figure 14:
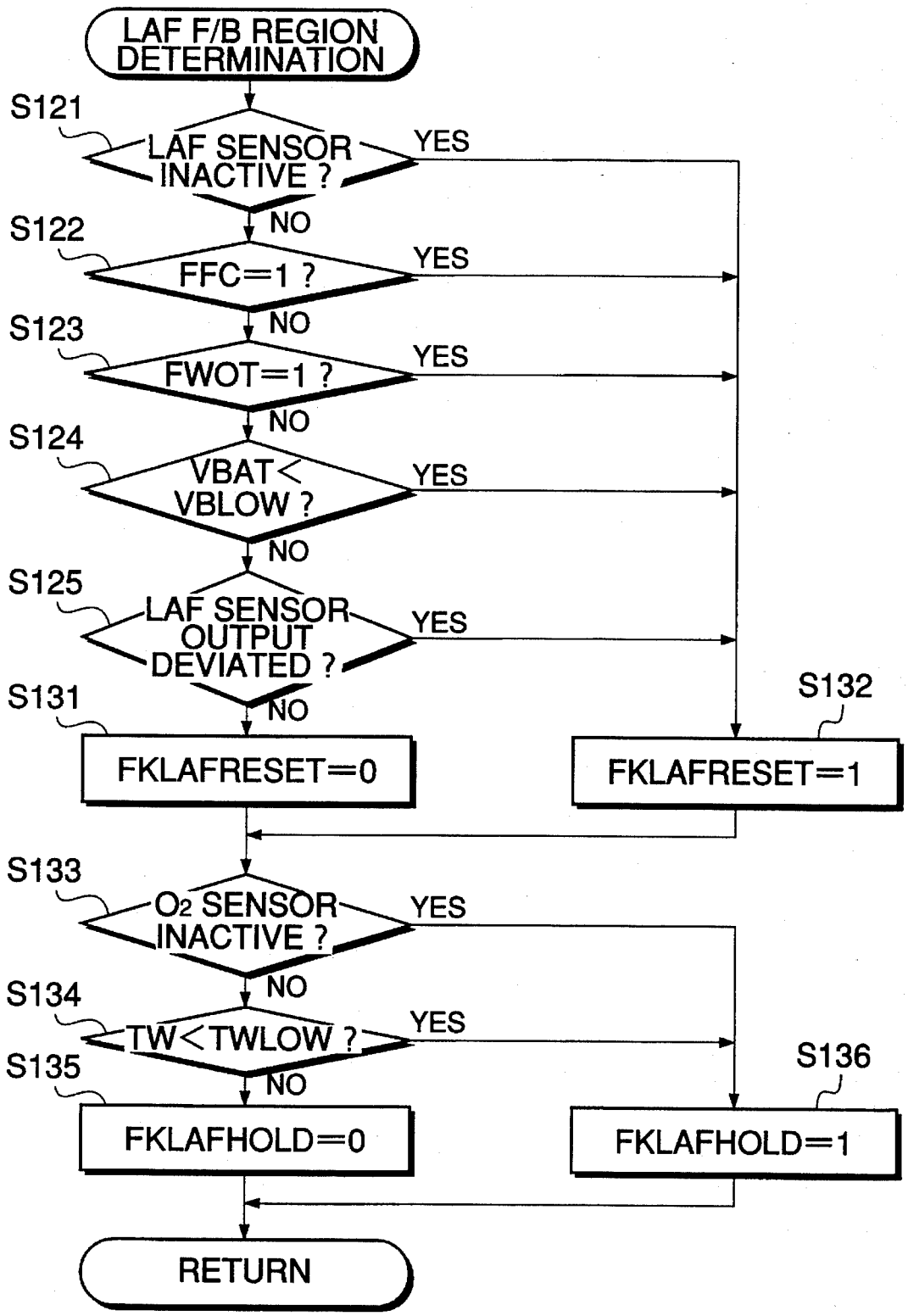
FIG. 14 is a flowchart showing a subroutine for determining whether the engine is operating in an LAF feedback control region, which is executed at a step S6 in FIG. 4.

FIG. 14 shows a LAF feedback control region determining routine executed at the step S6 in the FIG. 4 routine.

First, at a step S121, it is determined whether or not the LAF sensor 17 is inactive. If the LAF sensor 17 is inactive, it is determined at a step S122 whether or not a flag FFC, which, when set to "1", indicates that fuel cut is being carried out, assumes "1". If FFC=0 holds, it is determined at a step S123 whether or not the WOT flag FWOT, which, when set to "1", indicates that the engine is operating in the wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the KLAF reset flag FKLAFRESET, which, when set to "1", indicates that the feedback control based on the LAF sensor should be inhibited, is set to "1" at a step S132.

On the other hand, if all the answers to the questions of the steps S121 to S125 are negative (NO), the KLAF reset flag FKLAFRESET is set to "0" at a step S131.

At the following step S133, it is determined whether or not the 02 sensor 18 is inactive. If the 02 sensor 18 is active, it is determined at a step S134 whether or not the engine coolant temperature TW is lower than a predetermined lower limit value TWLOW (e.g. 0° C.). If the 02 sensor 18 is inactive or if TW<TWLOW holds, a hold flag FKLAFHOLD, which, when set to "1", indicates that the PID correction coefficient KLAF should be held at the present value, is set to "1" at a step S136, followed by terminating the program. If the 02 sensor 18 is active and at the same time TW≧TWLOW holds, the hold flag FKLAFHOLD is set to "0" at a step S135, followed by terminating the program.

Next, a subroutine for executing the step S9 in the FIG. 4 routine to calculate the feedback correction coefficient KFB will be described.

Figure 15:
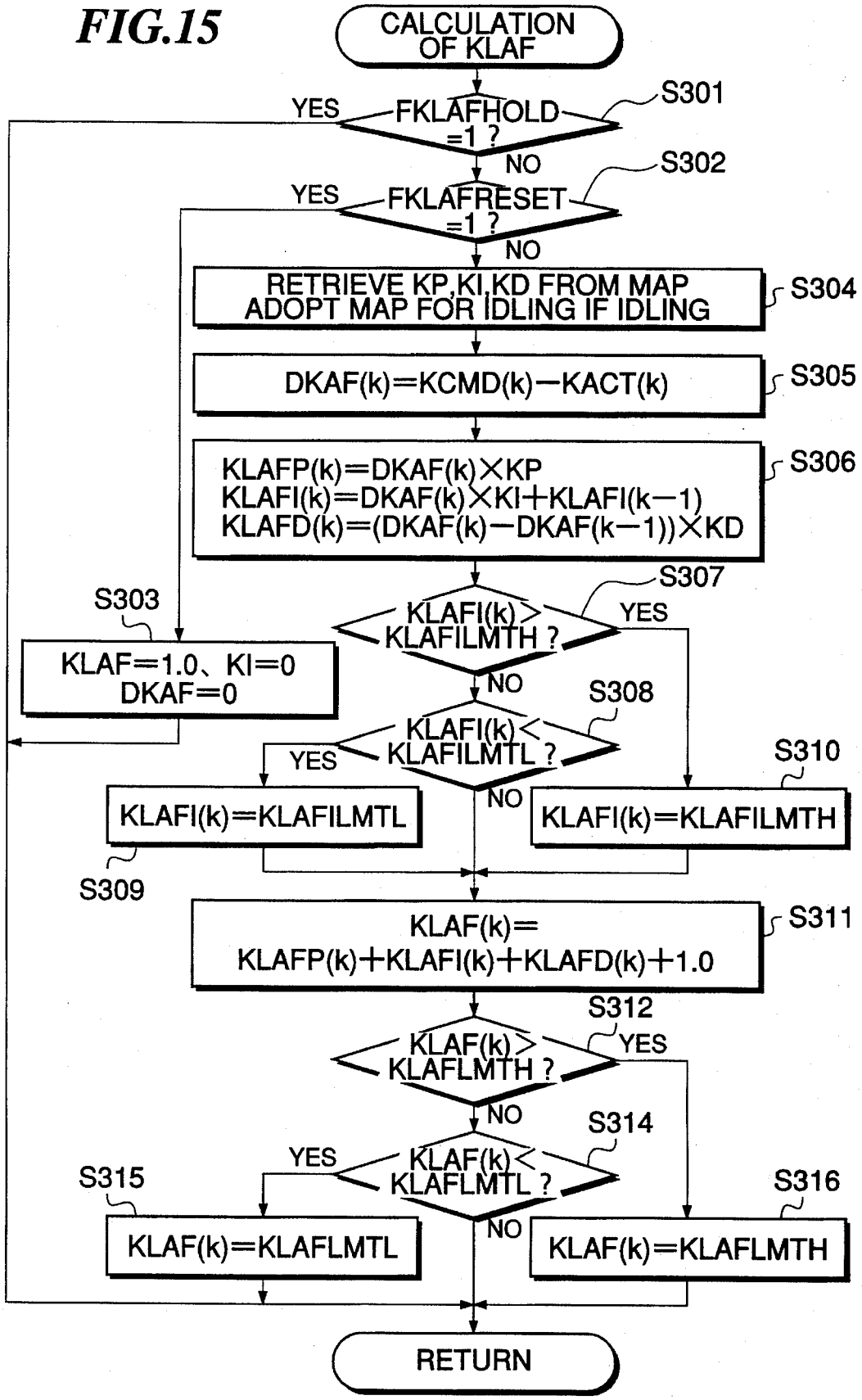
FIG. 15 is a flowchart showing a subroutine for calculating a PID correction coefficient KLAF.

The feedback correction coefficient KFB is set to the PID correction coefficient KLAF or to the adaptive control correction coefficient KSTR according to operating conditions of the engine. First, manners of calculating these correction coefficients will be described with reference to FIGS. 15 and 16.

First, at a step S301, it is determined whether or not the hold flag FKLAFHOLD assumes "1". If FKLAFHOLD=1 holds, the present processing is immediately terminated, whereas if FKLAFHOLD=0 holds, it is determined at a step S142 whether or not the KLAF reset flag FKLAFRESET assumes "1". If FKLAFRESET=1 holds, the program proceeds to a step S303, wherein the PID correction coefficient KLAF is set to "1.0" and at the same time an integral term control gain KI and a difference DKAF between the desired equivalent ratio KCMD and the actual equivalent ratio KACT are set to "0", followed by terminating the program.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, the difference DKAF(k) (=KCMD(k)−KACT(k)) between the desired equivalent ratio KCMD and the actual equivalent ratio KACT is calculated at a step S305, and the difference DKAF(k) and the gains KP, KI, and KD are applied to the following equations (5) to (7) to calculate a proportional term KLAFP(k), an integral term KLAFI(k), and a differential term KLAFD(k) at a step S306:

$$KLAFP(k)=DKAF(k)\times KP \quad (5)$$

$$KLAFI(k)=DKAF(k)\times KI+KLAFI(k-1) \quad (6)$$

$$KLAFD(k)=(DKAF(k)-DKAF(k-1))\times KD \quad (7)$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at steps S307 and S308, respectively. If KLAFI(k)>KLAFILMTH holds, the integral term KLAFI(k) is set to the predetermined upper limit value KLAFILMTH at a step S310, whereas if FLAFI(k)<KLAFILMTL holds, the same is set to the predetermined lower limit value KLAFILMTL at a step S309.

At the following step S311, the PID correction coefficient KLAF(k) is calculated by the use of the following equation (8):

$$KLAF(k)=KLAFP(k)+KLAFI(k)+KLAFD(k)+1.0 \quad (8)$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k)≦KLAFLMTH holds at the step S312, it is determined at a step S314 whether or not the KLAF(k) value is smaller than a predetermined lower limit value KLAFLMTL. If KLAF(k)≧KLAFLMTL holds, the present program is immediately terminated, whereas if KLAF(k)<KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Next, description will be made of calculation of the adaptive control correction coefficient KSTR with reference to FIG. 16.

Figure 16:
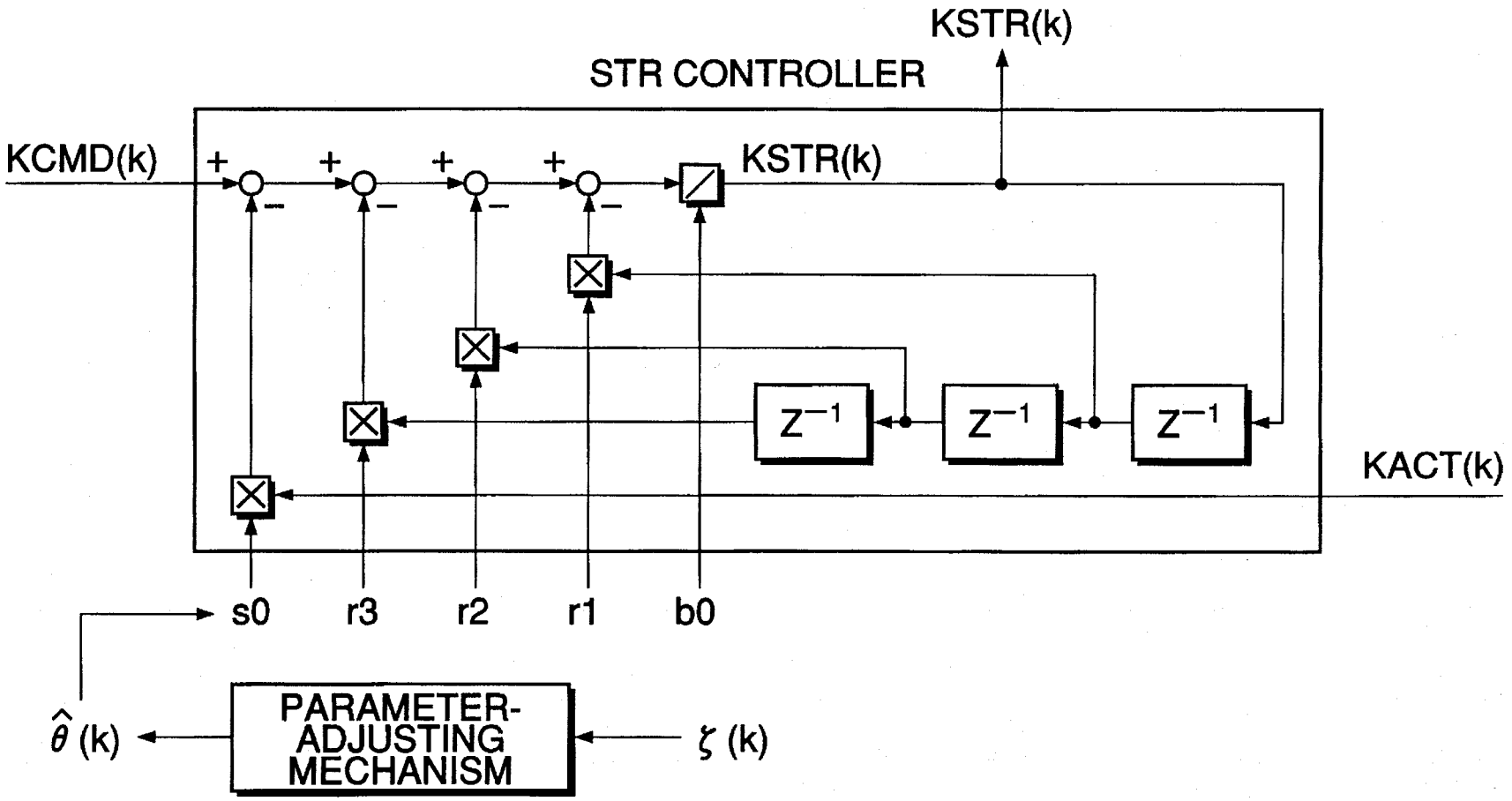
FIG. 16 is a block diagram useful in explaining a manner of calculating an adaptive control correction coefficient KSTR.

FIG. 16 shows the construction of the block B19 in FIG. 3, i.e. the self-tuning regulator (hereinafter referred to as "the STR") block. The STR block is comprised of a STR controller for setting the adaptive control correction coefficient KSTR such that the detected equivalent ratio KACT(k) becomes equal to the desired air-fuel ratio coefficient (desired equivalent ratio) KCMD(k), and a parameter adjusting mechanism for setting parameters to be used by the STR controller.

Adjustment laws (mechanisms) for adaptive control employed in the present embodiment include a parameter adjustment law proposed by Landau et al. According to this parameter adjustment law, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real. This law is known and described e.g. in "Computrole" No. 27, CORONA PUBLISHING CO., LTD., Japan, pp. 28–41, "Automatic control handbook" OHM, LTD., Japan, pp. 703–707, "A Survey of Model Reference Adaptive Techniques—Theory and Application", I.D. LANDAU "Automatica" Vol. 10, pp. 353–379, 1974, "Unification of Discrete Time Explicit Model Reference Adaptive Control Designs", I.D. LANDAU et al. "Automatica" Vol. 17, No. 4, pp. 593–611, 1981, and "Combining Model Reference Adaptive Controllers and Stochastic Self-tuning Regulators", I.D. LANDAU "Automatica" Vol. 18, No. 1., pp. 77–84, 1992.

In the present embodiment, the above parameter adjustment law proposed by Landau et al. is employed. This parameter adjustment law will be described in detail hereinbelow: According to this adjustment law, if polynomials of the denominator and numerator of the transfer function $A(Z^{-1})/B(Z^{-1})$ of the object of control by a discrete system are expressed by the following equations (9) and (10), the adaptive parameter $\hat{\theta}^T(k)$ and the input $\zeta^T(k)$ to the adaptive parameter adjusting mechanism are defined by the following equations (11) and (12). The equations (9) to (12) define an example of a plant in which m=1, n=1 and d=2 hold, i.e. a system of the first order thereof has an ineffective time as long as two control cycles. The symbol k used herein indicates that the parameter with (k) has the present value, one with (k−1) the immediately preceding value, and so forth. u(k) and y(k) correspond to the KSTR(k) and KACT(k) values, respectively, in the present embodiment.

$$A(z^{-1}) = 1 + a1z^{-1} + \ldots + anz^{-n} \tag{9}$$

$$B(z^{-1}) = b0 + b1z^{-1} + \ldots + bmz^{-m} \tag{10}$$

$$\begin{aligned}\hat{\theta}^T(k) &= [b_0(k), r_1(k), \ldots r_{m+d-1}(k), S_0(k), \ldots, S_{n-1}(k)] \\ &= [b_0(k), r_1(k), r_2(k), r_3(k), s_0(k)]\end{aligned} \tag{11}$$

$$\begin{aligned}\zeta^T(k) &= [u(k), \ldots, u(k-m-d+1), y(k), \ldots, y(k-n+1)] \\ &= [u(k), u(k-1), u(k-2), u(k-3), y(k)]\end{aligned} \tag{12}$$

The adaptive parameter $\hat{\theta}(k)$ is expressed by the following equation (13):

$$\hat{\theta}(k)=\hat{\theta}(k-1)+\Gamma(k-1)\zeta(k-d)e^*(k) \tag{13}$$

where the symbols $\Gamma(k)$ and $e^*(k)$ represent a gain matrix and an identification error signal, respectively, and can be expressed by the following recurrence formulas (14) and (15):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \tag{14}$$

$$e^*(k) = \frac{D(z^{-1})y(k) - \hat{\theta}^T(k-1)\zeta(k-d)}{1+\zeta^T(k-d)\Gamma(k-1)\zeta(k-d)} \tag{15}$$

Further, it is possible to provide various specific algorithms depending upon set values of λ1(k) and λ2(k). For example, if λ1(k)=1 and λ2(k)=λ (0<λ1<2), a progressively decreasing gain algorithm is provided (if λ=1, the least square method), if λ 1(k)=λ1 (0<λ1<1) and λ2(k)=λ2 (0<λ2<2), a variable gain algorithm (if λ2=1, the method of weighted least squares), and if λ1(k)/λ2(k)=λ and if λ3 is expressed by the following equation (16), λ1(k)=λ3 provides a fixed trace algorithm. Further, if λ1(k)=1 and λ2(k)=0, a fixed gain algorithm is obtained. In this case, as is clear from the equation (14), Γ(k)=Γ(k−1), and hence Γ(k)=Γ(fixed value) is obtained.

$$\lambda_3(k) = 1 - \frac{\|\Gamma(k-1)\zeta(k-d)\|^2}{\sigma+\zeta^T(k-d)\Gamma(k-1)\zeta(k-d)} \cdot \frac{1}{tr\Gamma(0)} \tag{16}$$

In the example of FIG. 16, the STR controller (adaptive controller) and the adaptive parameter adjusting mechanism are arranged outside the fuel injection amount-calculating system, and operate to calculate the feedback correction coefficient KSTR(k) such that the actual air-fuel ratio KACT(k) becomes equal to the desired air-fuel ratio coefficient KCMD(k−d') (d' represents the above-mentioned ineffective time period before the KCMD value reflects on the actual air-fuel ratio KACT) in an adaptive manner.

In this manner, the adaptive control correction coefficient KSTR(k) and the actual equivalent ratio KACT(k) are determined, which are input to the adaptive parameter-adjusting mechanism, where the adaptive parameter $\hat{\theta}(k)$ is calculated to be input to the STR controller. The STR controller is also supplied with the desired equivalent ratio coefficient KCMD(k) and calculates the adaptive control correction coefficient KSTR(k) such that the actual equivalent ratio KACT(k) becomes equal to the desired equivalent ratio coefficient KCMD(k), by the use of the following recurrence formula (17):

$$KSTR(k) = \frac{KCMD(k-d') - s_0 \times KACT(k) - r_1 \times KSTR(k-1) - r_2 \times KSTR(k-2) - r_3 \times KSTR(k-3)}{b_0} \tag{17}$$

Next, a manner of calculation of the feedback correction coefficient KFB by switching between the PID correction coefficient KLAF and the adaptive control correction coefficient KSTR, i.e. by switching between the PID control and the adaptive control.

Figure 17:
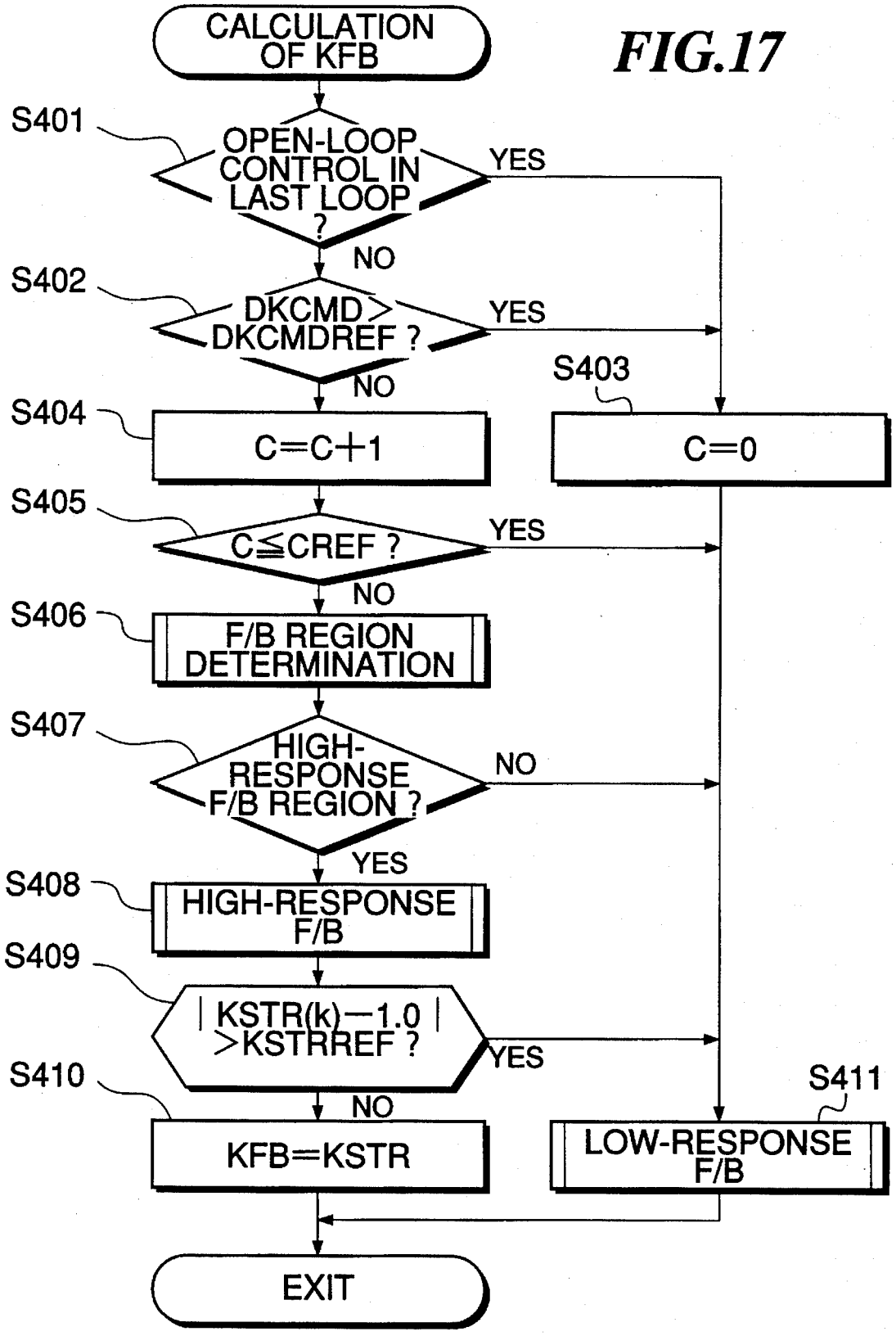
FIG. 17 is a flowchart showing a subroutine for calculating a feedback correction coefficient KFB.

FIG. 17 shows a subroutine for calculating the feedback correction coefficient KFB executed at the step S9 in FIG. 4.

First, it is determined at a step S401 whether or not the control mode was an open-loop control mode in the last loop of execution of the FIG. 4 routine, i.e. if FKLAFRESET=1 holds. If the control mode was not the open-loop control mode, it is determined at a step S402 whether or not a rate of variation DKCMD in the desired equivalent ratio KCMD (=|KCMD(k)−KCMD(k−1)| is larger than a reference value DKCMDREF. If the control mode was the open-loop control mode in the last loop of execution of the FIG. 4 routine, or if the control mode was the feedback control in-the last loop of execution of the FIG. 4 routine and at the same time the rate of variation DKCMD is larger than the reference value DKCMDREF, it is judged that the engine is in a region where the low-response feedback control should be executed (hereinafter referred to as "the low-response F/B region"). Then, a counter C is reset to "0" at a step S403, followed by the program proceeding to a step S411. At the step S411, the low-response F/B control is executed, which will be described with reference to FIG. 21, followed by terminating the program.

The engine is determined to be in the low-response F/B region when the engine was in the open loop region in the last loop because an air-fuel ratio value indicated by the LAF sensor output does not necessarily show a true or exact value of the air-fuel ratio of the mixture supplied to the engine due to delay of detection of the LAF sensor, which will occur e.g. when the fuel supply is resumed after fuel cut, so that the air-fuel ratio feedback control can be unstable. For a similar reason, when the amount of change DKCMD in the desired equivalent ratio KCMD is large, which will occur e.g. when a WOT enriching operation is stopped to resume the normal air-fuel control, or when,the air-fuel ratio control is switched over from the lean-burn control to the feedback control to the stoichiometric air-fuel ratio, the engine is determined to be in the low-response F/B region.

If the answers to the questions of the steps S401 and S402 are both negative (NO), i.e. if the control mode was the feedback control mode in the last loop and at the same time the rate of variation DKCMD in the desired equivalent ratio KCMD is smaller than the reference value DKCMDREF, the count value of the counter C is incremented by "1" at a step S404, and then the count value of the counter C is compared with a predetermined value CREF (e.g. 5) at a step S405. If C≦CREF holds, the program proceeds to the step S411, whereas if C>CREF holds, the program proceeds to a step S406, wherein it is determined by executing a subroutine, described hereinafter, whether the engine is operating in a region in which a high-response feedback control should be executed (hereinafter referred to as "the high-response F/B region") or in the low-response F/B region. Then, at a step S407, it is determined whether or not the control region in which the engine has been determined to be operating at the step S406 is the high-response F/B region. If the determined control region is not the high-response F/B region, the program proceeds to the step S411, whereas if the control region is the high-response F/B region, the program proceeds to a step S408, wherein a subroutine for the high-response feedback control, described hereinafter, is executed to calculate the adaptive control correction coefficient KSTR. Then, it is determined at a step S409 whether or not the absolute value of the difference |KSTR(k)−1.0| between the adaptive control correction coefficient KSTR and 1.0 is larger than a predetermined reference value KSTRREF. If |KSTR(k)−1.0|>KSTRREF holds, the program proceeds to the step S411, whereas if |KSTR(k)−1.0|≦KSTRREF holds, the feedback correction coefficient KFB is set to the KSTR value at a step S410, followed by terminating the program.

When the absolute value of the difference between the adaptive control correction coefficient KSTR and 1.0 is larger than the predetermined reference value KSTRREF, the low-response feedback control is selected for the purpose of achieving stability of the control.

When the count value of the counter C is smaller than the reference value CREF, the low-response feedback control is selected because immediately after returning of the engine operating condition from the open-loop control or immediately after a large variation in the desired equivalent ratio KCMD, a time lag before completion of fuel combustion and a response lag of the LAF sensor are so large that influences thereof cannot be compensated for by the adaptive control.

Figure 18:
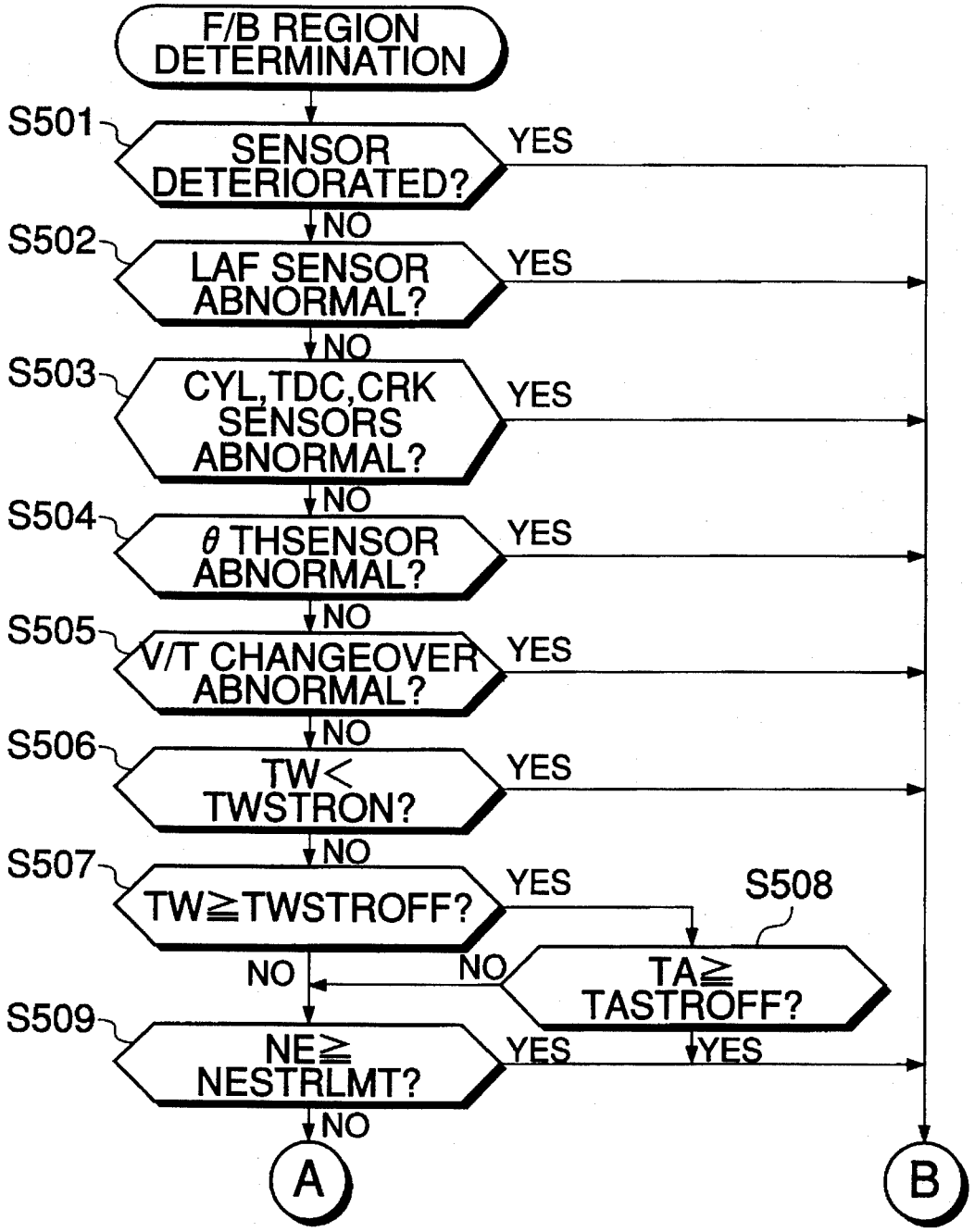
FIG. 18 is a flowchart showing a subroutine for selecting the response speed of the air-fuel ratio feedback control, i.e. for determining whether the engine is operating in a STR feedback control region or a PID feedback control region, which is executed at a step S406 in FIG. 17.
Figure 19:
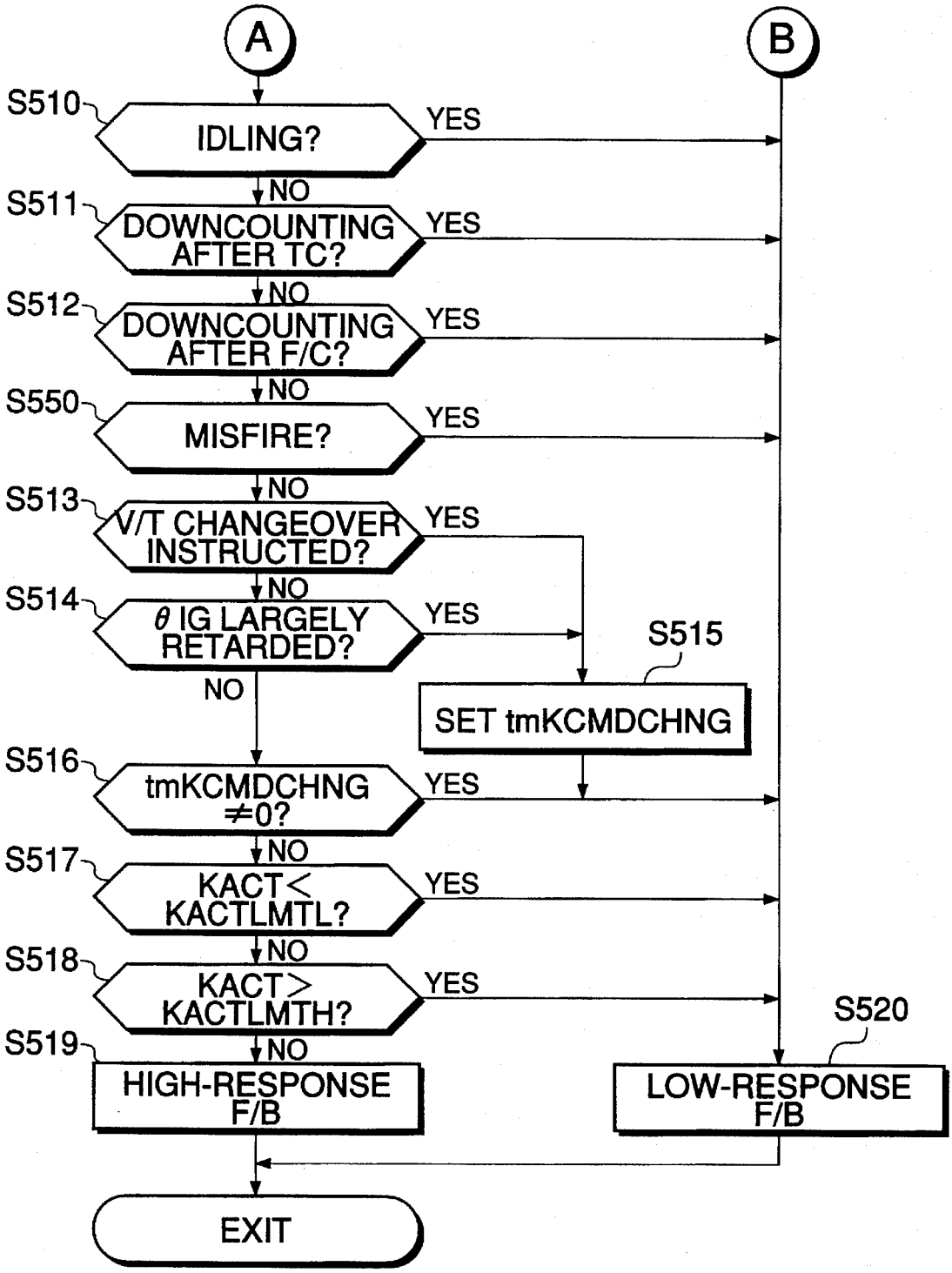
FIG. 19 is a continued part of FIG. 18 flow.

Next, the subroutine executed at the step S406 for selecting the response speed of the air-fuel ratio feedback control, i.e. determining whether the engine is operating in the high-response F/B region or in the low-response F/B region will be described with reference to FIG. 18.

First, at a step S501, it is determined whether or not the LAF sensor 17 has been deteriorated in response characteristic. If the LAF sensor 17 has not been deteriorated in response characteristic, the program proceeds to a step S502.

At the step S502, it is determined whether or not abnormality of the LAF sensor 17 has been detected. If no abnormality of the LAF sensor 17 has been detected, it is determined at a step S503 whether or not abnormality of the crank angle sensor 14 (cylinder-discriminating sensor, TDC sensor, CRK sensor) has been detected. If no abnormality of the crank angle sensor has been detected, it is determined at a step S504 whether or not abnormality of throttle valve opening θTH sensor 4 has been detected. If no abnormality of the throttle valve opening sensor 4 has been detected, it is determined at a step S505 whether or not abnormality of the valve timing changeover mechanism 60 has been detected.

If all the answers to the questions of the steps S501 to S505 are negative (NO), the program proceeds to a step S506, whereas any of the answers is affirmative (YES), it is determined at a step S520 that the engine is in the low-response F/B region, followed by terminating the program.

The low-response feedback control is thus selected when any of the above-mentioned sensors is abnormal, so as to prevent lowering of the controllability of the air-fuel ratio.

Then, at the step S506, it is determined whether or not the engine coolant temperature TW is lower than a predetermined value TWSTRON. If TW≧TWSTRON holds, it is determined at a step S507 whether or not the engine coolant temperature TW is equal to or higher than a predetermined value TWSTROFF (e.g. 100° C.). If TW≧TASTROFF holds, it is determined at a step S508 whether or not the intake air temperature TA is equal to or higher than a predetermined value TASTROFF. If TW<TWSTROFF holds at the step S507 or if TW≧TWSTROFF holds at the step S507 and at the same time TA<TASTROFF holds at the step S508, the program proceeds to a step S509, wherein it is determined whether or not the engine rotational speed NE is higher than a predetermined value NESTRLMT. If NE<NESTRLMT holds, it is determined at a step S510 whether or not the engine is idling. If the engine is not idling, it is determined at a step S511 whether or not a timer is in operation for measuring a time period elapsed after termination of traction control by the traction control system (TCS). This timer is formed by a downcount timer, and set during TCS operation and starts when the TCS operation is terminated.

If the timer is not in operation at the step S511, it is determined at a step S512 whether or not a timer is in operation for measuring a time period elapsed after termination of fuel cut. The fuel cut is carried out when the engine is in a predetermined decelerating condition, and a fuel cut flag FFC is set to "1" during the fuel cut operation. This timer is also formed by a downcount timer, and set during the fuel cut operation and started downcounting operation after termination of fuel cut.

If any of the answers to the questions of the steps S506 and S509 to S512 is affirmative (YES), or if both the answers to the questions of the steps S507 and S508 are affirmative (YES), it is determined at a step S520 that the engine is in the low-response F/B region, followed by terminating the program. If the answer to the question of the step S512 is negative (NO), the program proceeds to a step S550.

At the step S550, it is determined whether or not a misfire has occurred in the engine. The occurrence of a misfire can be determined by determining that a misfire has occurred in the engine when the variation of the engine rotational speed NE is above a predetermined value, as disclosed in Japanese Laid-Open Patent Publication (Kokai) No. 6-146998 filed by the present assignee. When the engine suffers from a misfire, the program proceeds to the step S520, whereas the engine does not suffer from a misfire, the program proceeds to a step S513.

At the step S513, it is determined whether or not changeover of the valve timing between the high-speed V/T and the low-speed V/T has been instructed. If the changeover has not been instructed, it is determined at a step S514 whether or not the ignition timing of the engine has been largely retarded. If the ignition timing has not been retarded, the program process to a step S516. If either the answer to the question of the step S513 or the answer to the question of the step S514 is affirmative(YES), a tmKCMDCHNG downcount timer is set to a predetermined time period TCHNG and started at a step S515, followed by the program proceeding to the step S520. The predetermined time period TCHNG is set to a time period sufficient for the combustion of the engine to become stable after the changeover of the valve timing has been instructed or after the ignition timing has been largely retarded.

At the step S516, it is determined whether or not the count of the tmKCMDCHNG downcount timer is not equal to "0". If the count is not equal to "0", the program proceeds to the step S520, whereas if the count is equal to "0", it is determined at steps S517 and S518 whether or not the actual equivalent ratio KACT is within a predetermined range defined by a predetermined lower limit value KACTLMTL (e.g. 0.99) and a predetermined higher limit value KACTLMTH (e.g. 1.01). If KACT<KACTLMTL or KACT>KACTLMTH holds, the program proceeds to the step S520, whereas if KACTLMTL≦KACT≦KACTLMTH holds, the program proceeds to a step S519, wherein it is determined that the engine is in the high-response F/B region, followed by terminating the program.

By executing the steps S517 and S518, changeover of the feedback control from the low-response feedback control to the high-response feedback control is carried out only when the actual equivalent ratio KACT is equal to 1.0 or a value close thereto, to thereby achieve smooth changeover of the feedback control mode and hence ensure required stability of the air-fuel ratio control.

The reason why it is thus determined by the steps S506 to S516 that the low-response feedback control should be executed is as follows:

When the engine coolant temperature TW is low (TW<TWSTRON), the engine combustion is not stable due to insufficient atomization of fuel and increased friction between the piston and the cylinder, so that a misfire can occur. Therefore, a stable value of the detected equivalent ratio KACT cannot be obtained if the high-response feedback control is carried out in such a condition. Also when the engine coolant temperature TW is extremely high (TW≧TWSTROFF) and at the same time the intake air temperature is extremely high (TA≧TASTROFF), vapor lock can occur in the fuel supply line to decrease the actual amount of fuel injection. Further, when the engine rotational speed NE is high, i.e. if NE≧NESTRLMT holds, the ECU 5 can have an insufficient calculation time and further the engine combustion is not stable. Further, when the engine is idling, the engine operating condition is almost stable such that the adaptive control, which has a high gain, is not required to be carried out. Immediately after termination of the traction control in which the ignition timing is temporarily largely retarded or fuel cut is effected to decrease the torque of the engine so as to avoid excessive slippage of the wheels, the engine combustion is not stable before a predetermined time period elapses after termination of the traction control, so that execution of the high-response feedback control can unexpectedly result in an increase in the variation of the air-fuel ratio. For a similar reason, immediately after termination of a usual decelerating fuel cut operation, the low-response feedback control is selected. Similarly, when a misfire occurs in the engine, the engine combustion is undoubtedly unstable, so that the low-response feedback control is selected. Further, before a predetermined time period (TCHNG) elapses after changeover of the valve timing, the combustion state of the engine drastically changes due to a change in the valve opening period over which the intake or exhaust valves are opened. Also, before the predetermined time period TCHNG elapses after termination of control of ignition timing to a largely retarded timing, the engine combustion is not stable, and hence a stable KACT value cannot be expected.

In addition to the traction control, large retardation of the ignition timing may be carried out in execution of other kinds of control such as torque shock-reducing control executed when the automatic transmission undergoes a change in the shift gear position, knocking-avoiding control executed when load on the engine is high, ignition timing control executed for the purpose of accelerating the rise of the temperature of the catalysts immediately after the engine is started, or on like occasions.

Next, the high-response/low-response feedback control executed by the control system according to the present embodiment will be described.

Figure 20:
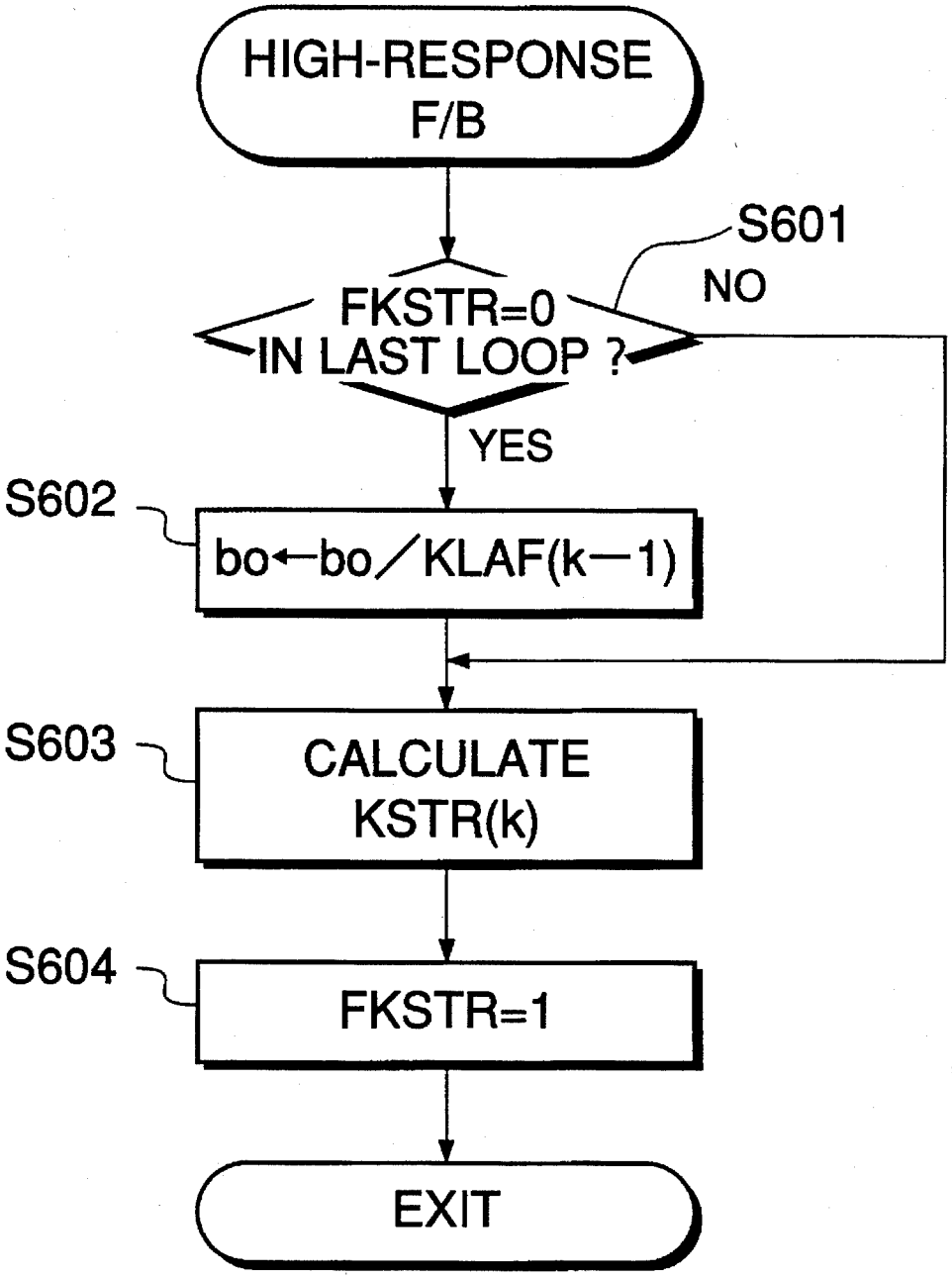
FIG. 20 is a flowchart showing a subroutine for a high-response feedback control, which is executed by the control system according to the first embodiment at a step S519 in FIG. 19.

FIG. 20 shows a subroutine for carrying out the high-response feedback control executed at the step S408 of the FIG. 17 subroutine. First, at a step S601, it is determined whether or not the flag FKSTR, which, when set to "1", indicates that the engine is operating in a region in which the feedback control by the use of the adaptive control correction coefficient KST should be executed (hereinafter referred to as "the adaptive control region"), assumed "0" in the immediately preceding loop. If the flag KSTR assumed "1" in the last loop, the program jumps to a step S603, wherein the adaptive control correction coefficient KSTR is calculated in the manner described hereinbefore, and then the flag FKSTR is set to "1" at a step S604, followed by terminating the present routine.

On the other hand, if the flag FKSTR assumed "0" in the last loop, the adaptive parameter b0 (scalar quantity determining the gain) is replaced by a value obtained by dividing the b0 value by the last value KLAF(k−1) of the PID correction coefficient KLAF at a step S602, followed by the program proceeding to the step S603.

By replacing the adaptive parameter b0 by the value b0/KLAF(k−1) at the step S602, further smooth changeover from the PID control to the adaptive control can be obtained to thereby ensure required stability of the control. The reason for carrying out the replacement is as follows: If the value b0 in the equation (17) is replaced by the value b0/KLAF(k−1), the following equation (18) is obtained, where the first term of the first equation is equal to "1" because the adaptive correction coefficient KSTR is set to and held at 1 (KSTR(k)=1) during execution of the PID control. Accordingly, the value KSTR(k) at the start of the adaptive control becomes equal to the value KLAF(k−1), resulting in smooth changeover of the correction coefficients:

$$KSTR(k) = \left[ \frac{\begin{array}{c} KCMD(k-d') - s_0 \times \\ KACT(k) - r_1 \times KSTR(k-1) - \\ r_2 \times KSTR(k-2) - r_3 \times KSTR(k-3) \end{array}}{b_0} \right] \times KLAF(k-1) = 1 \times KLAF(k-1) = KLAF(k-1) \tag{18}$$

Figure 21:
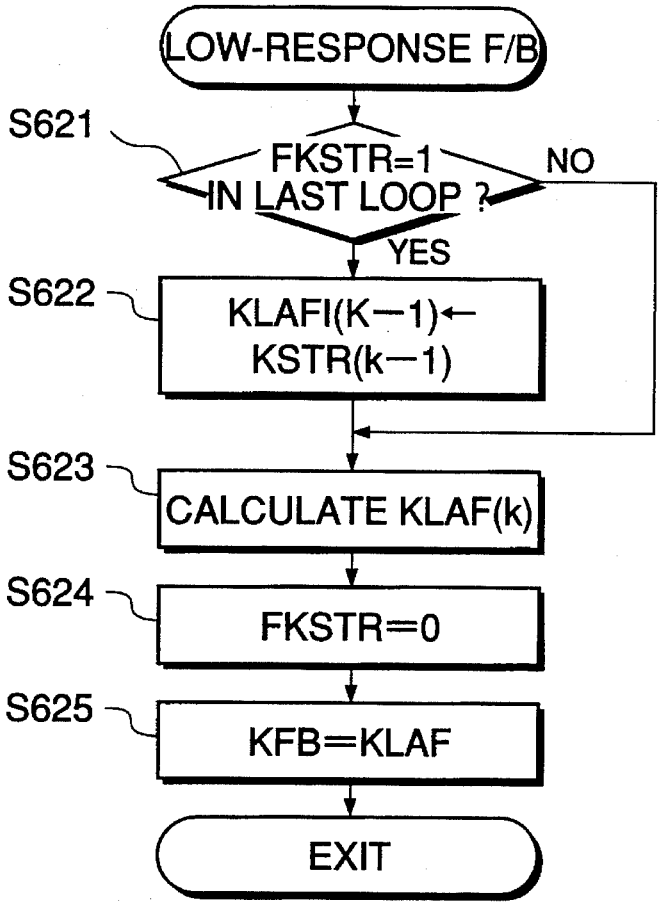
FIG. 21 iS a flowchart showing a subroutine for a low-response feedback control, which is executed by the control system according to the first embodiment at a step S520 in FIG. 19.

FIG. 21 shows a subroutine for carrying out the low-response feedback control executed at the step S411 of the FIG. 17 subroutine. First, at a step S621, it is determined whether or not the STR flag FKSTR assumed "0" in the last loop. If FKSTR=0 held in the last loop, the program jumps to a step S623, wherein the PID correction coefficient KLAF is calculated by executing the FIG. 15 subroutine. Then, the flag FKSTR is set to "0" at a step S624, and the program proceeds to a step S625, wherein the feedback correction coefficient KFB is set to the PID correction coefficient KLAF(k) calculated at the step S623, followed by terminating the present program.

On the other hand, if FKSTR=0 held in the last loop, the immediately preceding value KLAFI(k−1) of the integral term of the PID control is set to the immediately preceding value KSTR(k−1) of the adaptive control correction coefficient KSTR at a step S622, followed by the program proceeding to the step S623.

When changeover from the adaptive control to the PID control is carried out (if FKSTR=1 held in the immediately preceding loop and the engine is in the low-response F/B region in the present loop), there is a possibility of a drastic change in the integral term KLAFI of the PID control. Therefore, the step S622 is executed to set KLAF(k−1)=KSTR(k−1). This can reduce the difference between the adaptive control correction coefficient KSTR(k−1) and the PID correction coefficient KLAF(k), whereby smooth changeover from the adaptive control to the PID control can be carried out, to thereby ensure required stability of the engine control.

By virtue of the operations carried out by the FIGS. 17 to 21 subroutines, so long as the engine combustion is not in a steady condition, the air-fuel ratio feedback control is changed over from the adaptive control to the PID control, whereby sufficient accuracy and stability of the air-fuel ratio control can be ensured even when the engine is not in a steady operating condition, to thereby maintain excellent driveability and exhaust emission characteristics of the engine.

Next, a control system according to a second embodiment of the invention will be described. This embodiment is distinguished from the first embodiment described above in that while in the first embodiment whether or not the engine is operating in the low-response F/B region or the high-response F/B region is determined depending on operating conditions of the engine, then the adaptive control is applied as the high-response feedback control, and the PID control as the low-response feedback control, in the second embodiment the adaptive control is also applied as the low-response feedback control but the response speed is reduced, instead of executing the PID control. Therefore, description of the second embodiment is identical with that of the first embodiment except for those described hereinabove with reference to FIGS. 20 and 21, which are replaced by FIGS. 22 and 23 in the present embodiment. Further, it should be noted that in the illustrated embodiments, the algorithm of the adaptive control is set to a fixed gain algorithm, i.e. gain matrix Γ(k)=Γ.

Figure 22:
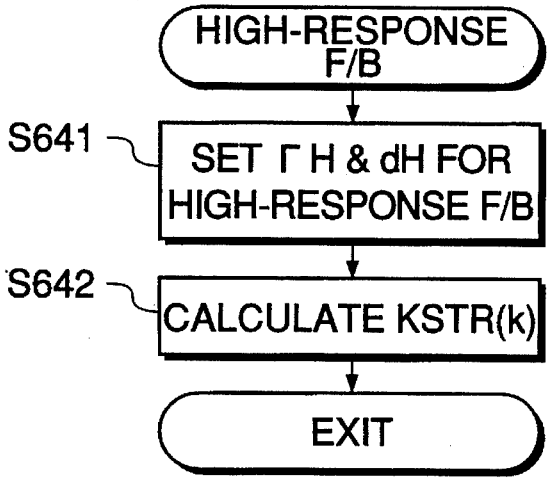
FIG. 22 is a flowchart showing a subroutine for a high-response feedback control, which is executed by a control system according to a second embodiment of the invention at the step S519 in FIG. 19.

FIG. 22 shows a subroutine for carrying out the high-response feedback control, which is executed at the step S408 of the FIG. 17 routine. First, at a step S641, a gain matrix ΓH for the high-response feedback control is selected as the gain matrix Γ, and at the same time the number of cycles d indicative of the ineffective time of the adaptive control is set to a value dH for the high-response feedback control. Then, the adaptive control correction coefficient KSTR is calculated in the manner described hereinbefore at a step S642, followed by terminating the program.

Figure 23:
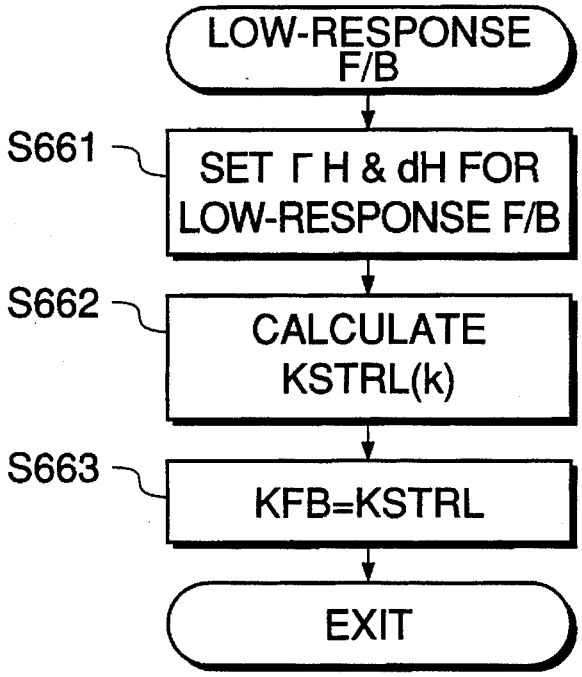
FIG. 23 is a flowchart showing a subroutine for a low-response feedback control, which is executed by the control system according to the second embodiment at a step S520 in FIG. 19.

FIG. 23 shows a subroutine for carrying out the low-response feedback control, which is executed at the step S411 of the FIG. 17 routine.

At a step S661, a gain matrix ΓL for the low-response feedback control is selected as the gain matrix Γ, and at the same time the number of cycles d indicative of the ineffective time of the adaptive control is set to a value dL for the low-response feedback control, which is larger than the value dH. Then, an adaptive control correction coefficient KSTRL for the low-response feedback control is calculated at a step S662, and the feedback correction coefficient KFB is set to the KSTRL value at a step S663, followed by terminating the program.

The gain matrix ΓL for the low-response feedback control is set such that it provides a smaller gain than the gain matrix ΓH for the high-response feedback control. More specifically, the gain matrix is defined by the following equation (19):

$$\Gamma = \begin{bmatrix} g1 & 0 & 0 & 0 & 0 \\ 0 & g2 & 0 & 0 & 0 \\ 0 & 0 & g3 & 0 & 0 \\ 0 & 0 & 0 & g4 & 0 \\ 0 & 0 & 0 & 0 & g5 \end{bmatrix} \quad (19)$$

The equation (19), which represents the gain matrix Γ used in the present embodiment, is formed by a row of five parameters and a column of five parameters. The magnitudes of adaptive parameters g1, g2, g3, g4 and g5 determine rates of change in the adaptive parameters b0, r1, r2, r3, s0 calculated by the parameter-adjusting mechanism. Therefore, by setting the parameters g1, g2, g3, g4 and g5 to smaller values than the gain matrix ΓH for the high-response feedback control, the gain matrix ΓL for the low-response feedback control is obtained, which sets a lower adjustment rate or speed of the adaptive parameters calculated by the parameter-adjusting mechanism. In the present case, all the parameters g1 to g5 are set to smaller values as mentioned above. Alternatively, only part of them may be changed. For example, the parameters g1 to g4 corresponding to rates of change of the adaptive parameters r1 to r3, which define the gain of the control system, may be changed, or one or both of the parameters g1 and g5 corresponding to rates of change of the adaptive parameters s0 and b0, which define the responsiveness of the control system, may be changed.

Further, the responsiveness of the control system is determined by the whole gain matrix Γ, and therefore it is possible to lower the responsiveness of the control system by changing the parameters independently of each other, e.g. by increasing the parameter g5 and slightly decreasing the parameters g2 to g4.

By executing the subroutines shown in FIGS. 17 to 19, and FIGS. 22 and 23, according to the second embodiment, it is possible to obtain the same effect as obtained by the first embodiment, i.e. the effect of suppressing undesired variations in the air-fuel ratio when the engine combustion is not in a steady condition.

Although in the present embodiment, the parameters g1, g2, g3, g4 and g5 of the gain matrix are set to predetermined values for the high-response feedback control and predetermined values for the low-response feedback control in advance, this is not limitative, but the parameters g1 to g5 can be set during operation of the engine according to a degree of degradation of the engine combustion which is detected while the engine is in operation.

Further, although in the present embodiment, the parameters of the gain matrix Γ and the number of cycles d indicative of the ineffective time are both changed to change the speed of the adaptive control depending upon whether or not the engine is operating in the low-response F/B region or the high-response F/B region, this is not limitative, but only one of the gain matrix and the number of cycles d may be changed instead.

Still further, although when the engine is in an unstable or unsteady condition, the air-fuel ratio feedback control is changed over from the adaptive control to the PID control in the first embodiment, and the response speed of the adaptive control is changed in the second embodiment, this is not limitative, but both of the measures for the air-fuel ratio feedback control in an unstable or unsteady condition of the engine may be employed for selective use depending on the situation or operating conditions of the engine.

Figure 24:
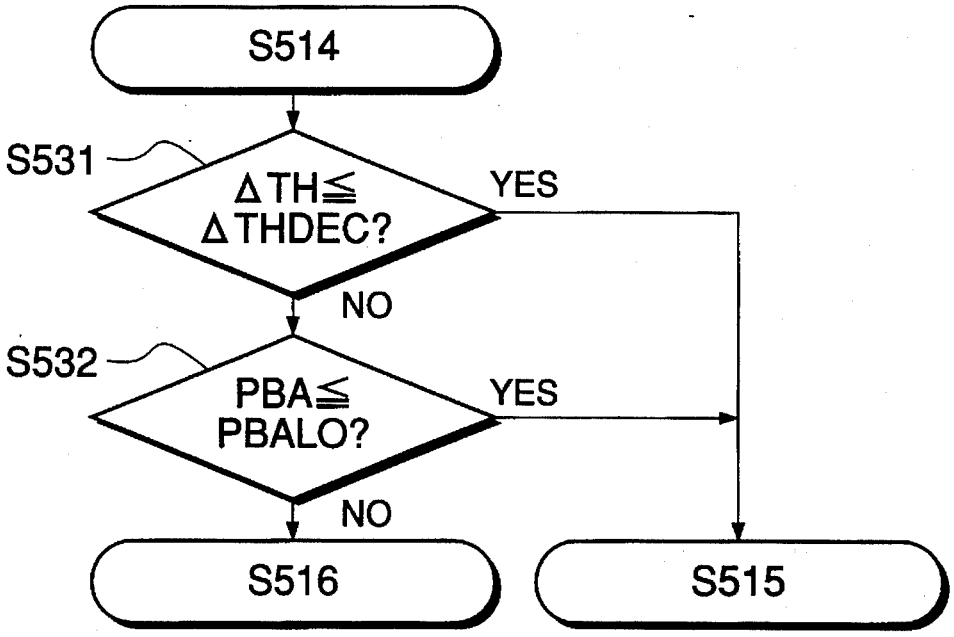
FIG. 24 is part of a flowchart showing a subroutine for selecting the response speed of the air-fuel ratio feedback control, which is executed by a control system according to a third embodiment of the invention.

Next, description will be made of a third embodiment of the invention. In view of the fact that the engine combustion becomes unstable also when the engine is decelerating, and the resulting variation in the output from the LAF sensor 17 causes an increased variation in the air-fuel ratio of the mixture supplied to the engine, according to the present embodiment the control speed of the control system is reduced as carried out by the control system of the first embodiment, also when the engine is decelerating. The basic construction of the control system according to the third embodiment is identical with that of the first embodiment, and hence FIGS. 1 to 17, 20 and 21 and their corresponding descriptions can apply here, but additional description will be made with reference to FIG. 24 which shows steps to be inserted between the steps S514 and S516 in FIG. 19. Therefore, the determination as to whether the engine is operating in the high-response F/B region or the low-response F/B region is carried out by a new subroutine shown in FIG. 18 and FIG. 19 into which FIG. 24 is incorporated. Description of the steps of the new subroutine which are identical to those of the corresponding subroutine of the first embodiment is omitted.

Referring to FIG. 24, at a step S531, it is determined whether or not an amount of change a ΔTH in the throttle valve opening θTH per predetermined time period is equal to or lower than a predetermined value ΔTHDEC (negative value). If ΔTH>ΔTHDEC holds, it is determined at a step S532 whether or not the intake pipe absolute pressure PBA is equal to or lower than a predetermined value PBALO. If ΔTH>ΔTHDEC holds and at the same time PBA>PBALO holds, it is judged that the engine is not in a decelerating region, and then the program proceeds to the step S516 in FIG. 19, whereas if ΔTH≦ΔTHDEC or PBA≦PBALO holds, it is judged that the engine is in the decelerating region, and then the program proceeds to the step S515 in FIG. 19.

The provision of the additional steps S531 and S532 makes it possible to suppress undesired variation in the air-fuel ratio during deceleration of the engine.

Although in the third embodiment, as the low-response feedback control, the PID control is adopted, this is not limitative, but the adaptive control may be continued but the control speed thereof is reduced, as described with respect to the second embodiment.

In the first to third embodiments described heretofore, preferably abnormality of each of the sensors is detected e.g. by determining whether or not an output from the sensor falls outside a range defined by predetermined upper and lower limit values, or the output from the same remains unchanged over a predetermined time period. Also preferably,, the LAF sensor 17 is determined to be abnormal when the label resistance thereof cannot be read or when the response characteristic thereof is deteriorated.

The deterioration of the response characteristic of the LAF sensor 17 may be carried out such that the sensor is determined to be deteriorated when the difference between a time period TFC elapsed from a time point of starting of fuel cut to a time point the output from the LAF sensor bas reached an A/F value of 30 and a reference time period TFCREF determined by measurement in the same manner in advance when the LAF sensor 17 was put to use exceeds a predetermined value.

Further, abnormality of the valve timing changeover mechanism may be determined by comparing the oil pressure in the valve timing mechanism and a command signal for changeover of the valve timing delivered from the ECU 5o Next, description will be made of a fourth embodiment of the invention. This embodiment is distinguished from the first to third embodiments only in that it is further provided with means for taking fail-safe actions in the event of occurrence of abnormality of sensors detected during the air-fuel ratio control. Therefore, detailed description will be made only of points different from the preceding embodiments.

Figure 25:
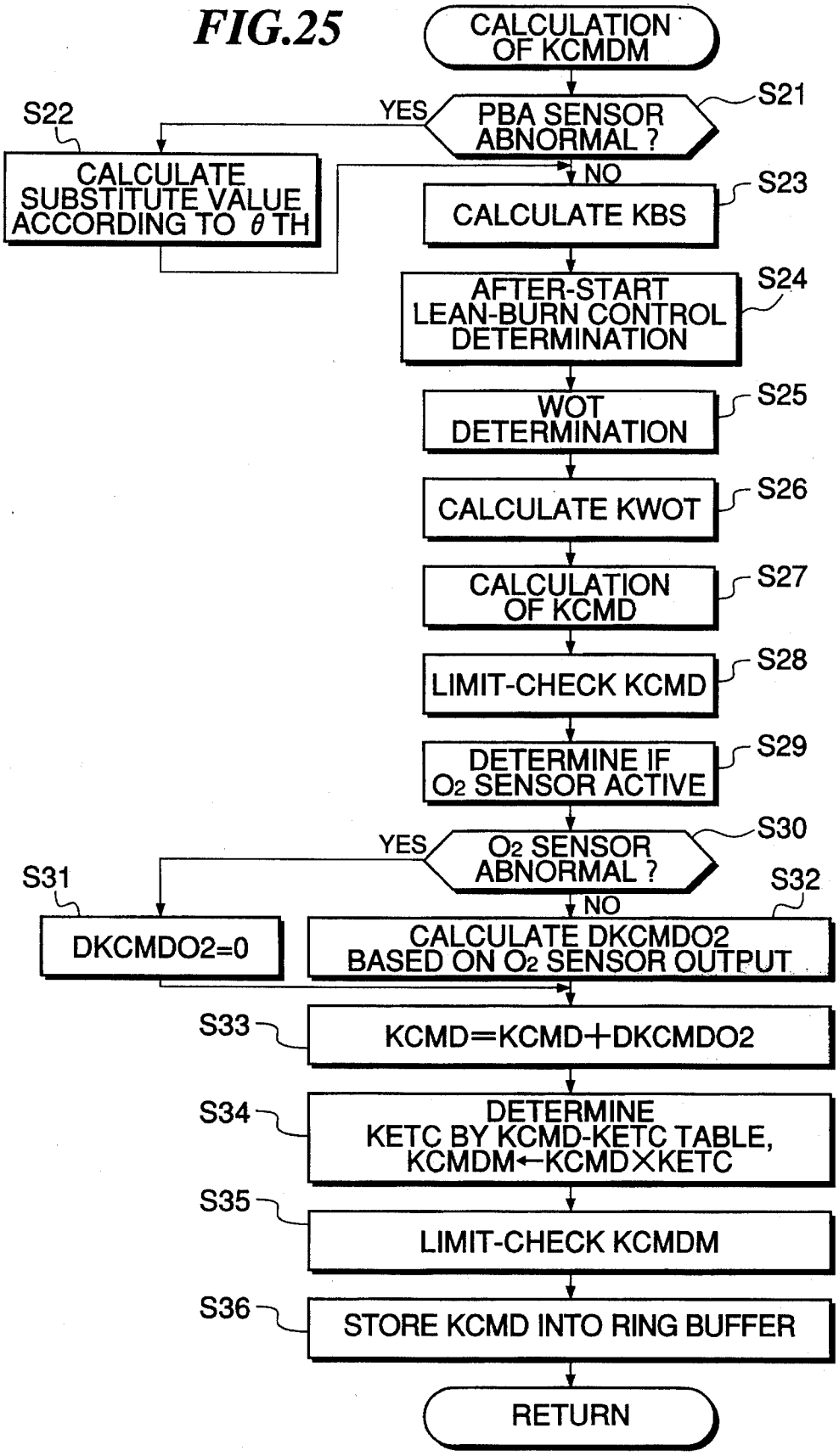
FIG. 25 is a flowchart showing a subroutine for calculating the final desired air-fuel ratio coefficient KCMDM, which is executed by a control system according to a fourth embodiment of the invention.

In the present embodiment, the desired air-fuel ratio coefficient KCMDM is calculated by executing a subroutine shown in FIG. 25. This subroutine is different from the FIG. 5 subroutine of the first embodiment in that additional steps are provided for determining abnormality of the PBA sensor and the 02 sensor. The remaining part of this subroutine is identical with that of the FIG. 5 subroutine, and hence corresponding steps are designated by identical step numbers, and description thereof is omitted.

Referring to FIG. 25, first, at a step S21, it is determined whether or not abnormality of the intake pipe absolute pressure sensor 10 has been detected. If no abnormality of the intake pipe absolute pressure sensor 10 has been detected, the program jumps to the step S23, whereas if it has been detected, a substitute value calculated from the throttle valve opening θTH is set as a value of the intake pipe absolute pressure PBA, followed by the program proceeding to the step S23.

From the step S29, the program proceeds to a step S30, wherein it is determined whether or not abnormality of the 02 sensor 18 has been detected. If no abnormality of the 02 sensor 18 has been detected, the program proceeds to the step S32, whereas if it has been detected, the program proceeds to a step S31, wherein the correction term DKCMDO2 is set to "0", followed by the program proceeding to the step S33.

Further, in the present embodiment, the LAF feedback control region determination at the step S6 in the FIG. 4 routine is executed by a subroutine shown in FIG. 26. This subroutine is distinguished from the corresponding FIG. 14 subroutine of the first embodiment in provision of additional steps S126 to S129. The corresponding steps are designated by identical step numbers, and description thereof is omitted.

Referring to FIG. 26, if all the answers to the questions of the steps S121 to S125 are negative (NO), it is further determined at a step S126 whether or not abnormality of the label resistance of the LAF sensor 17 has been detected. If abnormality of the label resistance of the LAF sensor 17 has been detected, it is determined at a step S127 whether or not the air-fuel ratio of the mixture is being feedback-controlled to the stoichiometric air-fuel ratio, i.e. whether or not the desired air-fuel ratio KCMD is equal to 1.0. If no abnormality of the label resistance has been detected, or if the air-fuel ratio of the mixture is being controlled to the stoichiometric air-fuel ratio even if abnormality of the label resistance has been detected, the program proceeds to a step S128, wherein it is determined whether or not abnormality of the engine coolant temperature sensor has been detected. If no abnormality of the engine coolant temperature sensor has been detected, it is determined at a step S129 whether or not the intake pipe absolute pressure sensor is abnormal. If the answer to the question of the step S127 is negative (NO), or if either the answer to the question of the step S128 or the answer to the question of the step S129 is affirmative (YES), the program proceeds to the step S132, wherein the KLAF reset flag FKLAFRESET is set to "1", whereas if all the answers to the questions of the steps SS126, S128, and S129 are negative (NO), the KLAF reset flag FKLAFRESET is set to "0" at the step S131.

According to the present embodiment, when abnormality of the LAF sensor 17, the engine coolant temperature sensor 13 or the intake pipe absolute pressure sensor 10 is detected, the air-fuel ratio feedback control based on the LAF sensor output is inhibited, which prevents the controllability of the air-fuel ratio from being unexpectedly degraded due to execution of the LAF feedback control when any of the above sensors is abnormal.

Further, when the response characteristic of the LAF sensor 17 has been deteriorated (i.e. the delay time in the response of the sensor has become long), it is desirable that, in the equation (18) for calculation of the adaptive control correction coefficient KSTR(k):

$$KSTR(k) = \frac{KCMD(k-d') - s_0 \times KACT(k) - r_1 \times KSTR(k-1) - r_2 \times KSTR(k-2) - r_3 \times KSTR(k-3)}{b_0} \quad (18)$$

the number of cycles d indicative of the ineffective time is increased or the gain matrix Γ is changed to provide a smaller gain, thereby reducing the speed of adjustment (identification) of the adaptive parameters. This makes it possible to continue the adaptive feedback control even if the response characteristic of the LAF sensor 17 has been deteriorated, thereby minimizing the degradation of exhaust emission characteristics and driveability of the engine. Alternatively, when the response characteristic of the LAF sensor 17 has been deteriorated, the adaptive control may be changed over to the PID control.

Figure 27:
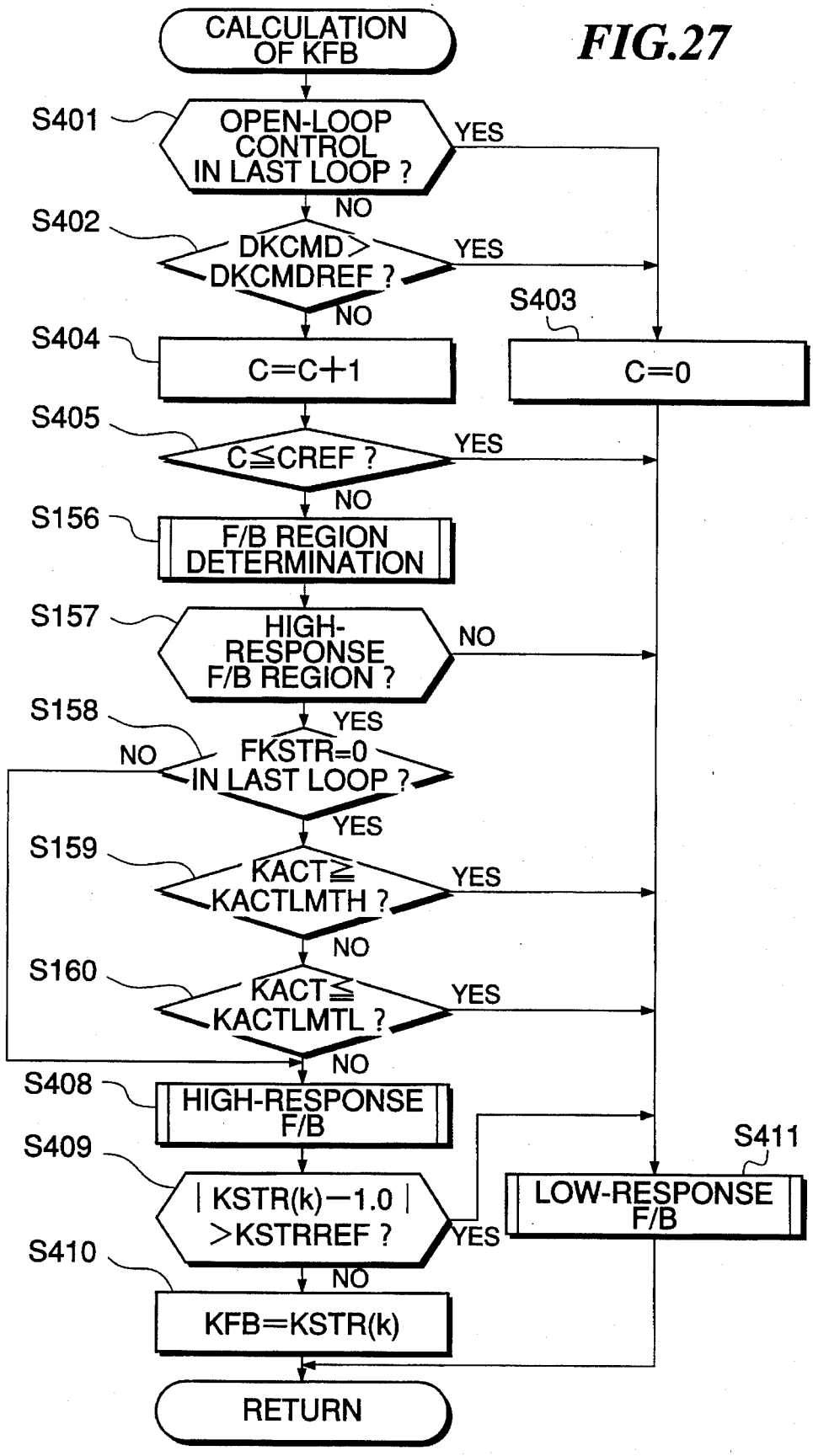
FIG. 27 is a flowchart showing a subroutine for calculating the feedback correction coefficient KFB according to the fourth embodiment.

In the present embodiment, the feedback correction coefficient KFB is calculated by executing a subroutine shown in FIG. 27. This subroutine is similar to the FIG. 17 subroutine of the first embodiment, and steps S401 to S405 and S408 to S411 are identical to the corresponding steps of the FIG. 17 subroutine, and hence these corresponding steps Sare designated by identical step numbers, with description thereof being omitted.

Figure 28:
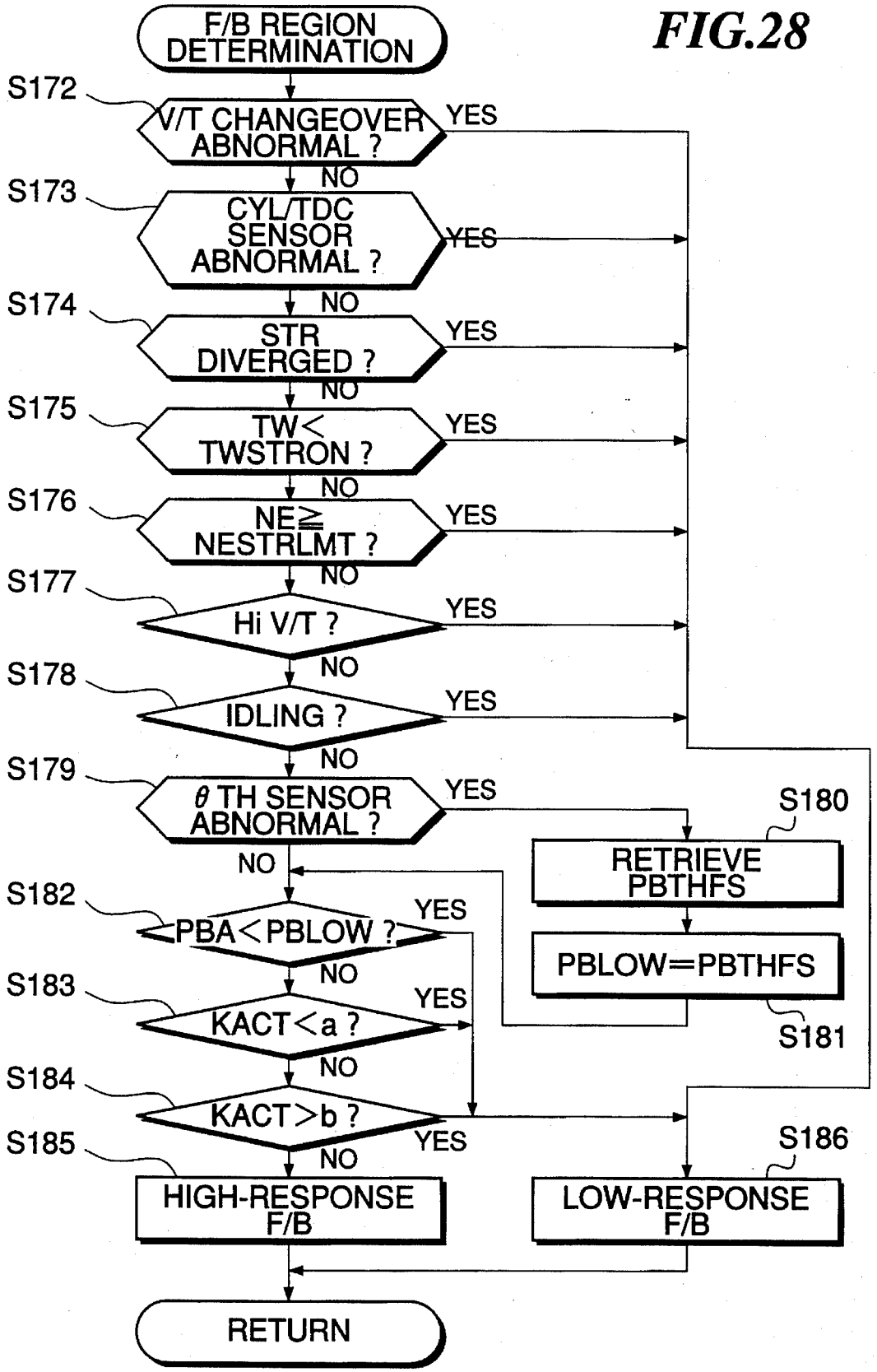
FIG. 28 is a flowchart showing a subroutine for selecting the response speed of the air-fuel ratio feedback control, i.e. for determining whether the engine is operating in a STR feedback control region or a PID feedback control region, which is executed by the control system according to the fourth embodiment at a step S156 in FIG. 27.

Referring to FIG. 27, if C>CREF holds at the step S405, the program proceeds to a step S156 wherein a subroutine shown in FIG. 28 is executed for determining whether the engine is operating in the high-response F/B region (STR control region) or the low-response F/B region (PID control region).

Referring to FIG. 28, first, at a step S172, it is determined whether or not abnormality of changeover of the valve timing has been detected. If no abnormality of changeover of the valve timing has been detected, it is determined at a step S173 whether or not abnormality of the CYL sensor or the TDC sensor has been detected. If abnormality of neither of the sensors has been detected, it is determined at a step S174 whether or not the adaptive control, i.e. the air-fuel ratio correction coefficient KSTR has diverged. If any of the answers to the questions of the steps S172 to S174 is affirmative (YES), the program proceeds to a step S186, wherein it is determined that the engine is operating in the low-response F/B region (PID control region), followed by terminating the program. On the other hand, if all the answers to the questions of the steps S172 to S174 are negative (NO), further determinations are carried out at steps S175 to S179. Whether the adaptive control has diverged or not is determined by whether or not the adaptive control correction coefficient KSTR falls outside a range defined by upper and lower limit values.

It is further determined at the step S175 whether or not the engine coolant temperature TW is lower than a predetermined value TWSTRON. If TW≧TWSTRON holds, it is determined at a step S176 whether or not the engine rotational speed NE is equal to or higher than a predetermined value NESTRLMT. If NE<NESTRLMT holds, it is determined at the step S177 whether or not the present valve timing is the high-speed valve timing. If the present valve timing is not the high-speed valve timing, it is determined at the step S178 whether or not the engine is idling. If any of the answers to the questions of the steps S175 to S178 is affirmative (YES), the program proceeds to the step S186, followed by terminating the program, whereas if all the answers to the questions of the steps S175 to S178 are negative (NO), the program proceeds to the step S179.

Figure 29:
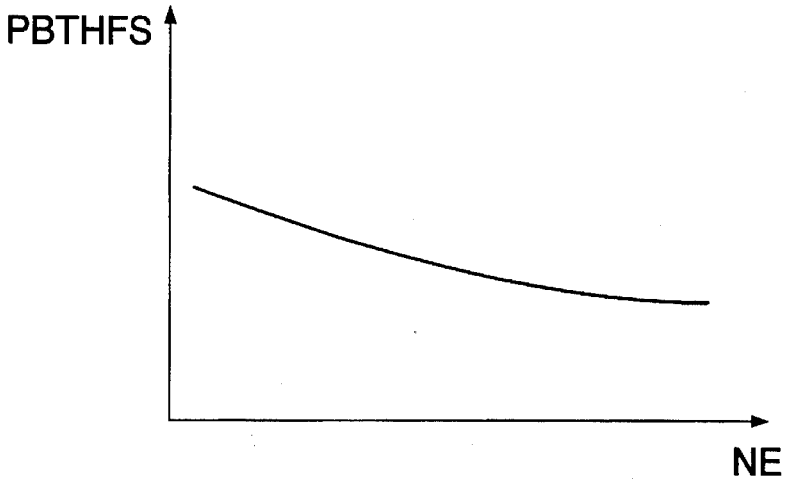
FIG. 29 shows a table for use in determining a reference value PBTHFS for determining whether the STR feedback control should be stopped.

At the step S179, it is determined whether or not abnormality of the throttle valve opening sensor 4 has been detected. If no abnormality of the throttle valve opening sensor 4 has been detected, the program jumps to a step S182, whereas if it has been detected, the program proceeds to a step S180, wherein a PBTHFS table is retrieved to determine a STR stoppage reference value PBTHFS. The PBTHFS table is set, e.g. as shown in FIG. 29, such that the PBTHFS value decreases as the engine rotational speed NE increases. Then, the PBTHFS value read from the PBTHFS table is set as a low load reference value PBLOW at a step S181, followed by the program proceeding to the step S182.

At the step S182, it is determined whether or not the intake pipe absolute pressure PBA is lower than the low load reference value PBLOW. If PBA<PBALOW holds, the program proceeds to the step S186, followed by terminating the program, whereas if PBA≧PBLOW holds at the step S182, the program proceeds to a step S183.

The low load reference value PBLOW is set to a predetermined value when the throttle valve opening sensor is normally functioning, and replaced by the STR stoppage reference value PBTHFS determined according to the engine rotational speed NE only when abnormality of the throttle valve opening sensor has been detected. When the throttle valve opening sensor 4 is abnormal, idling of the engine cannot be accurately determined from the throttle valve opening θTH (the answer to the question of the step S178 can be always negative (NO) when the throttle valve opening sensor 4 is abnormal). To eliminate this inconvenience, the idling of the engine is determined with reference to the intake pipe absolute pressure PBA on such an occasion.

When abnormality of the throttle valve opening sensor 4 has been detected, both the adaptive control and the PID control may be inhibited (by setting the flag FKLAFRESET to "1"). In such a case, only when no abnormality of the throttle valve opening sensor 4 is detected, the present program is executed at the step S9 of the FIG. 4 main routine.

At the step S183, it is determined whether or not the actual equivalent ratio KACT is smaller than a predetermined value a. If the former is equal to or larger than the latter, it is determined at a step S184 whether or not the actual equivalent ratio KACT is larger than a predetermined value b (>a). If either the answer to the question of the step S183 or the answer to the question of the step S184 is affirmative (YES), the program proceeds to the step S186, whereas if both the answers to the questions of the steps S183 and S184 are negative (NO), the program proceeds to a step S185, wherein it is determined that the engine is operating in the high-response F/B region (adaptive control region i.e. STR control region), followed by terminating the program.

The reason why it is thus determined by the steps S172 to S184 that the feedback correction coefficient KFB should be calculated by the low-response feedback control (PID control) is as follows: When the engine coolant temperature TW is low (TW<TWSTRON), the engine combustion is not stable, so that a misfire can occur. Therefore, a stable value of the detected equivalent ratio KACT cannot be obtained if the adaptive control is carried out on such an occasion. Also when the engine coolant temperature TW is extremely high, the feedback correction coefficient KFB is calculated by the PID control for a similar reason to the above. When the engine rotational speed NE is high, i.e. if NE≧NESTRLMT holds, the ECU 5 can have an insufficient calculation time and further the engine combustion is not stable. When the high-speed valve timing is selected, an overlap time period over which the intake valves and the exhaust valves are both open is prolonged so that blowing of the mixture through the open exhaust valves without being burned within the combustion chamber can occur, and accordingly a stable value of the detected equivalent ratio KACT cannot be obtained if the adaptive control is carried out. Further, when the engine is idling, the engine operating condition is almost stable, and therefore the adaptive control, which is a high gain control, is not required.

Further, if the detected equivalent ratio KACT is smaller than the predetermined value a or larger than the predetermined value b, which means that the air-fuel ratio of the mixture supplied to the engine is lean or rich, and therefore the high-gain adaptive control should not be executed. The determinations at the steps S183 and S184 may employ the desired equivalent ratio KCMD instead of the detected equivalent ratio KACT Referring again to FIG. 27, at a step S157, it is determined whether or not the feedback correction coefficient KFB should be calculated by the adaptive control (STR control), according to the result of the determination by the FIG. 28 subroutine. If the answer to the question of the step S157 is negative (NO), the program proceeds to the step S411, whereas if the answer to the question of the step S157 is affirmative (YES), the program proceeds to a step S158, wherein it is determined whether or not the STR flag FKSTR assumed "0" in the last loop.

If FKSTR=1 held in the last loop, the program jumps to the step S408, whereas if FKSTR=0 held in the last loop, it is determined at steps S159 and S160 whether or not the detected equivalent ratio KACT falls within a range between a predetermined upper limit value KACTLMTH (e.g. 1.01) and a predetermined lower limit value KACTLMTL (e.g. 0.99). If KACT<KACTLMTL or KACT>KACTLMTH holds, the program proceeds to the step S411, wherein the PID correction coefficient KLAF is calculated. On the other hand, if KACTLMTL≦KACT≦KACTLMTH holds, the program proceeds to the step S408.

According to the FIG. 28 subroutine described above, when abnormality of sensors and the like is detected at the steps S172 to S174, and steps S179 to S181, the feedback correction coefficient KFB is set to the PID correction coefficient KLAF, whereby when such abnormality is detected, the PID control which is slower in response speed than the adaptive control is executed to minimize degradation of the exhaust emission characteristics and driveability of the engine.

In this embodiment as well, the detection of abnormality of the sensors is carried out in the same manner as described hereinbefore with respect to the first to third embodiments.

The LAF sensor output deviation with respect to the stoichiometric air-fuel ratio is determined (at the step S125 in FIG. 26) e.g. in the following manner: When the output from the 02 sensor 18 is at a low level, the desired air-fuel ratio KCMD is progressively increased, while when the output from the 02 sensor 18 is at a high level, the desired air-fuel ratio KCMD is progressively decreased. This air-fuel ratio control is continued over a predetermined time period, and an average value of values of the equivalent air-fuel ratio KACT detected when the output from the 02 sensor has been inverted with respect to the stoichiometric air-fuel ratio is calculated (the number of KACT values obtained when the 02 sensor output is inverted from the low level to the high level is required to be equal to the number of KACT values obtained when the 02 sensor output is inverted in the opposite direction.) Then, it is determined that the output from the LAF sensor corresponding to the stoichiometric air-fuel ratio deviates from the proper value when the average value KACTAV falls outside a range defined by predetermined upper and lower limit values (e.g. 1.0±0.5)

The deterioration of the response characteristic of the LAF sensor 17 and abnormality of the valve timing are also determined in the same manners as described hereinbefore with respect to the first to third embodiments.

Figure 30:
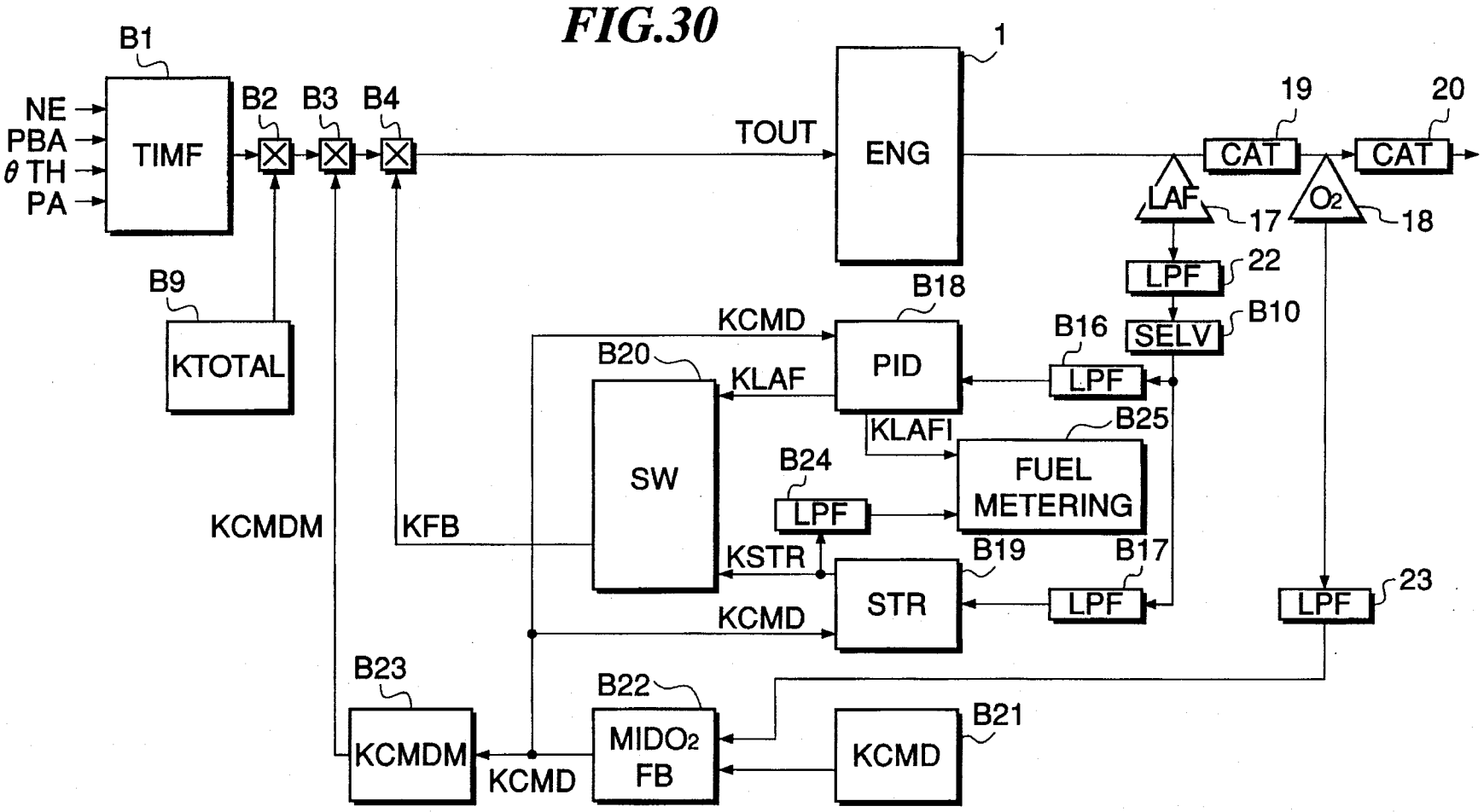
FIG. 30 shows a block diagram useful in explaining functions of a control system according to a fifth embodiment of the invention and a manner of controlling the air-fuel ratio of a mixture supplied to the engine.

Next, description will be made of a fifth embodiment of the invention. The present embodiment has additional functions designated by blocks B24 and B25 as shown in FIG. 30, as compared with the functions shown in FIG. 3 of the first to fourth embodiments.

The block B25 is a fuel metering block to which are supplied an output KSTRLO from a low-pass filter designated by B24, i.e. a filtered value of the adaptive correction coefficient KSTR, and the integral term KLAFI of the PID control from the PID block B18.

The remaining component parts and elements of the present embodiment are identical with those of the first to fourth embodiments described above, and description thereof is omitted.

As to program routines as well, only parts of the program routines which are different from those executed by the preceding embodiments will be described.

In the fifth embodiment, the correction coefficient KFB is calculated by executing the FIG. 27 subroutine employed in the fourth embodiment. However, the discrimination of the feedback region at the step S156 is executed by a subroutine shown in FIG. 31, which is similar to the FIG. 28 subroutine of the fourth embodiment, and corresponding steps are designated by identical step numbers.

Figure 31:
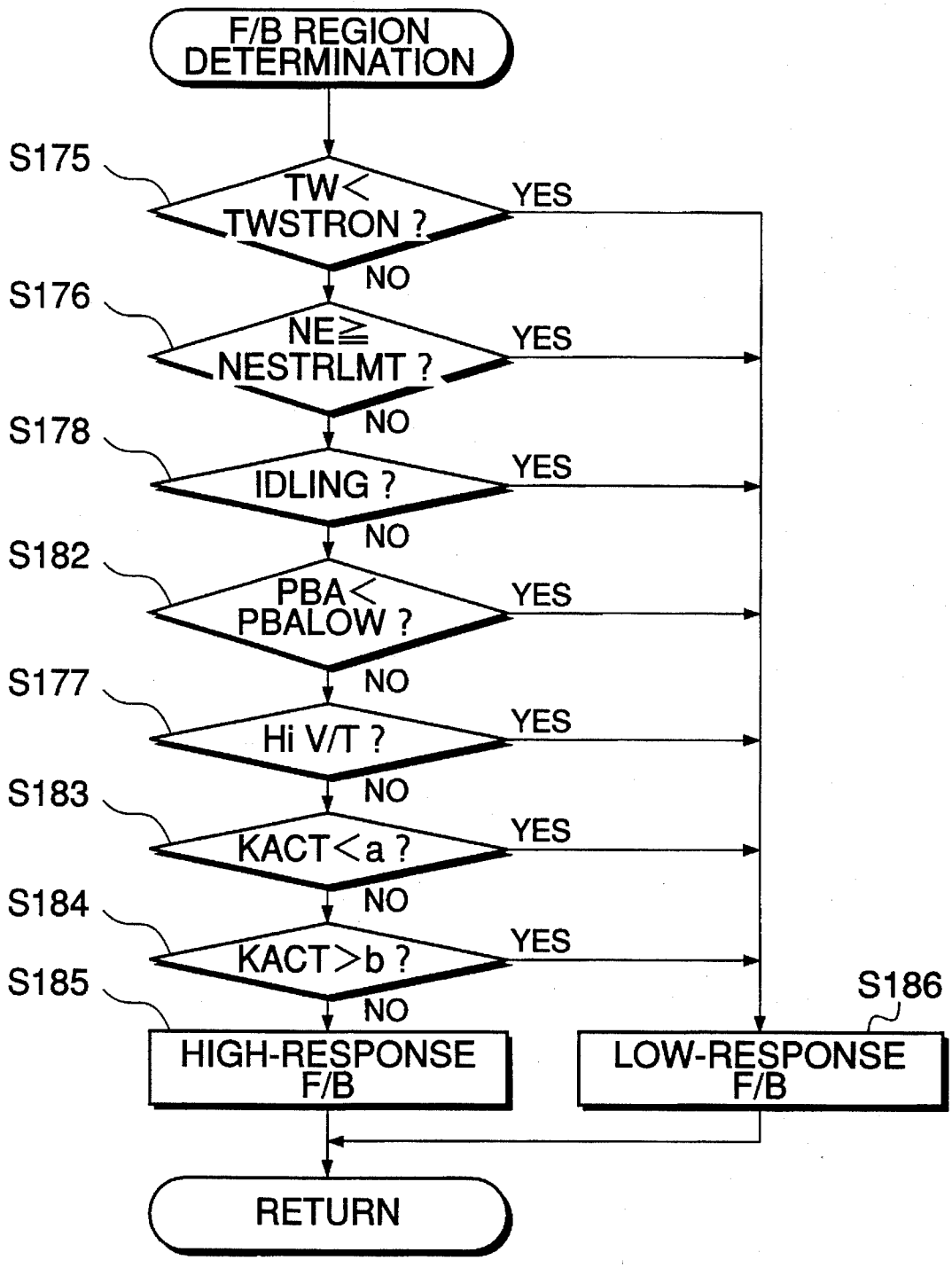
FIG. 31 is a flowchart showing a subroutine for determining whether the engine is operating in a STR feedback control region or a PID feedback control region, which is executed by the control system according to the fifth embodiment at the step S156 in FIG. 27.

Referring to FIG. 31, first, it is determined at the step S175 whether or not the engine coolant temperature is lower than the predetermined value TWSTRON. If TW<TWSTRON holds, it is determined at the step S176 whether or not the engine rotational speed NE is equal to or higher than the predetermined value NESTRLMT. If NE<NESTRLMT holds, it is determined at the step S178 whether or not the engine is idling. If the engine is not idling, it is determined at the step S182 whether or not the intake pipe absolute pressure PBA is lower than the low load reference value PBLOW. If PBA<PBALOW holds, the program proceeds to the step S177, wherein it is determined whether or not the present valve timing is the high-speed valve timing. If the present valve timing is not the high-speed valve timing, it is determined at the step S183 whether or not the actual equivalent ratio KACT is smaller than the predetermined value a. If the former is equal to or larger than the latter, it is determined at the step S184 whether or not the actual equivalent ratio KACT is larger than the predetermined value b (>a).

If any of the answers to the questions of the above steps S175 to S185 is affirmative (YES), the program proceeds to the step S186, wherein it is determined that the engine is in the low-response F/B (PID control) region, followed by terminating the program.

If all the answers to the questions of the above steps S175 to S185 are negative (NO), the program proceeds to the step S185, wherein it is determined that the engine is in the high-response F/B/adaptive control) region, followed by terminating the program.

Figure 32:
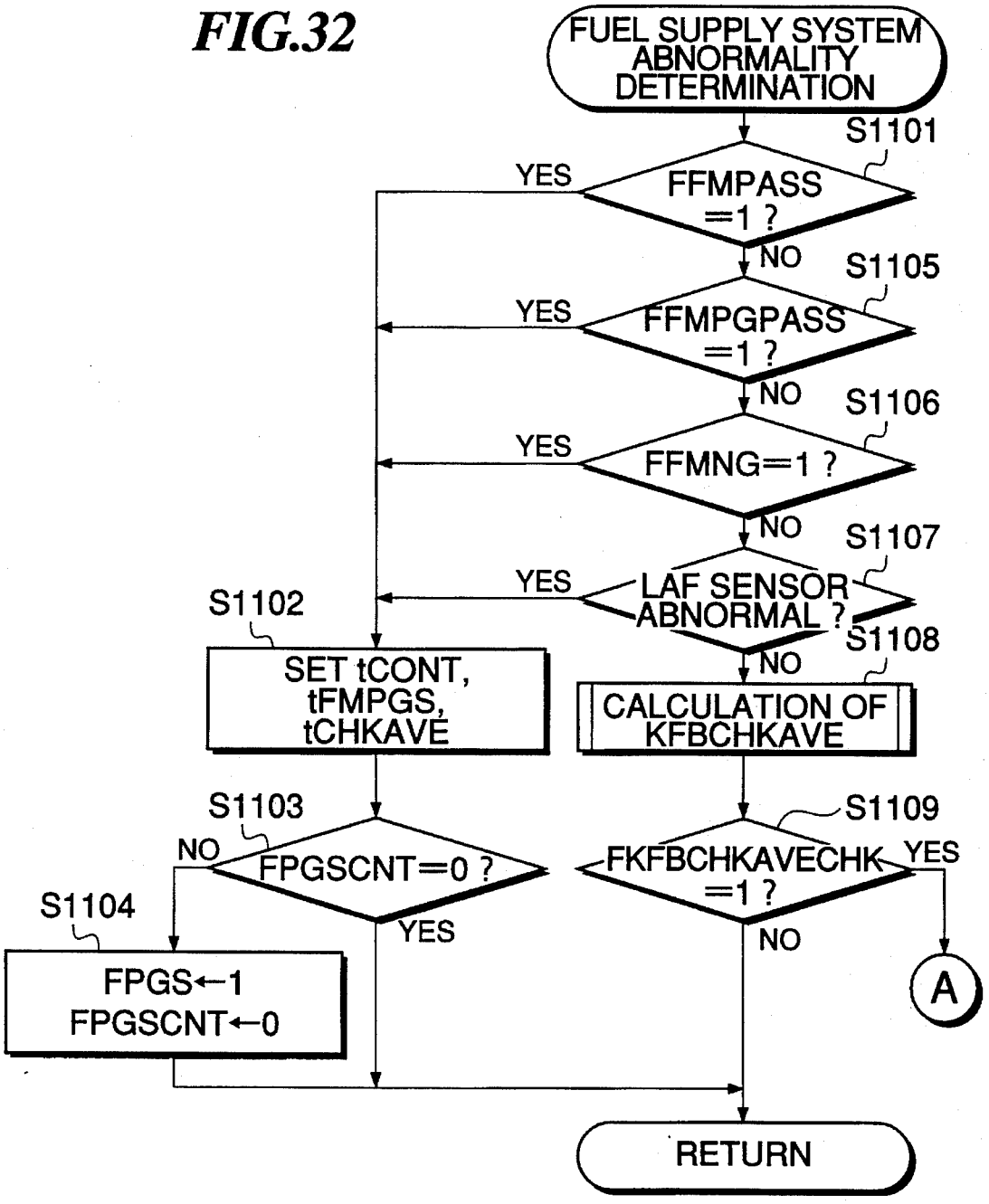
FIG. 32 is a flowchart showing a routine for detecting abnormality of a fuel supply system of the engine.
Figure 33:
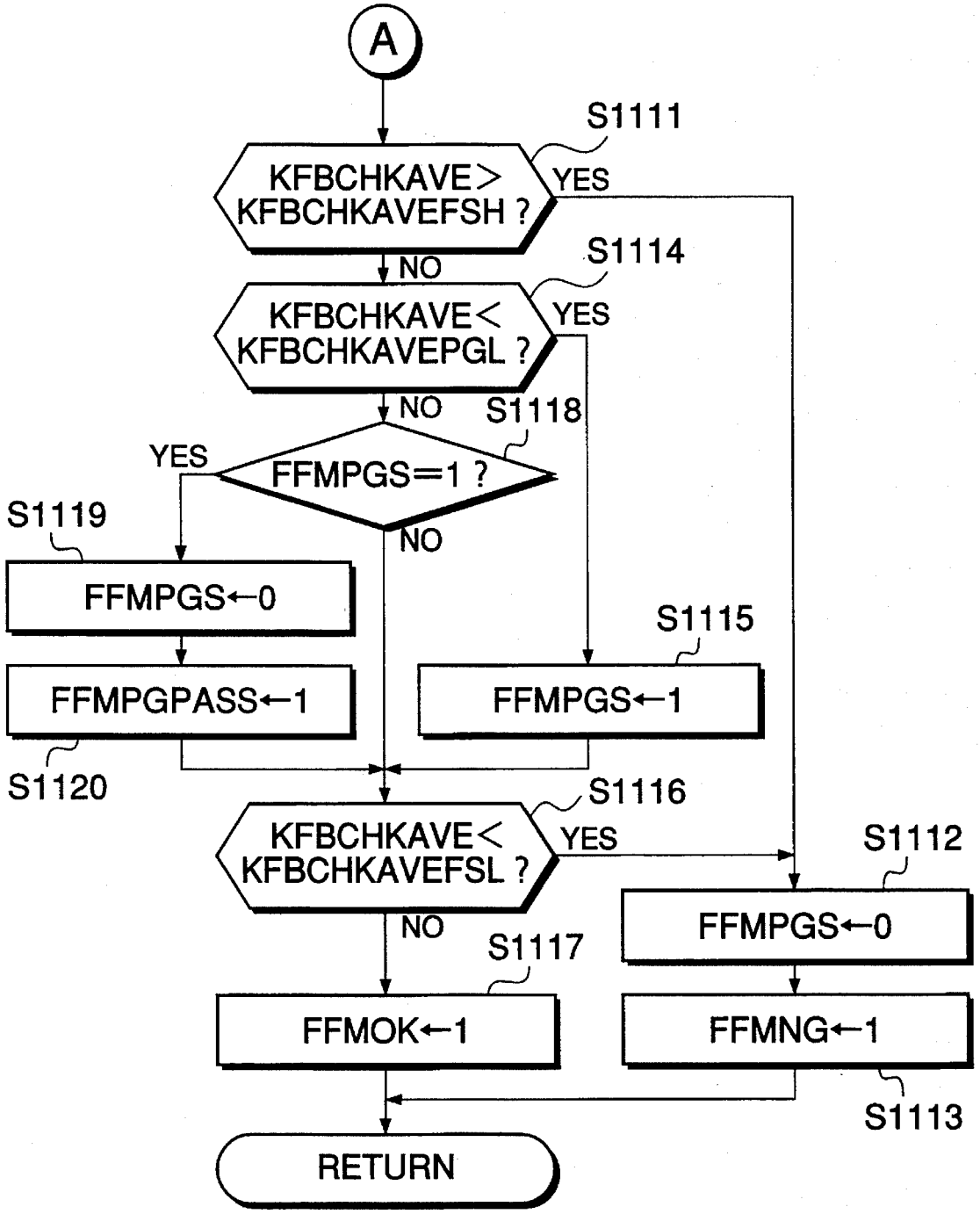
FIG. 33 is a continued part of FIG. 32 flow.

FIGS. 32 and 33 show a routine for detecting abnormality of a fuel supply system of the engine to which the present invention is applied, which is executed by background processing by the ECU 5.

Referring first to FIG. 32, it is determined whether or not a flag FFMPASS which, when set to "0", indicates that checking or monitoring of the fuel supply system for abnormality should be executed, assumes "1". If,the flag FFMPASS assumes "1", i.e. so long as an instruction for monitoring of the fuel supply system for abnormality is not issued, the program proceeds to a step S1102. At the step S1102, a monitoring condition continuation timer tCONT for setting a time period over which the monitoring conditions should continue to be fulfilled, an after-purge cut-stabilizing timer FFMPGS for setting a time period over which the air-fuel ratio should be stabilized after purge cut, i.e. interruption of purging of evaporative fuel cut, and a KAV-calculating timer tCHKAVE for setting a time period over which an averaged coefficient value KAY of the air-fuel ratio feedback correction coefficient KFB should be calculated are set to respective predetermined values, and started. These timers are each formed by a downcount timer.

Then, at a step S1103, it is determined whether or not a flag FPGSCNT, which, when set to "1", indicates that purge cut should be carried out for checking the fuel supply system for abnormality, assumes "0". The flag FPGSCNT is used in calculating an abnormality-determining value KFBCHKAVE, referred to hereinafter, to execute purge cut when an instruction for carrying out purge cut is issued to eliminate a possibility of an erroneous detection due to the influence of purging of evaporative fuel into the intake pipe. (This flag is set to "1" at a step S1220, referred to hereinafter.)

If the answer to the question of the step S1103 is affirmative (YES), i.e. if the flag FPGSCNT assumes "0", which means that the purge cut is not being executed, the present program is immediately terminated, whereas if the answer is negative (NO), i.e. if the flag FPGSNCT assumes "1", a flag FPGS, which, when set to "1", indicates that purge control, i.e. control of purging of evaporative fuel should be carried out, is set to "1", and the flag FPGSCNT is set to "0" to permit purging of evaporative fuel again, at a step S1104, followed by terminating the program.

On the other hand, if the flag FFMPASS assumes "0" at the step S1101, i.e. if the instruction for monitoring the fuel supply system for abnormality has been issued, determinations at steps S1105 to S1107 are sequentially carried out. That is, at the step S1105, it is determined whether or not a flag FFMPGPASS, which, when set to "1", indicates that the monitoring of the fuel supply system should be inhibited to eliminate a possibility of an erroneous detection due to the influence of purging of evaporative fuel, assumes "1". The flag FFMPGPASS is set to "1" at a step S1120.

At the step S1106, it is determined whether or not a flag FFMNG, which, when set to "1", indicates that the fuel supply system is abnormal, assumes "1". The flag FFMNG is set to "1" at a step S1113, referred to hereinafter, when abnormality of the fuel supply system is finally determined.

At the step S1107, it is determined whether or not the LAF sensor 17 is abnormal. This is because the present monitoring or checking of the fuel supply system is carried out based on the output from the LAF sensor 17.

If any of the answers to the questions of these steps is affirmative (YES), i.e. if FFMPGASS=1 or FFMNG=1 holds, or the LAF sensor is abnormal, the monitoring of the fuel supply system for abnormality is inhibited, and the steps S1102 to S1104 are executed as described above.

If all the answers to the questions of the steps S1105 to S1107 are negative (NO), i.e. if FFMPGASS=0 and FFMNG=0 hold, and the LAF sensor is normal, it is judged that the monitoring of the fuel supply system for abnormality should be executed, and the program proceeds to a step S1108, wherein the abnormality-determining value KFBCHKAVE is calculated by executing a subroutine, described in detail hereinafter.

After calculation of the abnormality-determining value KFBCHKACVE at the step S1108, the program proceeds to a step S1109, wherein it is determined whether or not a flag FKFBCHKAVECHK, which, when set to "1", indicates that the abnormality-determining value KFBCHKACVE has been calculated, assumes "1". If the answer to this question is negative (NO), i.e. if the abnormality-determining value KFBCHACVE has not been calculated, the present program is terminated. If the answer to the question of the step S1109 is affirmative (YES), i.e. if the abnormality-determining value KFBCHKACVE has been calculated, the program proceeds to a step S1111 in FIG. 33, wherein it is determined whether or not the calculated KFBCHKAVE value is larger than a predetermined upper limit value KFBCHKAVEFSH.

If the answer to the question of the step S1111 is affirmative (YES), i.e. if the calculated KFBCHKAVE value is larger than the predetermined upper limit value KFBCHKAVEFSH, it is judged that the fuel supply system is abnormal, and then the program proceeds to a step S1112, wherein a flag FFMPGS, which, when set to "1", indicates that purge cut should be carried out, is set to "0", and at the following step S1113, the flag FFMNG is set to "1", followed by terminating the program.

Figure 38:
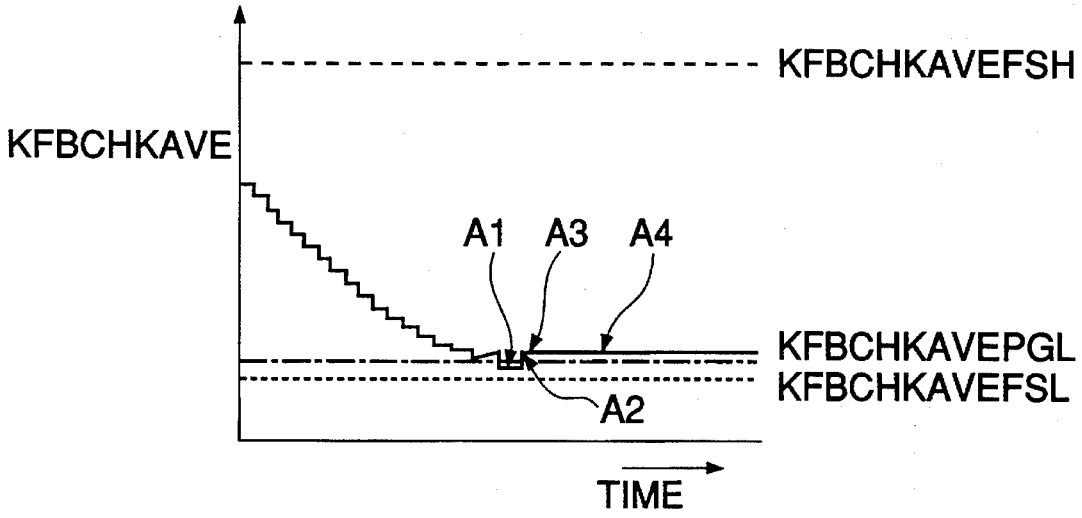
FIG. 38 is a graph showing changes in the abnormality-determining value KFBCHKAVE.

On the other hand, if the answer to the question of the step S1111 is negative (NO), the program proceeds to a step S1114, wherein it is determined whether or not the present KFBCHKAVE value is smaller than a reference value KFBCHKAVEPGL for determining whether or not there is a possibility of an erroneous detection due to the influence of purging. The reference value KFBCHKAVEPGL is set, as shown in FIG. 38, such that it is slightly larger than a predetermined lower limit value KFBCHKAVEFSL. This is because if the reference value KFBCHIVEPGL and the predetermined lower limit value KFBCHKFSL are equal to each other, the fuel supply system can be determined to be abnormal before a change in the KFBCHKAVE value appears, when purge cut is executed as described hereinafter.

If the answer to the question of the step S1114 is affirmative (YES), i.e. if the present KFBCHKAVE value is smaller than the reference value KFBCHKAVEPGL (see A1 in FIG. 38), it is judged that there is a possibility of erroneous detection due to purging of evaporative fuel, so that the program proceeds to a step S1115, wherein the flag FFMPGS is set to "1" to carry out purge cut in the monitoring operation in the following loops. (The purge cut is effected at steps S1219 and S1220, described hereinafter.) Thus, the purge cut is carried out only when the abnormality-determining value KFBCHKAVE becomes smaller than the reference value KFBCHKAVEPGL, whereby it is possible not only to prevent an erroneous abnormality detection due to the influence of purging of evaporative fuel in an accurate manner but also to prevent purge cut from being unnecessarily carried out. This dispenses with the need of frequent changeover between purge cut and purging of evaporative fuel, thereby preventing degradation of the driveability of the engine.

Then, the program proceeds to a step S1116, wherein it is determined whether or not the KFBCHKAVE value is smaller than the lower limit value KFBCHKAVEFSL. If KFBCHKAVE<KFBSCHKAVEFSL holds, it is determined that the fuel supply system is abnormal, and then the steps S1112 and S1113 are executed, followed by terminating the program. If KFBCHKAVE≧KFBSCHKAVEFSL holds at the step S1116, it is judged that the fuel supply system is normal, and then a flag FFMOK is set to "1" to indicate that the fuel supply system is normal, followed by terminating the program.

On the other hand, if KFBCHKAVE≧KFBCHKAVEPGL holds at the step S1114 (purge cut effected in the immediately preceding loop increases the KFBCHKAVE value; see A2 in FIG. 38), the program proceeds to a step S1118, wherein it is determined whether or not the instruction for purge cut was issued (at the step S1115) in the immediately preceding loop. If purge cut was instructed in the immediately preceding loop, i.e. if the flag FFMPGS assumes "1", the flag FFMPGS is set to "0" at a step S1119, thereby inhibiting the purge cut (see A3 in FIG. 38).

When it is judged that it is impossible to accurately check or monitor the fuel supply system for abnormality, due to the influence of purging, the flag FFMPGPASS is set to "1" at the following step S1120 to issue the instruction for inhibiting the checking of the fuel supply system (see A4 in FIG. 38), followed by the program proceeding to the step S1116.

Next, a manner of calculating the abnormality-determining value KFBCHKAVE at the step S1108 will be described with reference to FIGS. 34 to 37.

Figure 34:
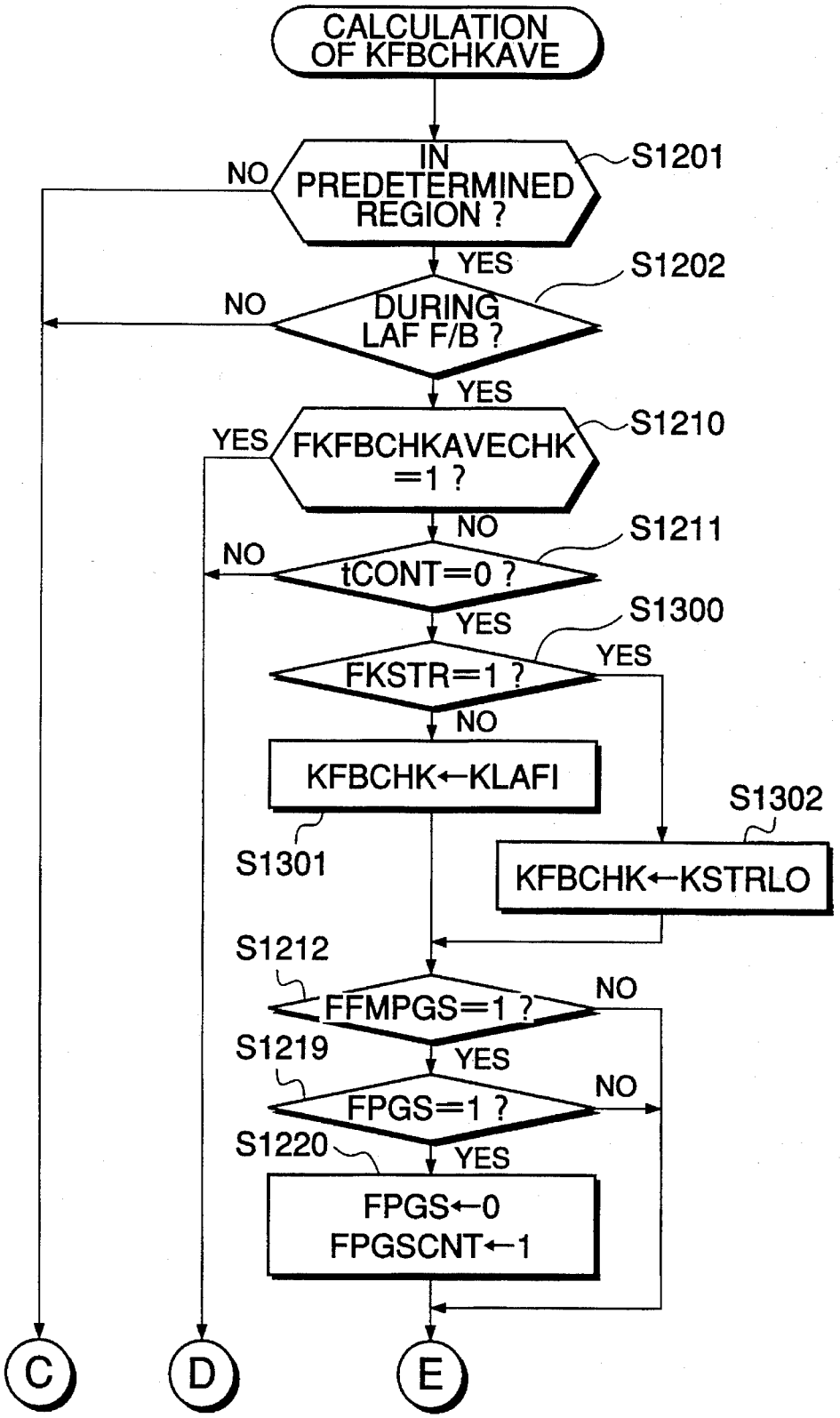
FIG. 34 is a flowchart showing a subroutine for calculating an abnormality-determining value KFBCHKAVE, which is executed at a step S1108 in FIG. 33.
Figure 35:
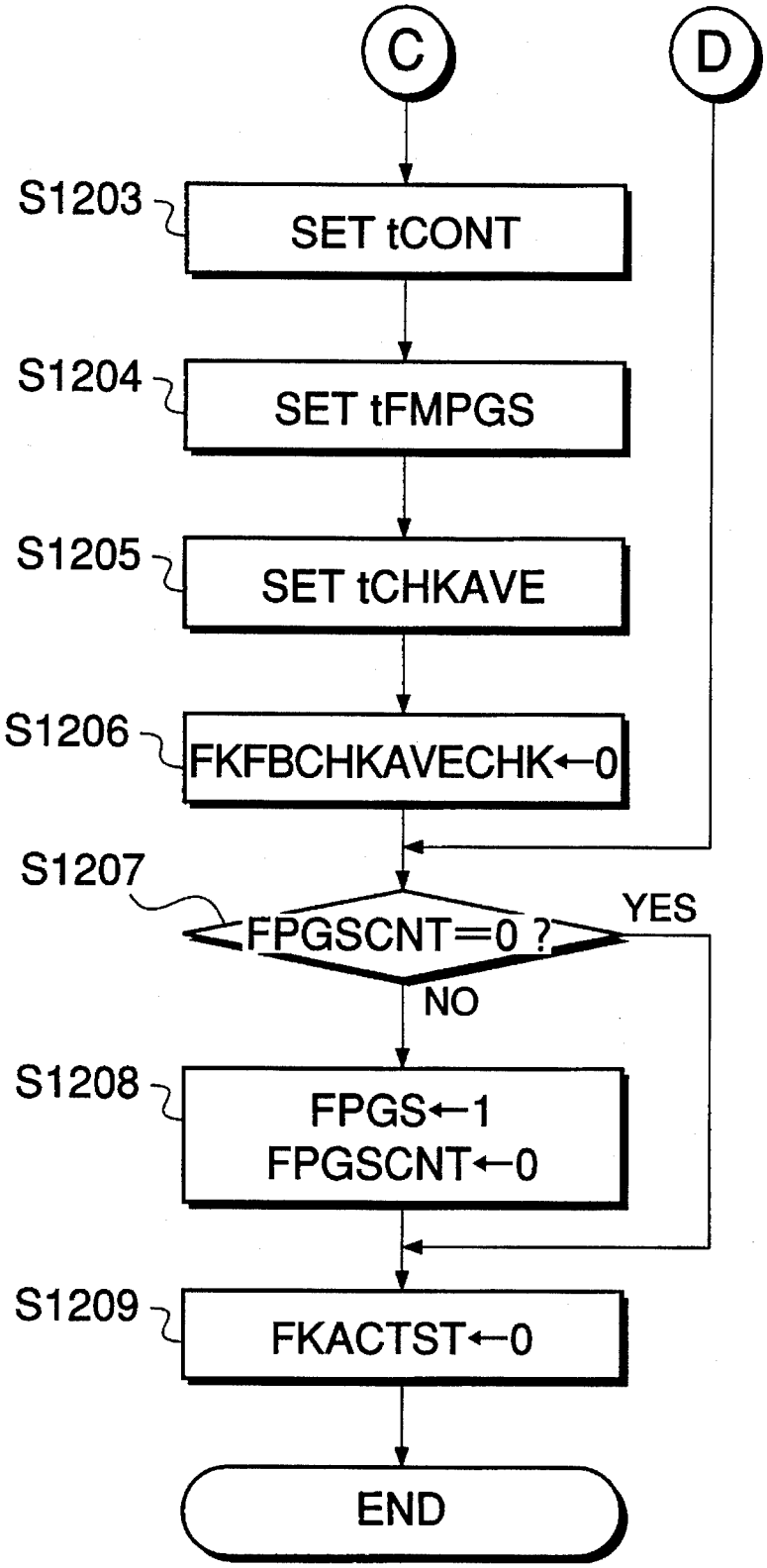
FIG. 35 is a continued part of FIG. 34 flow.

Referring to FIG. 34, first at a step S1201, it is determined whether or not the engine is operating in a predetermined region. That is, the engine is determined to be in the predetermined region when the engine rotational speed NE is within a range defined by a lower limit value NAVEL (e.g. 1504 rpm) and an upper limit value NAVEH (e.g. 2496 rpm) [these limit values may be set to different values between an AT (automatic transmission) vehicle and an MT (manual transmission) vehicle], the intake pipe absolute pressure PBA is within a range defined by a lower limit value PBAVEL (e.g. 263 mmHg) and an upper limit value PBSVEH (e.g. 435 mmHg) [these limit values may be also set to different values between the AT vehicle and the MT vehicle], the intake air temperature TA is within a range defined by a lower limit value TAAVEL (e.g. 20° C.) and an upper limit value TAAVEH (e.g. 70° C.), the engine coolant temperature TW is within a range defined by a lower limit value TWAVEL (e.g. 70° C.) and an upper limit value TWAVEH (e.g. 90° C.), the vehicle speed V is within a range defined by a lower limit value VAVEL and an upper limit value VAVEH, and the throttle valve opening θTH is within a range defined by a lower limit value θTHAVEL and an upper limit value θTHAVEH.

If the answer to the question of the step S1201 is affirmative (YES), i.e. if the engine is in the predetermined region, the program proceeds to a step S1202, wherein it is determined whether or not the air-fuel ratio feedback control is being executed. If either the answer to the question of the step S1201 or the answer to the question of the step S1202 is negative (NO), i.e. if the engine is not in the predetermined region, or if the air-fuel ratio feedback control is not being executed, the calculation of the abnormality-determining value KFBCHKAVE is not carried out since the correction coefficient KFB based on the output from the LAF sensor 17 is not calculated, but steps S1203 to S1209 are executed, followed by terminating the program.

That is, at the steps S1203 to S1205, the monitoring condition continuation timer tCONT, the after-purge cut-stabilizing timer tFMPGS and the KAV-calculating timer tCHKAVE are set to the respective predetermined values and started.

Further, at a step S1206, the flag FKFBCHKAVECHK is set to "0", and at the following step S1207, it is determined whether or not the flag FPGSCNT assumes "0". If the flag FPGSCNT does not assume "0", the program proceeds to a step S1208, wherein the flag FPGS is set to "1" and at the same time the flag FPGSCNT is reset to "0", and at the following step S1209, a flag FKACTST is set to "0", followed by terminating the program. The flag FKACTST is set to "1" when the relationship in magnitude between the actual equivalent ratio KACT and the desired equivalent ratio KCMD is inverted (hereinafter simply referred to as "the inversion of the KACT value") at a step S1217, referred to hereinafter. On the other hand, if the answer to the step S1207 is affirmative (YES), i.e. if the flag FPGSCNT assumes "0", the program skips over the step S1208 to the step S1209, followed by terminating the program.

Referring again to FIG. 34, when both the answer to the question of the step S1201 and the answer to the question of the step S1202 are affirmative (YES), i.e. if the engine is in the predetermined region, and at the same time the air-fuel ratio feedback control is being executed, the program proceeds to a step S1210, wherein it is determined whether or not the flag FKFBCHKAVECHK assumes "1". If FKFBCHKAVECHK assumes "0", which means that the abnormality-determining value KFBCHKACVE has not been calculated, the program proceeds to a step S1211, wherein it is determined whether or not the count of the timer tCONT is equal to "0".

If the answer to the question of the step S1210 is affirmative (YES), i.e. if the flag FKFBCHKAVECHK assumes "1" which means that the KFVCHKAVE value has been calculated, or if it is determined at the step S1211 that the count of the timer tCONT is not equal to "0", the steps S1207 to S1209 are executed followed by terminating the program.

If the answer to the question of the step S1211 is affirmative (YES), i.e. if the count of the timer tCONT is equal to "0", which means that the air-fuel ratio feedback control in the predetermined region of the engine has continued over the predetermined time period, the conditions for monitoring the fuel supply system for abnormality are fulfilled, and then the program proceeds to a step S1300 et seq., to calculate the abnormality-determining value KFBCHKAVE.

First, at the step S1300, it is determined whether or not the flag FKSTR set at the step S604 in FIG. 20 or the step S624 in FIG. 21 assumes "1". If the flag FKSTR does not assume "1", an abnormality-determining parameter KFBCHK for use in calculating the averaged coefficient value KAV is set to the integral term KLAFI of the PID control at a step S1301, whereas if the flag FKSTR assumes "1", the abnormality-determining parameter KFBCHK is set to the filter output value KSTRLO of the adaptive control correction coefficient KSTR of the STR control at a step S1302, followed by the program proceeding to a step S1212. The filter output value KSTRLO is obtained by causing the adaptive control correction coefficient KSTR to pass through the low-pass filter block B24 to thereby smooth the value through a so-called first-order delay process. In the STR control which is very high in control responsiveness, the correction coefficient KSTR changes at a high speed and with large amplitude. Therefore, by using the low-pass filter output value KSTRLO, it is possible to suppress an undesired variation in the averaged coefficient value KAV, and thereby obtain a proper value of the abnormality-determining value KFBCHKAVE. This makes it possible to detect abnormality of the fuel supply system with accuracy.

Further, at the step S1212, it is determined whether or not the flag FFMPGS assumes "1". When this step is first carried out, the flag FFMPGS assumes "0", which means that the purge cut has not been instructed, so that the program proceeds to a step S1213 in FIG. 36.

Figure 36:
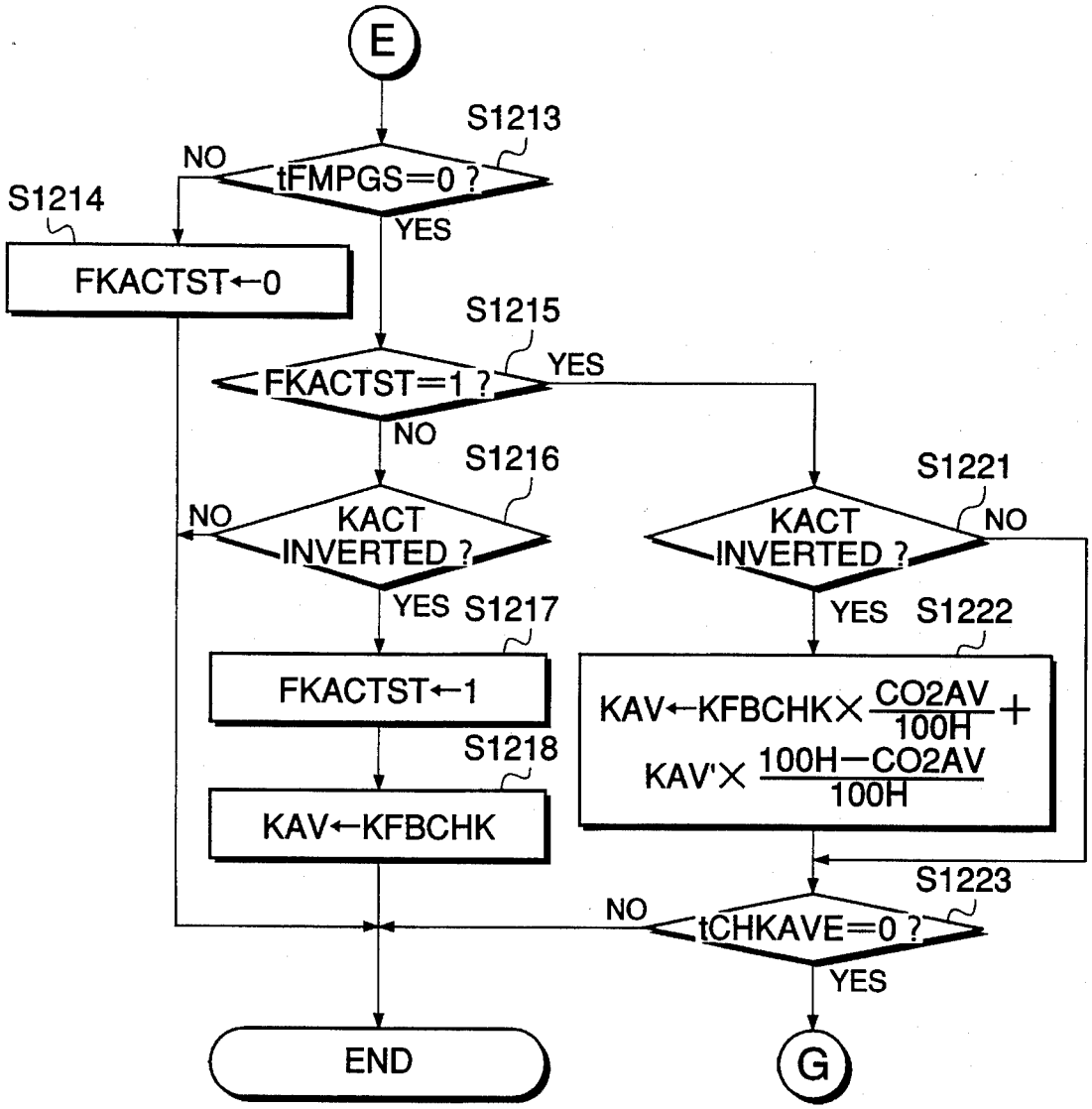
FIG. 36 is a continued part of FIG. 34 flow.
Figure 37:
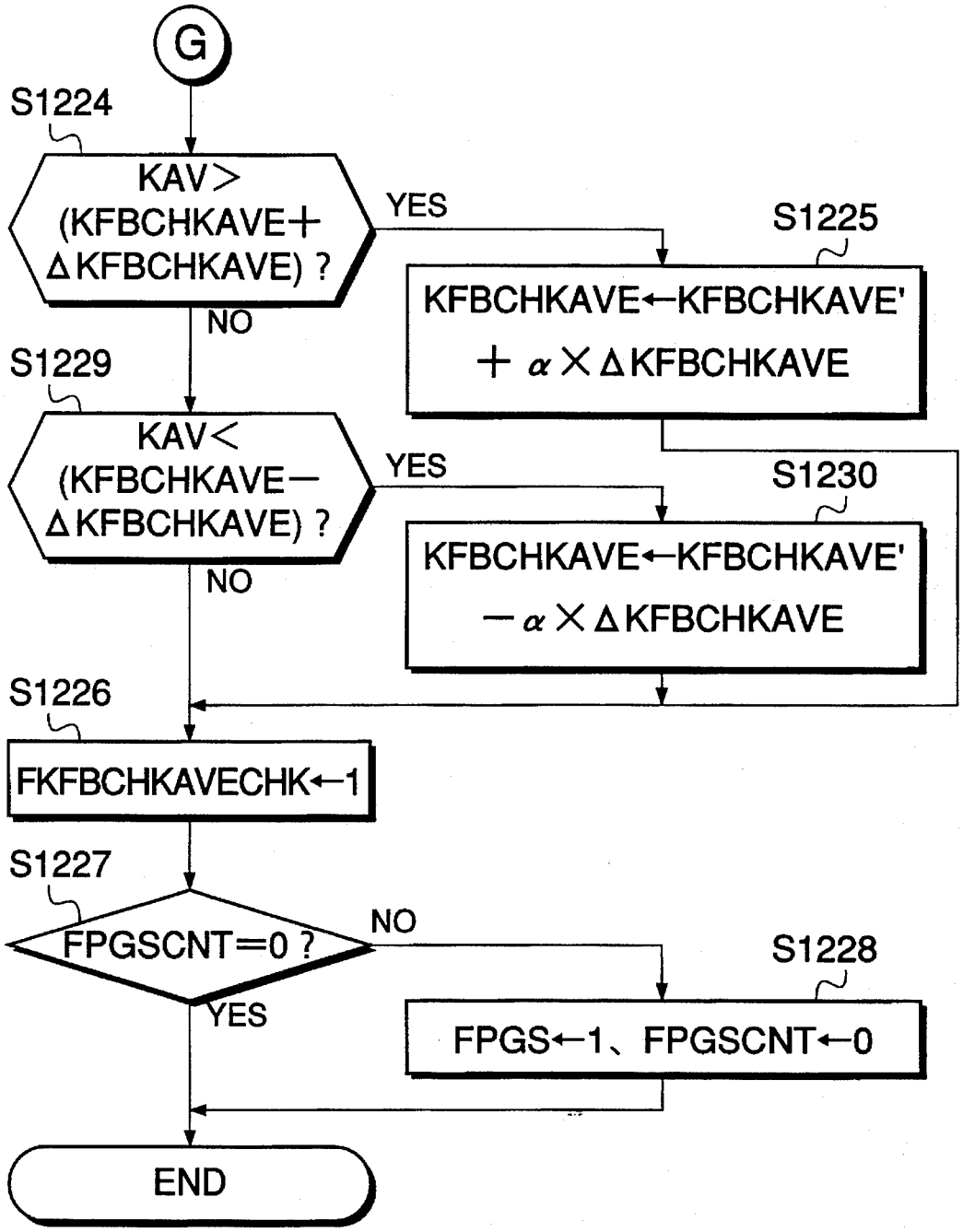
FIG. 37 is a continued part of FIG. 34 flow.

Referring to FIG. 36, at the step S1213, it is determined whether or not the count of the timer tFMPGS is equal to "0". If the count of the timer tFMPGS set at the step S1204 is not equal to "0", it is judged that the predetermined time period has not elapsed after starting of purge cut, and then the program proceeds to a step S1214, wherein the flag FKACTST is set to "0", followed by terminating the program.

If the answer to the question of the step S1213 is affirmative (YES), i.e. if the count of the timer FMPGS is equal to "0", which means that the predetermined time period has elapsed after starting of purge cut, the program proceeds to a step S1215, wherein it is determined whether or not the flag FKACTST assumes "1". When this step is first executed, the flag FKACTST assumes "0", which means that the inversion of the KACT value has not been detected yet, the program proceeds to a step S1216, wherein it is determined whether or not the inversion of the KACT value has occurred. If the inversion of the KACT value has not occurred, the present program is terminated, whereas if the inversion of the KACT value has occurred, the flag FKACTST is set to "1" at the step S1217, and the present KFBSCHK value is set to an initial value of the averaged coefficient value KAV at a step S1218, followed by terminating the program.

Referring again to FIG. 34, when the step S1212 is executed in a subsequent loop, and the answer to the question of the steps S1212 becomes affirmative (YES), i.e. if the flag FFMPGS assumes "1", which means that purge cut has been instructed to eliminate a possibility of an erroneous detection due to the influence of purging of evaporative fuel, the program proceeds to a step S1219, wherein it is determined whether or not the flag FPGS assumes "1". If the answer to this question is affirmative (YES), i.e. if the flag FPGS assumes "1", which means that purge cut is not being executed in spite of the instruction of purge cut, the program proceeds to a step S1220.

At the step S1220, the flag FPGS is set to "0" to inhibit control of purging of evaporative fuel, and at the same time the flag FPGSCNT is set to "1" to execute purge cut, followed by the program proceeding to the step S1213 in FIG. 36. Further, if the purge cut is being carried out at the step S1219 according to the instruction of purge cut, the program jumps to the step S1213. If the predetermined time period has elapsed after starting of purge cut at the step S1213, the program proceeds to the step S1215.

If the flag FKACTST assumes "1" at the step S1215, the program proceeds to a step S1221, wherein it is again determined whether or not the inversion of the KACT value has occurred. If the answer to this question is affirmative (YES), i.e. if the inversion of the KACT value has occurred, the averaged coefficient value KAV as a learned average value of the abnormality-determining parameter KFBCHK is calculated at a step S1222 by the use of the following equation (19):

$$KAV=KFBCHK\times(CO2AV/100H)+KAV'\times[(100-CO2AV)/100H] \quad (19)$$

wherein CO2AV represent a variable which is set to a fairly large value from a range of 1 to 100H so as to enable the control system to quickly follow up a change in the abnormality-determining parameter KFBCHK in the predetermined region of the engine. KAV' represents the immediately preceding value of the averaged coefficient value KAV, which is initially set to the last value of the KFBCHKAVE value calculated and stored when the engine was operating in the predetermined region on the last occasion, and to an initial value of the coefficient KFBCHKAVE when the engine enters the predetermined region for the first time after the start of the engine.

On the other hand, if the answer to the question of the step S1221 is negative (NO), i.e. if the inversion of the KACT value has not occurred, the program skips over the step S1222, so that the averaged coefficient value KAV is held at the immediately preceding value thereof.

At the following step S1223, it is determined whether or not the count of the timer tCHKAVE is equal to "0". If the count of the timer tCHKAVE is not equal to "0", the present subroutine is immediately terminated, whereas if the count of the timer tCHKAVE is equal to "0", which means that the predetermined time period for calculating the KAY value has elapsed, the program proceeds to a step S1224 in FIG. 37.

At the step S1224, it is determined whether or not the averaged coefficient value KAV thus determined is larger than a value obtained by adding an aging-determining difference ΔKFBCHKAVE (e.g. 800H) to the immediately preceding value of the abnormality-determining value KFBCHKAVE. The value KAFCHKAVE is initially set to an average value KREF of the correction coefficient KFB determined by executing another routine. If the answer to the question of the step S1224 is affirmative (YES), the abnormality-determining value KFBCHKACVE is updated by the use of the following equation (20):

$$KFBCHKAVE=KFBCHKAVE'+\alpha\times\Delta KFBCHKAVE \quad (20)$$

where KFBCHKAVE' represents the immediately preceding value of the value KFBCHKAVE, and α on the right side represents a coefficient (≦1.0) which is set e.g. to 0.5 depending on operating conditions of the engine.

Then, at the step S1226, the flag FKFBCHKAVECHK is set to "1", and then the program proceeds to a step S1227, wherein it is determined whether or not the flag FPGSCNT assumes "0". If the answer to this question is affirmative (YES), i.e. if the purge cut has not been carried out to detect abnormality of the fuel supply system, the present subroutine is terminated, whereas if the answer is negative (NO), i.e. if the purge cut has been carried out to detect abnormality of the fuel supply system, the program proceeds to a step S1228.

At the step S1228, the flag FPGS is set to "1", and the flag FPGSCNT is set to "0" to permit purging of evaporative fuel, followed by terminating the program.

If the averaged coefficient value KAV is not larger than the sum of the aging-determining difference ΔKFBCHKAVE and the immediately preceding KFBCHKAVE value at the step S1224, it is determined at a step S1229 whether or not the averaged coefficient value KAV is smaller than a value obtained by subtracting the aging-determining difference ΔKFBCHKAVE from the immediately preceding KFBCHKAVE value. If the answer to this question is affirmative (YES), the abnormality-determining value KFBCHKAVE is updated at a step S1230 by the use of the following equation (21):

$$KFBCHKAVE=KFBCHKAVE'-\alpha\times\Delta KFBCHKAVE \quad (21)$$

Then, the steps S1226, S1227, and S1228 are executed in the manner described above, followed by terminating the program. If the averaged coefficient value KAV is not smaller than the value obtained by subtracting the aging-determining difference ΔKFBCHKAVE from the immediately preceding KFBCHKAVE value, the program skips over the step S1230, followed by the program proceeding to the step S1226.

The operations described above with reference to FIGS. 34 to 37 enable the abnormality-determining value KFBCHKACVE to be properly calculated irrespective of whether or not the air-fuel ratio control is being executed by the PID control or by the STR control, and abnormality of the fuel supply system can be accurately detected by the use of the abnormality-determining value KFBCHKAVE.

Although in the present embodiment described above, during execution of the adaptive control, the KSTRLO value obtained by passing the KSTR value through the low-pass filter is used in calculating the averaged coefficient value KAV (by setting KFBCHK=KSTRLO), this is not limitative, but during execution of the adaptive control, KFBCHK=KSTR may be set and at the same time, the variable CO2AV in the equation (19) may be set to a smaller value than during the PID control, thereby increasing the degree of averaging by the equation (19).

What is claimed is:

1. A control system for an internal combustion engine having an exhaust system, said engine being installed on an automotive vehicle, comprising:

an air-fuel ratio sensor arranged in said exhaust system;

first control means for controlling an amount of fuel to be supplied to said engine in a feedback manner based on an output from said air-fuel ratio sensor by using an adaptive controller of a recurrence formula type, such that an air-fuel ratio of an air-fuel mixture supplied to said engine is converged to a desired air-fuel ratio;

second control means for controlling said amount of said fuel to be supplied to said engine in a feedback manner with a response speed lower than a response speed of said first control means, based on said output from said air-fuel ratio sensor, such that said air-fuel ratio of said air-fuel mixture supplied to said engine is converged to said desired air-fuel ratio;

operating condition-detecting means for detecting operating conditions of at least one of said engine and said vehicle;

unsteady condition-determining means for determining whether or not said engine is in an unsteady operating condition in which combustion of said engine undergoes a variation, based on an output from said operating condition-detecting means; and selecting means for selecting between said first control means and said second control means for controlling said amount of fuel to be supplied to said engine, said selecting means selecting said second control means at least when said unsteady condition-determining means determines that said engine is in said unsteady operating condition.

2. A control system according to claim 1, wherein said adaptive controller of said first control means has a parameter-adjusting mechanism for adjusting adaptive parameters used by said adaptive controller.

3. A control system according to claim 1, wherein said second control means controls said amount of fuel to be supplied to said engine in a feedback manner based on said output from said air-fuel ratio sensor by using an adaptive controller of a recurrence formula type, such that said air-fuel ratio of said air-fuel mixture supplied to said engine is converged to said desired air-fuel ratio, said adaptive controller of said second control means having a parameter-adjusting mechanism for adjusting adaptive parameters used thereby, said parameter-adjusting mechanism of said adaptive controller of said second control means adjusting said adaptive parameters used by said adaptive controller of said second control means at a speed lower than a speed at which said parameter-adjusting mechanism of said adaptive controller of said first control means adjusts said adaptive parameters used by said adaptive controller of said first control means.

4. A control system according to claim 1, wherein said second control means controls said amount of said fuel to be supplied to said engine in said feedback manner by using at least one of a proportional term, a differential term, and an integral term.

5. A control system according to claim 1, wherein said selecting means selects said first control means after a predetermined time period elapses from the time it is determined that said engine enters a steady operating condition in which said combustion of said engine is stable.

6. A control system according to claim 1, wherein said operating condition-detecting means includes means for detecting a decelerating condition of said engine.

7. A control system according to claim 1, wherein said operating condition-detecting means includes means for detecting a temperature of said engine.

8. A control system according to claim 1, wherein said operating condition-detecting means includes means for detecting a retardation of ignition timing of said engine.

9. A control system according to claim 1, wherein said operating condition-detecting means includes means for detecting interruption of fuel supply to said engine.

10. A control system according to claim 1, wherein said engine includes traction control means for controlling an excessive slip of wheels of said vehicle, said operating condition-detecting means including means for detecting operation of said traction control means.

11. A control system according to claim 1, wherein said engine includes engine output characteristic control means for controlling an output characteristic of said engine, said operating condition-detecting means including means for detecting operation of said engine output characteristic control means.

12. A control system according to claim 1, wherein said vehicle has a transmission, said operating condition-detecting means detects shift gear position-changing operation of said transmission.

13. A control system according to claim 1, wherein said operating condition-detecting means includes means for detecting a change in said desired air-fuel ratio of said mixture supplied to said engine.

14. A control system for an internal combustion engine having an exhaust system, comprising:

an air-fuel ratio sensor arranged in said exhaust system;

first control means for controlling an amount of fuel to be supplied to said engine in a feedback manner based on an output from said air-fuel ratio sensor by using a controller of a recurrence formula type, such that an air-fuel ratio of an air-fuel mixture supplied to said engine is converged to a desired air-fuel ratio;

second control means for controlling said amount of said fuel to be supplied to said engine in a feedback manner with a response speed lower than a response speed of said first control means based on said output from said air-fuel ratio sensor, such that said air-fuel ratio of said air-fuel mixture supplied to said engine is converged to said desired air-fuel ratio;

operating condition-detecting means for detecting operating conditions of said engine;

abnormality-detecting means for detecting abnormality of at least one of said engine and said control system, and fail-safe action means for at least inhibiting operation of said first control means in a manner dependent on said abnormality of said at least one of said engine and said control system, when said abnormality of said least one of said engine and said control system is detected.

15. A control system according to claim 14, wherein said controller of said first control means is an adaptive controller which has a parameter-adjusting mechanism for adjusting adaptive parameters used by said adaptive controller.

16. A control system according to claim 14, wherein said second control means controls said amount of fuel to be supplied to said engine in a feedback manner based on said output from said air-fuel ratio sensor by using a controller of a recurrence formula type, such that said air-fuel ratio of said air-fuel mixture supplied to said engine is converged to said desired air-fuel ratio, said controller of said second control means adjusting a gain used by said controller of said second control means at a speed lower than a speed at which said parameter-adjusting mechanism of said controller of said first control means adjusts a gain used by said controller of said first control means.

17. A control system according to claim 14, wherein said second control means controls said amount of said fuel to be supplied to said engine in said feedback manner by using at least one of a proportional term, a differential term, and an integral term.

18. A control system according to claim 14, wherein said engine includes a plurality of cylinders, intake valves and exhaust valves provided for each of said plurality of cylinders, and valve timing-changing means for changing valve timing at which said intake valves and exhaust valves are operated, said abnormality-detecting means detecting abnormality of operation of said valve timing-changing means, said fail-safe action means inhibiting operation of said first control means and causing said second control means to operate, when said abnormality of said operation of said valve timing-changing means is detected.

19. A control system according to claim 14, wherein said engine includes a plurality of cylinders, said operating condition-detecting means including a TDC sensor for detecting a TDC position for each of said plurality of cylinders and a cylinder-discriminating sensor for discriminating each cylinder from other ones, said fail-safe action means inhibiting operation of said first control means and causing said second control means to operate, when abnormality of operation of at least one of said TDC sensor and said cylinder-discriminating sensor is detected.

20. A control system according to claim 14, wherein said fail-safe action means inhibits operation of said first control means and cause said second control means to operate, when diverging of an air-fuel ratio correction coefficient output from said first control means is detected by said abnormality-detecting means.

21. A control system according to claim 14, wherein said engine includes an intake passage, and a throttle valve arranged in said intake passage, said operating condition-detecting means including a throttle valve opening sensor for detecting a degree of opening of said throttle valve, an intake passage pressure sensor for detecting pressure within said intake passage at a location downstream of said throttle valve, and an engine rotational speed sensor for detecting a rotational speed of said engine, said fail-safe action means inhibiting operation of said first control means and causing said second control means to operate, when abnormality of said throttle valve opening sensor is detected, provided that said pressure within said intake passage detected by said intake passage pressure sensor is lower than a predetermined value set according to said rotational speed of said engine detected by engine rotational speed sensor.

22. A control system, for an internal combustion engine having a fuel supply system, and an exhaust system, comprising:

an air-fuel ratio sensor arranged in said exhaust system;

control means for calculating an air-fuel ratio correction coefficient based on an output from said air-fuel ratio sensor by using a controller of a recurrence formula type to control an amount of fuel to be supplied to said engine in a feedback manner such that an air-fuel ratio of an air-fuel mixture supplied to said engine is converged to a desired air-fuel ratio;

smoothing means for smoothing a value of said air-fuel ratio correction coefficient calculated by said control means to obtain a smoothed value of said air-fuel ratio correction coefficient;

averaged coefficient value-calculating means for calculating an averaged value of said smoothed value of said air-fuel ratio correction coefficient; and abnormality-determining means for determining abnormality of said fuel supply system of said engine, based on said averaged value.

23. A control system according to claim 22, wherein said value of said air-fuel ratio correction coefficient used by said averaged coefficient value-calculating means is obtained when said air-fuel ratio detected by said air-fuel ratio sensor changes across said desired air-fuel ratio value.

24. A control system according to claim 22, wherein said engine including an intake system, a fuel tank, an evaporative emission control system for purging evaporative fuel generated from said fuel tank into said intake system, said control means having inhibiting means for inhibiting purging of evaporative fuel by said evaporative emission control system, when said averaged value of said smoothed value of said air-fuel ratio correction coefficient is smaller than a predetermined value which is slightly larger than a lower limit value of said averaged value, and for inhibiting determination of said fuel supply system by said abnormality-determining means when said averaged value exceeds said predetermined value after said inhibition of said purging of evaporative fuel by said evaporative emission control system.

25. A control system according to claim 22, wherein said abnormality-determining means determines that said fuel supply system is abnormal when said averaged value lies outside a range defined by predetermined upper and lower values.

* * * * *